US008613678B2

(12) United States Patent
Nusbaum et al.

(10) Patent No.: US 8,613,678 B2
(45) **Date of Patent: *Dec. 24, 2013**

(54) ELECTRONICALLY CONTROLLED GOLF SWING ANALYZING/TRAINING MAT SYSTEM WITH BALL STRIKING-RELATED FEEDBACK

(71) Applicant: Mark Edward Nusbaum, McLean, VA (US)

(72) Inventors: Mark Edward Nusbaum, McLean, VA (US); Jan E. Rhoads, Grapevine, TX (US)

(73) Assignee: Mark E. Nusbaum, Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/650,602

(22) Filed: Oct. 12, 2012

(65) Prior Publication Data

US 2013/0090180 A1 Apr. 11, 2013

Related U.S. Application Data

(63) Continuation of application No. 13/067,392, filed on May 27, 2011, now Pat. No. 8,287,398, which is a continuation of application No. 11/582,546, filed on Oct. 18, 2006, now Pat. No. 7,959,521.

(60) Provisional application No. 60/815,254, filed on Jun. 21, 2006, provisional application No. 60/842,011, filed on Sep. 5, 2006.

(51) Int. Cl.
*A63B 57/00* (2006.01)

(52) U.S. Cl.
USPC ..... 473/278

(58) Field of Classification Search
USPC ..... 473/131, 150, 154, 168, 278, 461; 273/85, 181, 176, 245
See application file for complete search history.

(56) References Cited

U.S. PATENT DOCUMENTS

| | | | | |
|---|---|---|---|---|
| 4,136,387 | A | | 1/1979 | Sullivan et al. |
| 5,269,519 | A | * | 12/1993 | Malone ..... 473/154 |
| 5,303,924 | A | | 4/1994 | Kluttz et al. |
| 5,474,298 | A | | 12/1995 | Lindsay |

(Continued)

OTHER PUBLICATIONS

Tactilus Documents, Sensor Products, 18 pages, Aug. 24, 2005.

(Continued)

*Primary Examiner* — David L Lewis
*Assistant Examiner* — Eric M Thomas
(74) *Attorney, Agent, or Firm* — Nixon & Vanderhye P.C.

(57) ABSTRACT

A golf practice mat includes an impact sensor disposed in a vicinity bounding the location of where a golf ball would be placed for striking. The golf practice mat may also include, for example, a "crosshair" target imprint that is disposed on a golf club impact sensor portion of the practice surface and indicates the point/line of contact that the club face should hit the ground after the ball has been struck with the club head in a descending blow. A microcontroller receives and analyzes the output of the impact sensor and generates a display/output message that is coupled to a display that is, for example, embodied on the golf practice mat to provide user shot-related feedback. The display may indicate, for example, the user's golf club, the estimated distance the ball will travel depending upon the impact data analyzed, the club chosen by the user, input backswing data and/or a three-dimensional simulation of the resulting golf stroke.

21 Claims, 41 Drawing Sheets

(56) References Cited

U.S. PATENT DOCUMENTS

| | | | | |
|---|---|---|---|---|
| 5,586,940 | A * | 12/1996 | Dosch et al. | 473/140 |
| 5,826,874 | A | 10/1998 | Teitell et al. | |
| 5,885,168 | A | 3/1999 | Bair | |
| 5,935,014 | A | 8/1999 | Lindsay | |
| 5,943,044 | A | 8/1999 | Martinelli et al. | |
| 6,139,443 | A | 10/2000 | Reynolds | |
| 6,155,931 | A | 12/2000 | Perrine | |
| 6,292,181 | B1 | 9/2001 | Banerjee et al. | |
| 6,322,455 | B1 | 11/2001 | Howey | |
| 6,441,745 | B1 | 8/2002 | Gates | |
| 6,458,040 | B1 * | 10/2002 | Veazie, III | 473/268 |
| 6,515,586 | B1 | 2/2003 | Wymore | |
| 6,570,557 | B1 | 5/2003 | Westerman et al. | |
| 6,659,775 | B1 | 12/2003 | Moy | |
| 6,913,799 | B2 | 7/2005 | Brundula et al. | |
| 6,995,752 | B2 | 2/2006 | Lu | |
| 7,022,026 | B2 | 4/2006 | Blankenship | |
| 7,104,900 | B1 | 9/2006 | Finley | |
| 7,115,044 | B2 | 10/2006 | Faltin | |
| 2005/0032580 | A1 | 2/2005 | Rango | |
| 2005/0107180 | A1 | 5/2005 | Halleck et al. | |

OTHER PUBLICATIONS

"Sensor Tests for Interface Contact Stresses", Sensor Products, Engineeringtalk, www.engineeringtalk.com/news/seb/seb105.html, Jun. 4, 2001, 3 pages.

"A Hybrid Position and Displacement Sensor: The ASET sensor measures interfacial stresses in real time." Sensor Products, New Jersey, NASA Tech Briefs, Jun. 1999, 2 pages.

"Tactilus: Tactilus Real-Time Pressure Mapping Systems", Sensor Products, LLC, 8 pages, Aug. 2005.

"The Tactile Surface Pressure Experts, Impact Systems" Sensor Products, LLC, 8 pages, Aug. 24, 2005.

"Tactilus: Real-Time Surface Pressure Mapping Technology", Sensor Products, LLC, www.sensorprod.com/tactilus.html, 3 pages, 2005.

* cited by examiner

| Club / Stroke | Lob Wedge Distance | Sand Wedge Distance | Pitching Wedge Distance |
|---|---|---|---|
| 7:30 | 35 | 45 | 55 |
| 9:00 | 55 | 70 | 85 |
| 10:30 | 75 | 90 | 110 |

Memory Table

FIG. 5A

| Mode | Stroke |
|---|---|
| L1 | LW 7:30 |
| L2 | LW 9:00 |
| L3 | LW 10:30 |
| S1 | SW 7:30 |
| S2 | SW 9:00 |
| S3 | SW 10:30 |
| P1 | PW 7:30 |
| P2 | PW 9:00 |
| P3 | PW 10:30 |

ModeTable

FIG. 5B

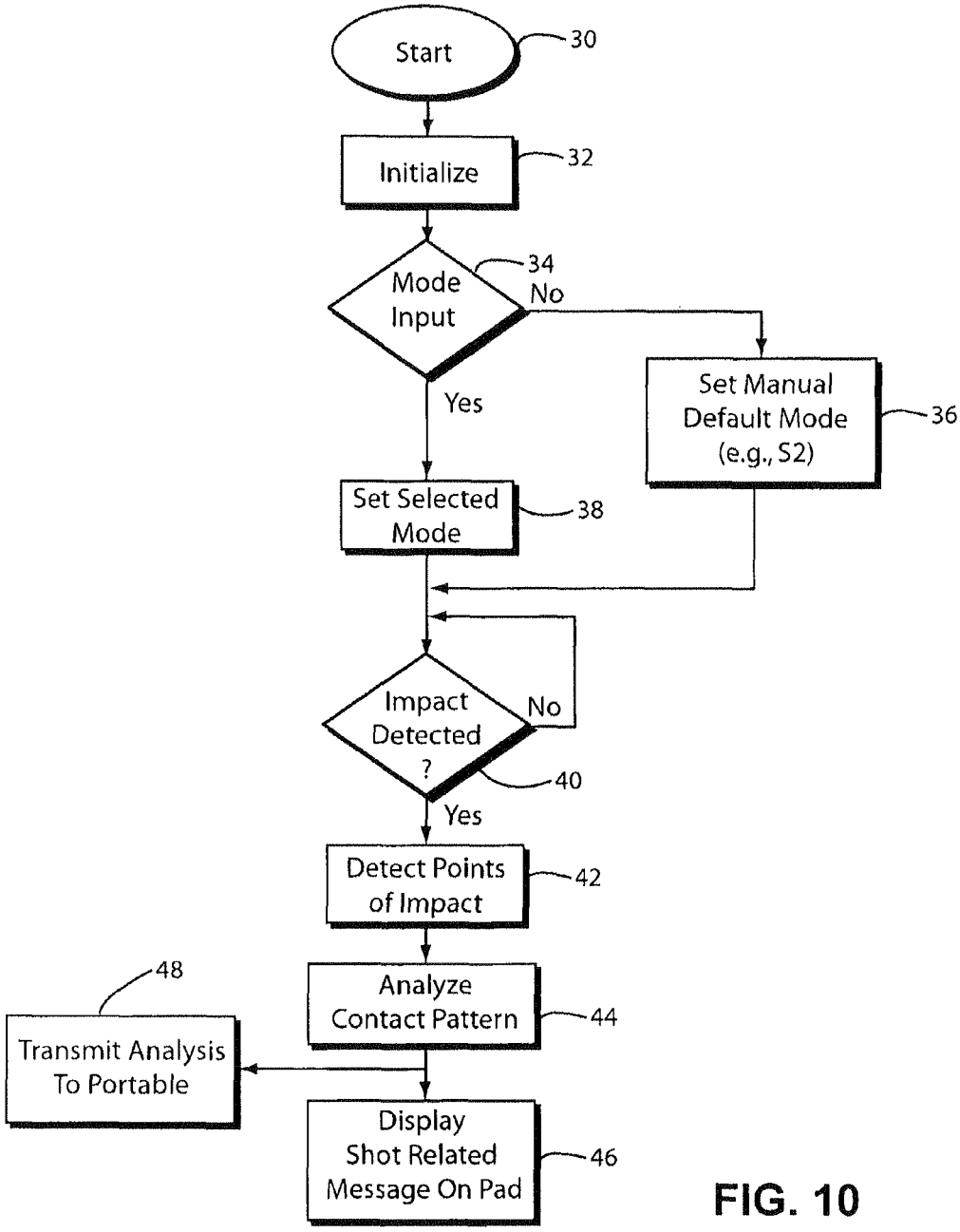
FIG. 10
FIG. 11A
Ball Flight Right
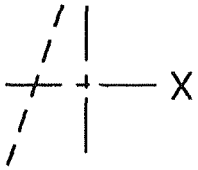
FIG. 11B
Ball Flight Left
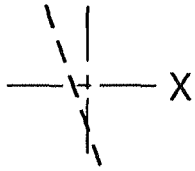
FIG. 11C
Ball Flight Straight
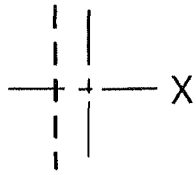

FRONT VIEW

SIDE VIEW

*NOTE: WITHIN EACH ROW, POINTS ARE NUMBERED 1 TO 32 FROM BOTTOM UP

ELECTRONICALLY CONTROLLED GOLF SWING ANALYZING/TRAINING MAT SYSTEM WITH BALL STRIKING-RELATED FEEDBACK

CROSS-REFERENCE TO RELATED APPLICATIONS

This is a continuation of application Ser. No. 13/067,392, filed May 27, 2011, which is incorporated herein by reference in its entirety, and which issued on Oct. 16, 2012 as U.S. Pat. No. 8,287,398, which is a continuation of application Ser. No. 11/582,546, filed on Oct. 18, 2006, which application is incorporated herein by reference, which issued on Jun. 14, 2011 as U.S. Pat. No. 7,959,521, and which claims the benefit under 35 U.S.C. 119(e) of Provisional Application Nos. 60/815,254 and 60/842,011, filed Jun. 21, 2006 and Sep. 5, 2006, respectively.

FIELD OF THE INVENTION

The invention generally relates to golf practice equipment apparatus and methodology. More particularly, the invention relates to an electronically controlled, golf swing analyzing/training/instructional mat system which provides a wide range of golf ball striking feedback.

BACKGROUND AND SUMMARY OF THE INVENTION

The game of golf has been a source of frustration for multitudes of golfers who have struggled to achieve consistently good results when playing this very difficult game.

Part of the difficulty in reducing golf scores and/or striking the ball consistently well is that much of what is required to be a good golfer is anti-intuitive to most players. For example, while great emphasis is placed in many golf courses on hitting the ball a long distance, attempts by beginner golfers to strike the ball with great impact, typically leads to the golfer tensing up and failing to hit the ball with the smooth, seemingly effortless stroke that often characterizes a long ball hitter having proper swing and ball striking techniques.

Similarly, beginner golfers attempting, for example, to hit a high arching shot using a pitching wedge, intuitively attempt to swing up at the ball in a misguided effort to hit it high. In contrast, the proper ball striking technique involves hitting down on the ball just prior to impact and letting the angle of the club face work to loft the ball.

There is a need for golf practice equipment that provides a wide range of user feedback to reinforce a swing that will result in good ball contact and to help correct a habitual swing/ball strike that will predictably result in bad ball contact. In this fashion, particularly when coupled with professional guidance, a golfer may develop a swing that results in optimum ball striking that becomes second nature. Without proper instructional guidance and positive feedback, proper ball striking cannot be readily accomplished.

In accordance with a first exemplary, non-limiting implementation of the present invention, a golf practice mat includes an impact sensor disposed in a vicinity bounding the location of where a golf ball is to be envisioned by the user. By way of example only, a circular indication of the position where a golf ball would be placed for striking is embodied on the practice mat.

The golf practice mat also includes, in an exemplary implementation, a "crosshair" target imprint that is disposed on a golf club impact sensor portion of the practice surface. The target imprint indicates the point/line of contact that the club face should hit the ground after the ball has been struck with the club head in a descending blow. The "crosshair" location reflects the prevailing view that, when a golf ball is to be struck on a golf course fairway, the proper ball striking technique requires hitting down on the ball at impact.

In an exemplary embodiment, a microcontroller receives and analyzes the output of the impact sensor and generates display-related data/output message that is coupled to a display that is, for example, embodied on the golf practice mat to provide stroke/shot-related feedback. In an illustrative embodiment, the display may, for example, provide an indication of the club chosen by the user, the user input amount of backswing rotation, the projected path of the ball after being struck, the estimated distance the ball will travel based upon a projection in light of the impact data analyzed, and/or a line of club head contact with the mat indicative of the disposition of a divot on an actual golf course. In an illustrative implementation, the display may include a 3D simulation of the resulting golf stroke and ball flight.

In an illustrative implementation, an Initial Strike Feedback Circle is embodied on the practice mat that pinpoints exactly where the golfer's initial club head strike fell with respect to an ideal strike point to thereby provide a divot-related indication. The idea behind this is to stimulate the golfer to adjust his/her stroke on the next swing to match an ideal strike point. In an illustrative embodiment, two circles are drawn around the center of a mat zero line, which is the ideal strike point. These circles are populated with closely-packed LEDs that can be individually activated to display, for example, the initial club head strike line.

Certain of the illustrative implementations are based in part upon a recognition that by a microcontroller analyzing the output of an array of impact sensors that detect club head contact at the points corresponding to where a divot would be taken on an actual golf course much can be learned/projected about the golfer's swing and the resulting golf shot. For example, much can be learned about the quality of the golfer's swing just from the size of the initial club head footprint on the impact mat/sensors and its horizontal X-Y position and rotational angle. Then, expanding this 2D geometric model to 3D, more can be learned from the footprint's initial vertical Y-Z downward pressure and rotational angle from toe to heel gleaned from small deltas in the pressure gradient across the length of the footprint in the Y-Z plane. Moreover, even more can be learned within each footprint from any small positional and rotational deltas that are described herein.

In an exemplary embodiment, the device stores a set of a user's golf club impact data over time and analyzes such data for stroke/shot-related trends, e.g., typically makes contact with the clubface open or closed to result in a ball path to the right or left, typically makes contact too far in front or behind the ball, etc. In this fashion, a user may be provided with 1) a wide range of real time and long range swing/ball striking-related feedback and/or 2) real time projected golf shot-related feed back.

Moreover, such data may be processed in accordance with an illustrative implementation such that it may be used by golf club manufacturers and retail outlets for club fitting and optimum golf club selection tailored to the swing of a given golfer. In accordance with illustrative implementations, this data may be processed and advantageously utilized to assist in the selection and/or fitting of the optimum golf club, e.g., TaylorMade, Callaway, Ping, etc., tailored to the swing of a user. Thus, the golf apparatus described herein may be utilized for other applications beyond golf training.

In accordance with a non-limiting exemplary implementation, the visual display may be accompanied by or, if desired, replaced with an audio indication of the stroke analysis.

In accordance with a non-limiting, exemplary implementation, the golf practice mat may include an input mechanism enabling the user to select, for example, a club and stroke to utilize, e.g., a sand wedge to be hit with a short, medium or full backswing. Such backswings, when analogized to the hands of a clock are often referred to, for example, as 7:30, 9:00 and 10:30 position backswings.

In accordance with an exemplary implementation, the optimum distance traveled for each club desired to be included is stored in a memory table embodied in the practice mat's associated microcontroller-based electronics. In one illustrative embodiment, the memory table associates for each club and each of a variety of backswings, an optimum distance value. The table is accessed by the microcontroller to compute stroke distance.

A user, in accordance with an exemplary implementation, selects a manual or automatic mode of operation. In the manual mode of operation, the user inputs the mode of operation defining the club and the stroke utilized. In an automated mode of operation, the microcontroller informs the user via the display and/or an audio output such club and stroke information and sequences through pre-programmed practice drills.

In accordance with a further exemplary embodiment, a user is provided with instructional materials depicting the proper ball striking stroke for various type of shots, such as a distance wedge, short chip, etc. Such materials may be provided in a booklet form provided in association with the golf practice mat.

In a further exemplary embodiment, such golf swing instructional materials may be provided, for example, in a memory card associated with a portable or any other type of computing device. The portable computing device may in accordance with such an exemplary embodiment display a sequence of videographic displays that show, for example, the proper body position for the backswing, ball strike/impact and follow through positions. Because there are varying views with respect to the proper stroke, such memory cards may be generated to represent the approach taught by various well-respected golf professionals/schools (e.g., Dave Pelz, A J Bonar, etc.) and users will preferably be provided with a choice of instructional golf swing sequences. Alternatively, in a further illustrative implementation, the memory card may be received in a memory input port associated with the practice mat microcontroller and the instructional materials may be displayed on the practice mat display.

In yet a further exemplary embodiment, the portable computing device may be utilized to communicate to the microcontroller and control the practice mat display. The mode of operation may be selected by the user from a portable computing device via, for example, conventional wireless communication protocols.

Further, in an illustrative embodiment, after the practice mat microcontroller has analyzed the impact related data, results may be wirelessly communicated to the portable or other computing device for generation of the display of a three-dimensional animated simulation of the results of the stroke that may include the replication of any desired golf course hole. Such a simulated display may be generated on a display screen of any size, including a large TV screen display.

In accordance with further exemplary embodiments, the practice mat may be supplemented with putting extensions/attachments for recording and displaying putts made from various distances in a putting mode of operation. Instructional putting videographic sequences may also be associated with this mode of operation.

In a further exemplary embodiment, the mat be utilized in conjunction with a tethered whiffle golf ball or a hollow, partial or substantially spherical rubber golf ball shell replica fixed to the mat to aid the golfer in envisioning an actual golf placement while practicing golf strokes.

These and other features and advantages of the illustrative embodiments described herein will become apparent with reference to the following drawings and accompanying specification.

BRIEF DESCRIPTION OF THE DRAWINGS

FIGS. 5A and 5B are illustrative memory tables that are utilized by a microcontroller during mode entry and distance calculation.

FIG. 10 shows a modified version of the flowchart in FIG. 8, for microcontroller 4, where the system includes a portable computing device.

FIG. 11A shows an illustrative ball flight right indicating display.

FIG. 11B shows an illustrative ball flight left indicating display.

FIG. 11C shows an illustrative ball flight straight indicating display.

FIGS. 15A-1 through 15A-3 illustratively depict how deviations in vertical X-Z alignment of the club can be detected by horizontal arrays of pressure sensors in an illustrative embodiment of the present invention.

FIGS. 15B-1 through 15B-3 illustratively depict how deviations in vertical Y-Z alignment of the club can be detected by horizontal arrays of pressure sensors in an illustrative embodiment of the present invention.

FIGS. 20A-1 and 20A-2 show the nominal dimensions of a typical sand wedge.

DETAILED DESCRIPTION OF THE ILLUSTRATIVE EMBODIMENTS

While the apparatus and methodology embodying the present invention may be implemented in many different forms, there is shown in the following drawings and will be described in detail herein specific embodiments thereof, with the understanding that the present disclosure is to be considered as an illustration of some of the many ways of using the claimed invention. This description should not be construed to limit the claimed invention to the specific embodiments described and illustrated herein.

Figure 1:
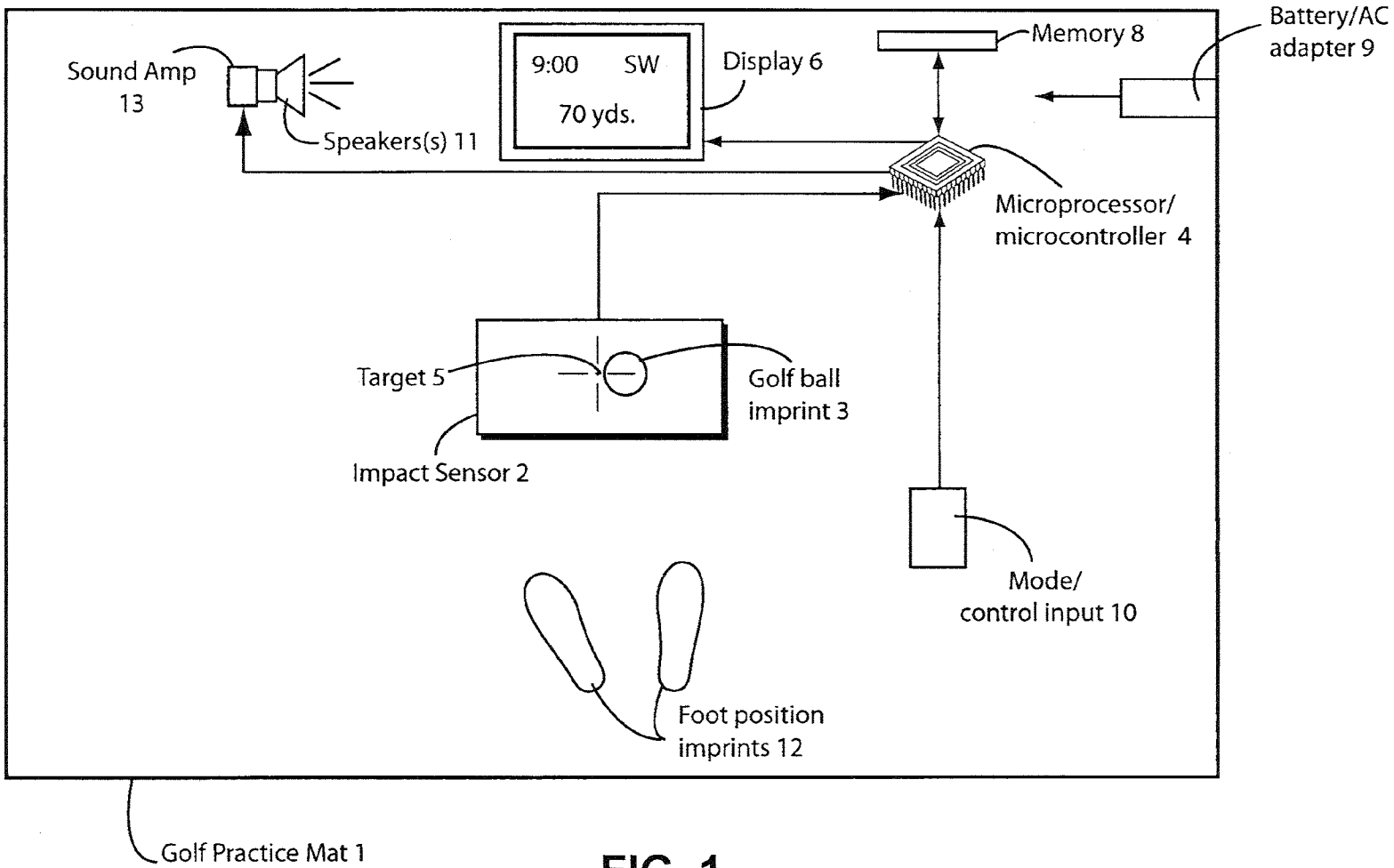
FIG. 1 is a schematic diagram of an exemplary non-limiting illustrative golf practice mat-like structure.

FIG. 1 is a schematic diagram of an exemplary, non-limiting illustrative golf practice apparatus and instructional training aid in accordance with one illustrative embodiment of the present invention. Golf practice mat 1, in accordance with one illustrative embodiment, may be constructed at least in part from any of a number of materials such as various artificial golf turfs including, for example, a grass-like surface having the ability to cushion a golf club striking the surface, permitting a golfer to hit down on a golf ball and into the turf to simulate taking a divot after striking the ball. The illustrative embodiment is depicted for a right-handed golfer. The practice/training device may, of course, be modified for left-handed golfers. The practice/training device may be of various overall dimensions, e.g., 3 by 5 feet, or may be square (e.g., 3 by 3 feet) for ease of use for either left or right-handed play.

By way of example only, the non-ball striking portion of mat 1 may, in accordance with a low cost implementation, be constructed using a carpet-like material such as, for example, a sturdy outdoor carpet. In an exemplary embodiment, the ball striking practice portion of the mat may be constructed from an artificial turf base such as disclosed in U.S. Pat. No. 6,155,931, (the '931 patent). The '931 patent is directed to a golf swing practice structure comprising a low friction flexible and resilient top sheet that is contacted by the golf club. The top sheet has a rigidity of 40 pounds per square inch or less and has an underlying supporting pad for supporting the top sheet and for providing space for the top sheet to move under force of the club. The support pad is compressible to 50% of its resting height in any area near its center line by an applied pressure of 8 psi or less. A bottom sheet is used underneath the support pad.

Alternatively, the mat fabric may be constructed primarily of the artificial turf structures as described in U.S. Pat. Nos. 6,913,799; 6,139,443; or 5,885,168. Each of the above-identified exemplary golf practice mat artificial turf structures are incorporated herein by reference.

In an illustrative implementation, golf practice mat 1 includes an impact sensor 2, having a golf ball representation/replica/imprint 3 and a target 5 imprinted or otherwise fixed thereto. Although in this illustrative embodiment, a circle the diameter of a golf ball may be used as a golf ball representation/imprint/replica (golf ball representation) 3, it should be understood that the golf ball may be represented in various other ways. In one implementation, an actual whiffle golf ball that, for example, is tethered to and placed on an indicated golf ball imprint also may be utilized. Additionally, in an exemplary embodiment, a hollow, partially or substantially completely spherical golf ball-dimensioned shell fastened to the mat may be utilized to give the golfer a three-dimensional target. This target should be constructed using a highly elastic substance, e.g., rubber, that will not be damaged by the full brunt of repeated swings. In this fashion, a golfer can practice ball striking with an object resembling a golf ball without damaging the object by repeated striking.

The golf ball imprint 3 position may be varied in its disposition on impact sensor 2 in various implementations. As shown in FIG. 1, the disposition is such that the sensor/processing system can detect when the club head strikes impact sensor 2 before reaching the defined ball position. In this fashion, a relatively low ball impact "fat" short distance practice shot may be detected. Alternatively, in an exemplary embodiment, the golf ball may be disposed on the right-hand edge of the impact sensor 2, so that sensor 2 provides reinforcing feedback only for practice swings where the club head impacts the impact sensor after the represented ball would have been struck.

The target 5 is preferably disposed in relation to golf ball imprint so as to reinforce the well known golf ball striking methodology of hitting down on the ball and using the angle of the club face to direct the ball to the optimum height.

The design of impact sensor 2 may be varied widely depending upon the desired stroke analysis. For example, merely detecting that the club head made contact with impact sensor 2 after the swing passes golf ball imprint 3, requires a coarser detection methodology than if it is desired to determine the angle of the club face upon contact.

Impact sensor 2 may, by way of example, be constructed with a contact touch pad including impact and/or pressure sensors to permit derivation of multiple contact point information, such that a set of club contact data points are generated. Impact sensor 2 is mounted on golf practice mat 1 such that it is substantially coplanar with the rest of the top fabric practice mat surface.

Impact sensor 2 may be the sensor element (and if desired may include the interface controller and software) of the real-time electronic tactile sensor from Sensor Products, Incorporated commercially available as Tactilus. Tactilus is an electronic tactile force and pressure-indicating sensor. The sensor system allows the user to monitor precisely how force is dispersed between any two contacting or mating surfaces in real-time while the event occurs. In one illustrative implementation, the golf club head contact with the impact sensor portion of the practice mat may be monitored with Tactilus, a system that is capable of use in systems where pressure lies between 0.001 PSI (0.0007 Kg/cm2) to 2,000 PSI (140.61 kg/cm2).

The Tactilus sensor element is essentially a thin flexible or rigid sheet that is densely packed with sensing points or pixels. These sensing points can be spaced as close as 1 mm (0.04") apart and can collect data as rapidly as 2,000 readings per second. The sensing points may use capacitance, resistance or piezoresistance architectures. The Tactilus system may be used to generate 2D, 3D and 360 degree image rendering with extensive user control, local point and region-of-interest (ROI) analysis, force integration and average pressure, pressure vs. time graph and pressure histogram, sophisticated calibration control and offers an extensive software library for application customization. An exemplary implementation using the Tactilus sensor is described in detail below.

Figure 2:
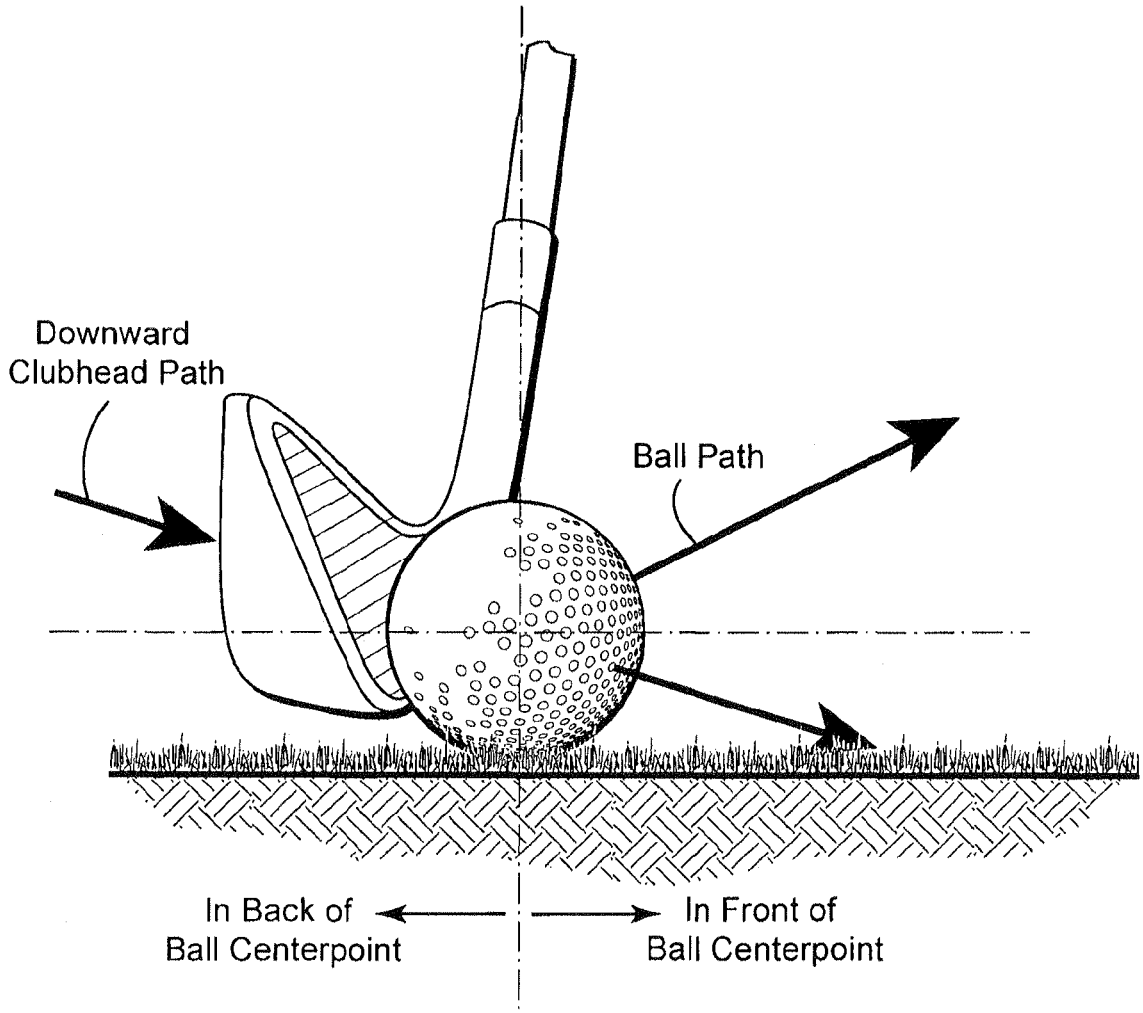
FIG. 2 depicts the desired downward motion of a club head such that it will take a divot only after the ball leaves the club face.

Alternatively, as an alternative to the Tactilus impact sensor that is described in detail below, impact sensor 2 may be a tactile sensor of the various types disclosed in U.S. Pat. No. 6,515,586 (the '586 patent), which is incorporated herein by reference. For example, in the '586 patent as shown in FIGS. 2 and 3 (see these figures for the cited sensor component reference numerals that follow), a tactile sensory surface is comprised of three layers consisting of a surface layer 204, a backing or foundation layer 206, and a sensory layer 208. The sensory layer 208 may be located between the surface and backing layers, 204 and 206, respectively. The sensors 202 may be integrated directly into the top or bottom side of the backing layer 206 at the time of manufacturing. The surface layer 204 may be, for example, a carpet layer where the sensors 202 are woven directly into the carpet fibers or in an artificial turf. As described in the '586 patent, the sensors may be embodied in any desired size surface area.

As described in the '586 patent and as shown in FIGS. 2 and 3 therein, sensory layer 208 may include plurality of sensors 202, sensor leads 210, width resistor indicators 212, width resistor wire pairs 214, length resistor indicators 216, a length resistor wire pair 218, multiplexers (or row multiplexers) 220 and a data bus 222. The sensors 202 can be arranged in any suitable pattern or field, including, but not limited to a grid pattern, hexagonal pattern, and so forth.

In the present impact sensor 2 application, although sensors 202 are preferably disposed in a pattern placed in rows, sensors 202 can be arranged in any suitable manner, including horizontally, vertically or diagonally. In an exemplary embodiment, the sensors are arranged in rows 209 to form a grid, and run across the width of the tactile sensory surface. Each separate row of sensors 202 can be spaced the same distance apart as the distance between individual sensors 202 in a row 209 to form a square/rectangular grid pattern. The sensors are, for example, about one cm. in diameter and are arranged in rows 209 with spacing between sensors of about 0.5 cm or less within each row 209.

Within a given row 209, there are a suitable number of sensors 202 connected to at least one row multiplexer via one or more sensor leads. The sensor lead can comprise one continuous wire as shown, or can include a series of wires running between each sensor 202, such that there is a small gap within the diameter of the sensor 202 where a wire or sensor lead 210 is not present.

Each sensor 202, when activated, sends out a particular signal to the row multiplexer 220 for that row, depending on the type of sensor 202, and in some cases, the degree of activation.

The sensors 202 can be any suitable type, such as force sensors or pressure sensors. Force sensors include, but are not limited to, piezo polymers and ceramic strain gauges. A pressure sensor gives the same constant force reading, which is inversely proportional to the area of the applied force. In one embodiment, the sensors 202 are responsive to variable pressures and can be adjusted. In an alternative embodiment, the sensors 202 are binary "on/off" sensors having a minimum threshold pressure needed to activate. For example, the minimum threshold pressure may be set to be less than about seven (7) bars (about 0.5 psi), up to about 1.5 bars (about 10 psi) to about 15 bars (about 100 psi) or more.

In a further embodiment, each sensor 202 may be comprised of layers of material which can detect contact pressure or whose electrical resistance or capacitance changes with an increase in pressure applied to the sensor 202. Such materials include, but are not limited to thin film sensors, such as piezo film. Piezo film is available in a wide variety of thicknesses and configurations, and is known to be flexible, lightweight and durable.

Another type of thin film sensor which can be used is a sensor device known as a force and position-sensing resistor (FSR). Such a device can detect both force and position, and typically displays a resistance of the square root of the area of the applied force. Two basic types of FSRs include an FSR-LP linear potentiometer and an "XYZ" pad. The FSR-LP has conducting fingers shunted by a conductive polymer, such that a greater number of shunted fingers produces a greater dynamic range and resolution. The XYZ pad or tablet is essentially two FSR-LPS set back-to-back. FSR devices are known to be impervious to moisture, chemicals, vibration and magnetism. The FSR device used can be of any suitable size and shape. The current should be set at a level appropriate to the golf practice mat application. In a particular embodiment, the sensors used are FSR devices from Interlink Electronics in Camarillo, Calif.

In accordance with a further exemplary embodiment, impact sensor 2 may be modular in design so that it may be readily replaced if damaged. Such a modular approach may be particularly useful for implementations when the sensor array is constructed with sensors that are relatively susceptible to damage. The use of a sensor array that may be readily replaced may advantageously increase the practicality of using sensors that are lower in cost. As will be appreciated by those skilled in the art, such an impact sensor 2 should be designed using, for example, multiplexers to minimize the number of conductors at the impact sensor module interface.

In accordance with a low cost implementation, impact sensor 2 may be implemented with a material that may change in contour to visually indicate the point at which the club head made contact with the practice mat 1. Alternatively, the material may be pressure sensitive so as to change in color in response to contact with a club head. For example, in one illustrative implementation, the impact sensor 2 may be comprised of a visco-elastic material beneath and, for example, adhesively attached to an artificial turf/outdoor carpet-type top mat surface. The characteristics of such a material is that it combines viscous and elastic behaviors; the scientific term to describe memory foam. Visco-elastic, or memory foam is a temperature and pressure sensitive material often used in mattresses and pillows to relieve pressure, ease and prevent back and neck problems. Visco-elastic foam is made of thousands of tiny cells which mold to any shape and revert back to their original form. In such a low cost implementation, this material may be used to provide a visual indication/feedback of the initial club strike point and the nature of a resulting divot had the stroke been performed on a golf fairway. Such visco-elastic material may be used in conjunction with any of the other embodiments to at least a limited extent to provide further visual feedback as to the initial club strike point. Further, any of these embodiments may be used with a replica of a golf ball with a visual cue (e.g., as reflected by a nail-like shaft going through the center of the golf ball) such as is shown in FIG. 2 depicting the downward angle at which the golf ball should desirably be struck. Such a replica of the type used by golf instructor, A. J. Bonar, may, for example, be disposed above the golf ball imprint on mat 1 well within the user's peripheral vision during a practice stroke to reinforce hitting down on the ball.

Whether the club contact points are indicated by a color, color shade, and/or contour change, the user would be provided with visual feedback as to how close the club head came to the ideal striking point. Such material will provide a visual indication of where in relation to the target a divot would have been taken if the swing were made at, for example, a golf course fairway. The user will, for example, be able to determine whether ball contact would have been made behind the ball.

Golf practice/training mat 1 also includes, in an exemplary embodiment, a display 6, one or more speakers 11 and a mode/control panel 10. Coupled to the mode/control panel 10 and impact sensor 2 is a microprocessor/microcontroller 4.

Display 6 may be any of a wide range of displays including an LCD or an LED display. By way of example only, display 6 may be mounted in practice mat 1 to be flush with the mat surface. Alternatively, display 6 may be an LCD display hingedly mounted such that it may be raised from the mat surface and angled to promote ease of visibility. In accordance with an illustrative embodiment, LCD display 6 may be include associated broadcast TV/video recording/playback (e.g., DVD) electronics to permit a user to practice while, for example, watch a golf instructional video, golf tournament or any desired programming. In a further embodiment, display 6 may be coupled to the golf practice mat 1 such that it is not disposed on the golf practice mat surface, but rather may be a display which is external to the mat and coupled to the microcontroller 4 via a wired or wireless connection.

Microprocessor/microcontroller 4 receives stroke data from impact sensor 2, analyzes the data and, as will be explained further below, generates a video graphics display that is coupled to display 6 and an associated audio output that is coupled to speakers 11. As will be explained further below, in one implementation, microcontroller 4, after analyzing the practice stroke data from impact sensor 2, generates a display on display 6 that identifies the club and backswing used (e.g., sand wedge (SW) and 9:00 stroke (see FIG. 3A)) and the projected distance of the shot. An audio indication of such a result may also be provided via speaker (s) 11 and sound amplifier 13.

Associated with microprocessor/controller 4 is a memory 8 that, for example, stores the software executed by microcontroller 4 together with memory tables utilized to generate the user's golf club yardage distance. Memory 8 may, for example, be a removable memory card, e.g., a flash memory card that is insertable into a memory receiving port (not shown) in mat 1. Memory 8 may alternatively be permanently resident in mat 1.

Microprocessor/microcontroller 4 is also operatively coupled to a mode/control input module 10. Mode/control input module 10 includes one or more control keys that are utilized, for example, to define the club and stroke used during a practice session segment. The club and stroke may be, in an exemplary embodiment, selected in response to a menu displayed on display 6. Alternatively, mode/control input module 10 may permit a user to key in a desired mode of operation as will be explained further below. Further, in accordance with yet another embodiment, mode/control input module 10 may be wirelessly coupled to microprocessor/microcontroller 4 to permit remote input of operating mode information and may be part of any of a number of commercially available portable or other computing device such as a PC.

The electronic components of practice mat 1 are powered by batteries/AC adapter 9 as shown in FIG. 1.

By way of example only, golf practice mat 1 may include foot position imprints 12 that, for example, aid the user in assuming the proper ball striking position during the session, e.g., the ball disposed half way between the user's feet, with the front foot disposed at a slight angle towards the target.

FIG. 2 graphically depicts the desired downward motion of a club head such that it will take a divot only after the ball leaves the club face. FIG. 2 depicts the teaching of golf professional A. J. Bonar, who recommends envisioning using the club to drive a nail down into the ground at the angle shown in order to properly address the ball during ball striking. See A. J. Reveals The Truth About Golf at page 43. A. J. Golf 2003. The FIG. 1 ball replica/imprint 3 and the target 5 represent the ball position and the point where a divot is taken in FIG. 2.

Figure 6A:
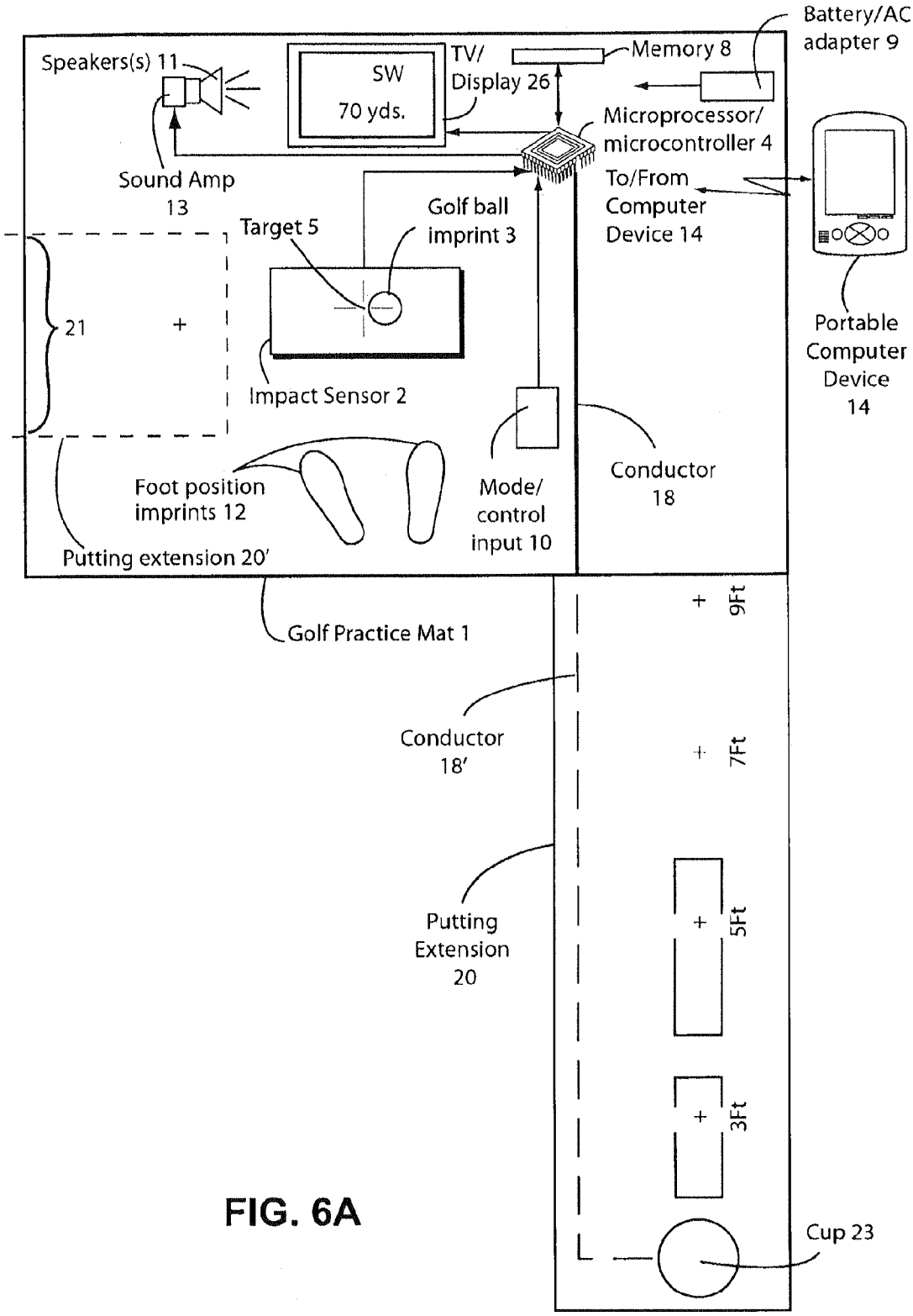
FIG. 6A is an illustrative block diagram showing a golf practice mat 1 modified to include a putting extension 20.
Figure 6B:
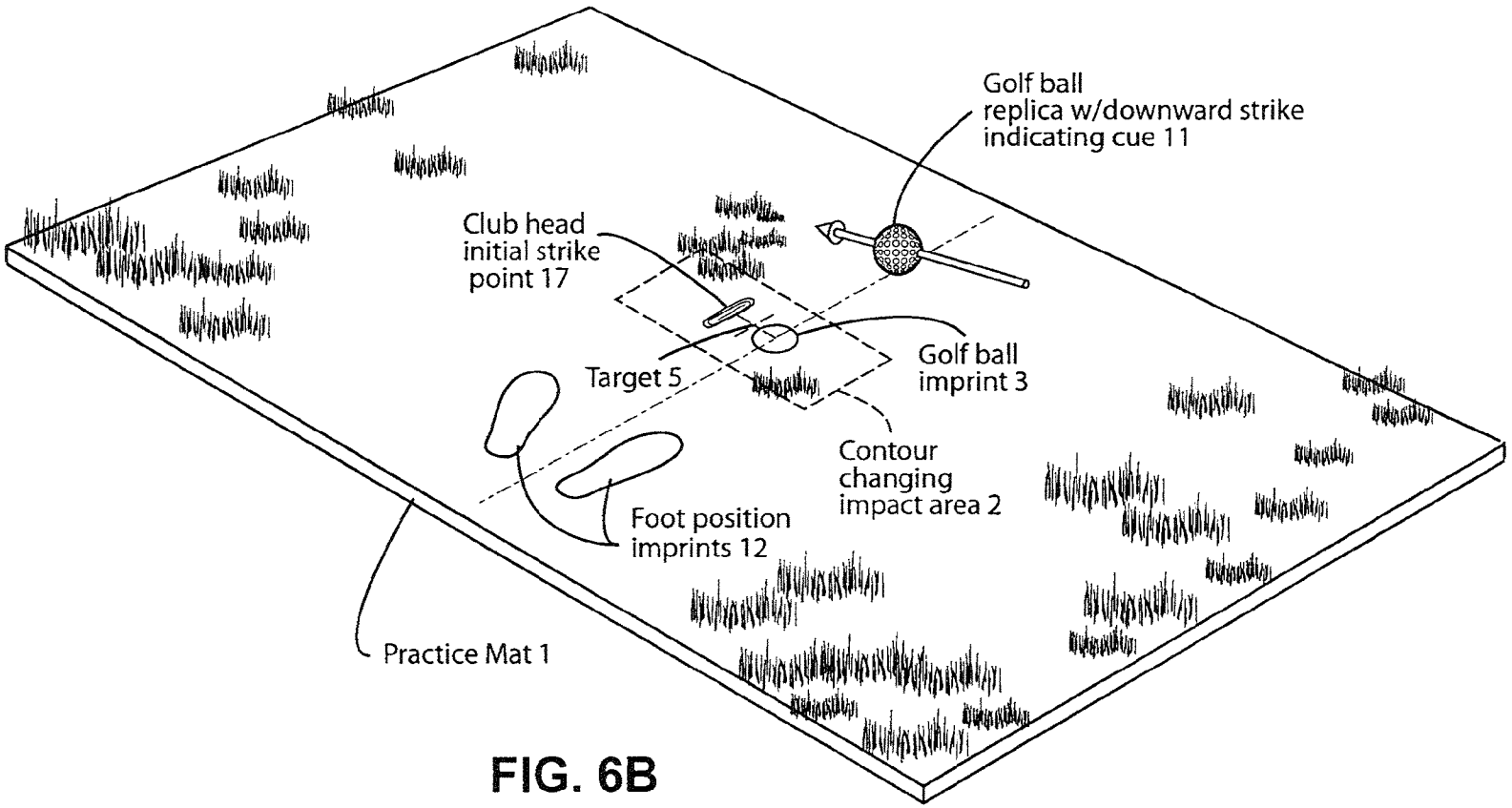
FIGS. 6B and 6C are further illustrative implementations of a golf practice mat that reinforces a descending blow-based ball strike.
Figure 6C:
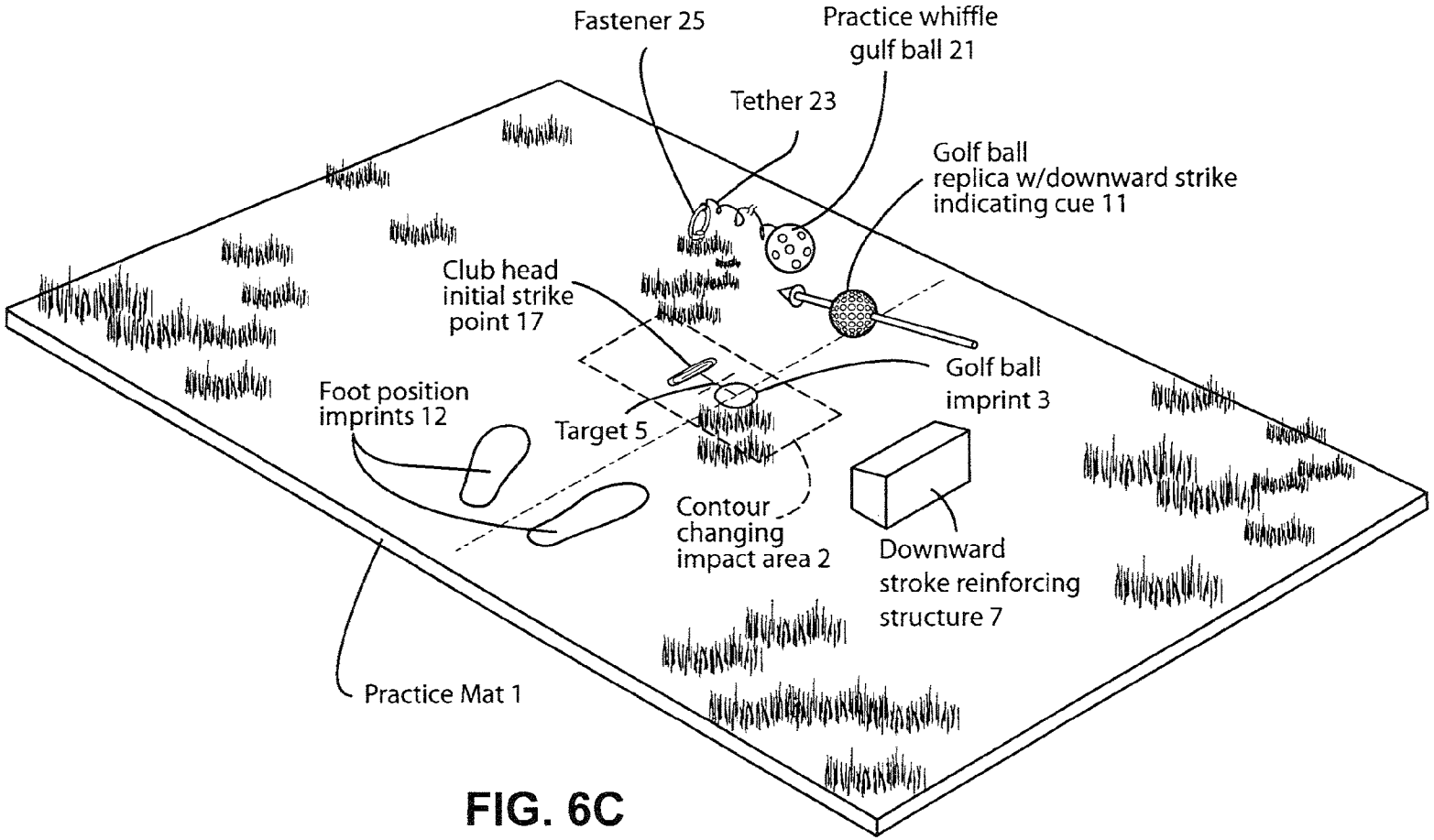

FIGS. 6B and 6C are illustrative implementations of a low cost golf practice mat that reinforces the descending blow-based ball strike shown in FIG. 2. As shown in FIGS. 6B and 6C practice mat 1 includes a contour changing impact sensing area 2. In this implementation, contour changing area 2 includes beneath and, for example, adhesively attached to the artificial turf/outdoor carpet top mat surface, a visco-elastic material. As set forth above, the characteristics of such a material is that it combines viscous and elastic behaviors; and is the scientific term to describe memory foam. Visco-elastic foam is made of thousands of tiny cells which mold to any shape and revert back to their original form. Such material will provide a visual indication of where in relation to the target a divot would have been taken if the swing were made at, for example, a golf course fairway. The user will, for example, be able to determine whether ball contact would have been made behind the ball.

In such a low cost implementation, this material may be used to provide a contour changing visual indication/feedback of the initial club strike point 17 and the nature of a resulting divot had the stroke been performed on a golf fairway, as is generally represented in FIGS. 6B and 6C. As indicated above, such visco-elastic material and the other components shown in FIG. 6C may be used in conjunction with any of the other embodiments to at least a limited extent to provide further visual feedback as to the initial club strike point 17 and to reinforce a downward blow-based ball strike. Thus, as shown in FIGS. 6B and 6C, any of these embodiments may be used with a replica of a golf ball with a visual cue 11 (e.g., as reflected by a arrow-like shaft going through the center of the golf ball) such as is also shown in FIG. 2 depicting the downward angle at which the golf ball should desirably be struck. Such a replica of the type used by golf instructor, A. J. Bonar, may, for example, be disposed as shown in FIGS. 6B and 6C above the golf ball imprint on mat 1 well within the user's peripheral vision during a practice stroke to reinforce hitting down on the ball.

As shown in FIG. 6C to further reinforce striking down on the ball, a downward stroke reinforcing structure 7 may be utilized to pose a physical barrier that the golf must aim to avoid or gently contact to thereby tend to force a downward blow of the correct angle to be made. The reinforcing structure 7 may be of any desired shape and is preferably made of a highly resilient material that can withstand occasional impact by a golf club and that, in turn, won't be damage the golf club or injure the golfer. In more sophisticated implementations the reinforcing structure may be adjustable in height to provide the appropriate ball addressing angle tailored to, for example, the golfer's height. For example, the barrier may be mounted in an inflatable tubular structure (not shown) that may be below the practice mat surface and inflated manually or via an attachable air pump to increase the height of the barrier as a function of the golfer's height. If desired the barrier may be coded with a stop inflation indication to identify a barrier height based upon the golfer's height to provide an indication of when the tube inflation will result in reinforcing a downward ball strike at an angle of approximately 15 degrees. When utilized in conjunction with the implementations having a microcontroller and impact sensors, the reinforcing structure 7 may, if desired, include a sensor so that the microcontroller can detect, for example, slight contact with reinforcing structure 7 and the impact sensor strike point.

As shown in FIG. 6C, in this implementation, practice mat 1 includes, for example, a practice whiffle golf ball 21 that may be placed over the golf ball imprint 3 and used for practice. Practice ball 21 is fastened to mat 1 via any of a wide range of fasteners 25 and is tethered via a tether 23, that may be, for example, a resilient string/rope, that will tend to bring the ball back towards mat 1 after contact is made. Such a practice ball 21 may be used in conjunction with any of the embodiments described herein.

Golf is an activity where it is important to practice utilizing the proper swing/ball striking technique. While what constitutes a proper technique may vary between golf schools/golf professionals, in a preferred implementation, the golf practice mat 1 should be utilized in conjunction with swing/ball striking instructional materials. In accordance with an exemplary embodiment, a user is provided with instructional written materials depicting the proper ball striking stroke for various type of shots, such as a distance wedge, short chip, etc.

In a further exemplary embodiment, such golf swing instructional materials may be provided, for example, on a memory card inserted into a memory port of a portable computing device 14 shown in FIGS. 3A-3F. The portable computing device 14 may, in accordance with such an exemplary embodiment, display a sequence of videographic displays that show, for example, the proper body position for the backswing, ball strike/impact and follow through positions. Such instructional videographic materials may alternatively be loaded into the practice/teaching system via a memory input port (not shown) coupled to microcontroller 4.

FIGS. 3A-3F are illustrative golf stroke sequences for hitting a lob wedge, sand wedge or pitching wedge for distances up to, for example, one hundred yards. Such video displays may be generated and displayed using portable computing device 14 that may, for example, be any of a number personal computing devices such as any of the hand-held devices manufactured by Palm, Inc. Preferably device 14 has a wireless communications capability. Other computing devices 14 that may be utilized as described herein include laptop and desktop computers. As noted above, golf practice mat 1 may in accordance with a low cost illustrative implementation take advantage of instructional graphics contained in an instructional brochure packaged with mat 1.

Figure 3A:
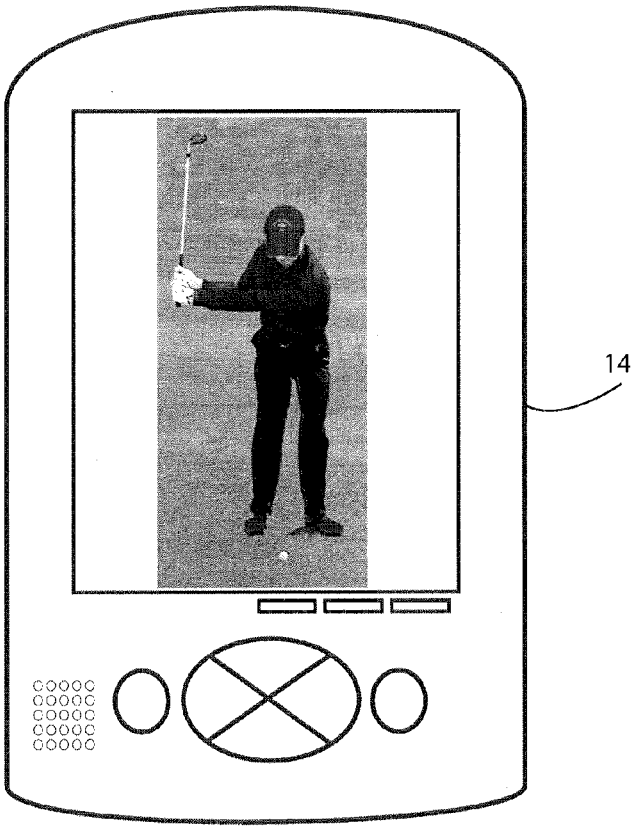
FIGS. 3A-3F are sequences of an illustrative golf stroke for hitting a lob wedge, sand wedge or pitching wedge.
Figure 3B:
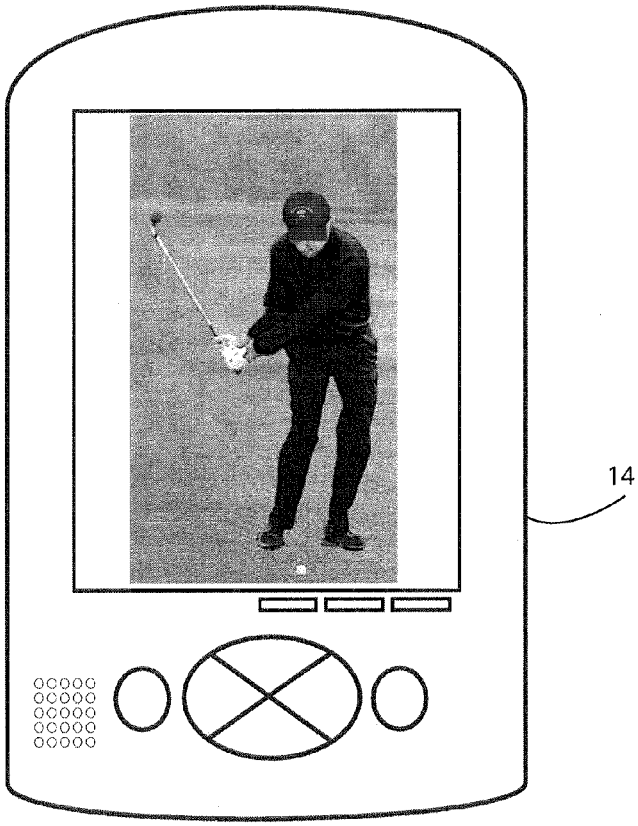
Figure 3C:
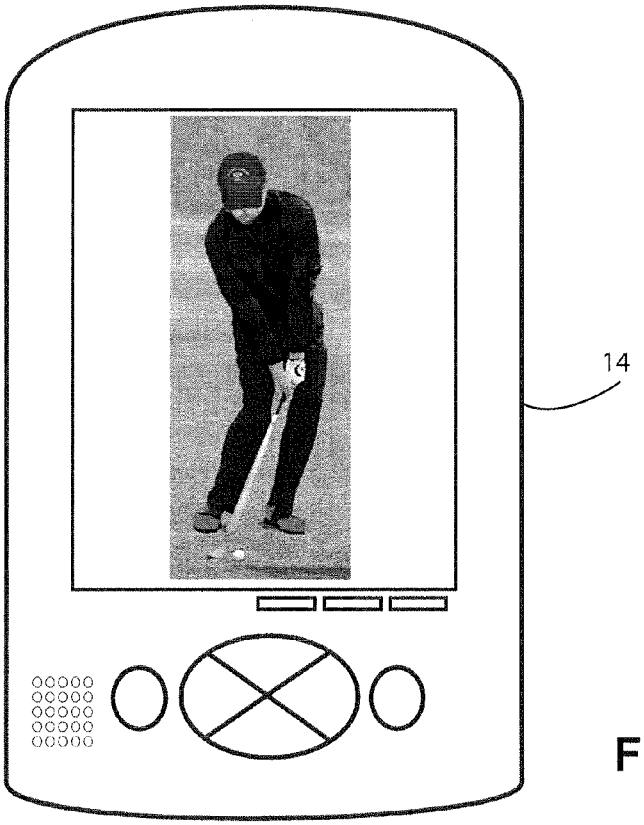
Figure 3D:
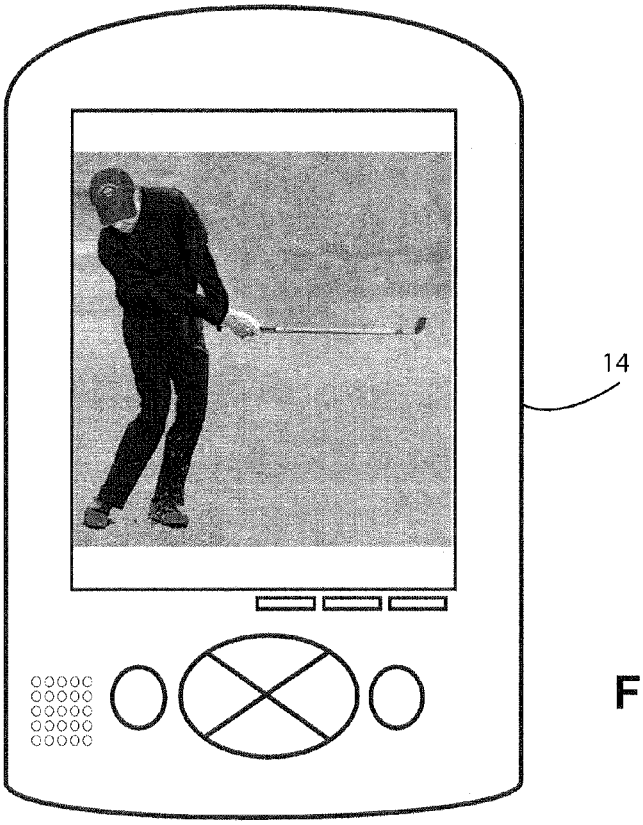
Figure 3E:
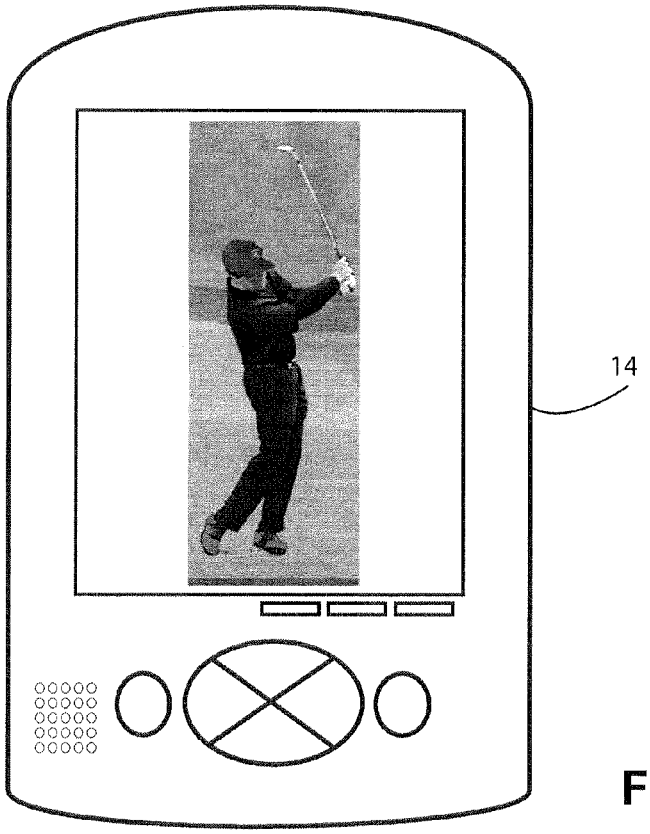
Figure 3F:
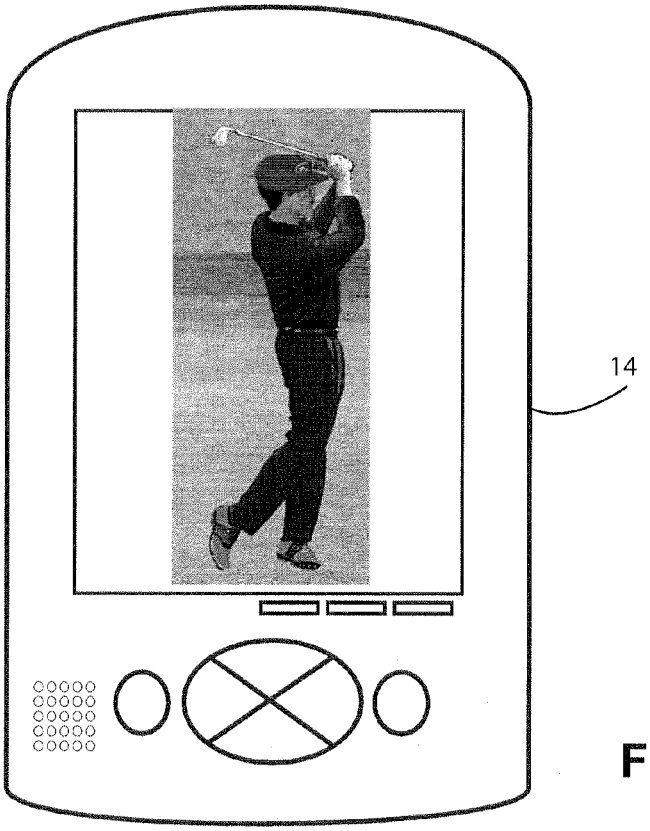

The short game stroke depicted in, for example, FIG. 3A, may be characterized in part by the length of the backswing as, for example, taught at Dave Pelz's golf schools. As shown in FIG. 3A, if the arms of the golfer are analogized to the hands on a clock, the stroke shown in FIG. 3A will be referred to herein in shorthand conventional notation as a "9:00 o'clock (9:00)" stroke. If, for example, the backswing went no further back than as shown in FIG. 3B, the shot will be referred to as, for example, a "7:30" stroke. If the backswing in FIG. 3A is rotated further back to a 10:30 position, the stroke will be referred to as a 10:30 stroke.

Figure 4:
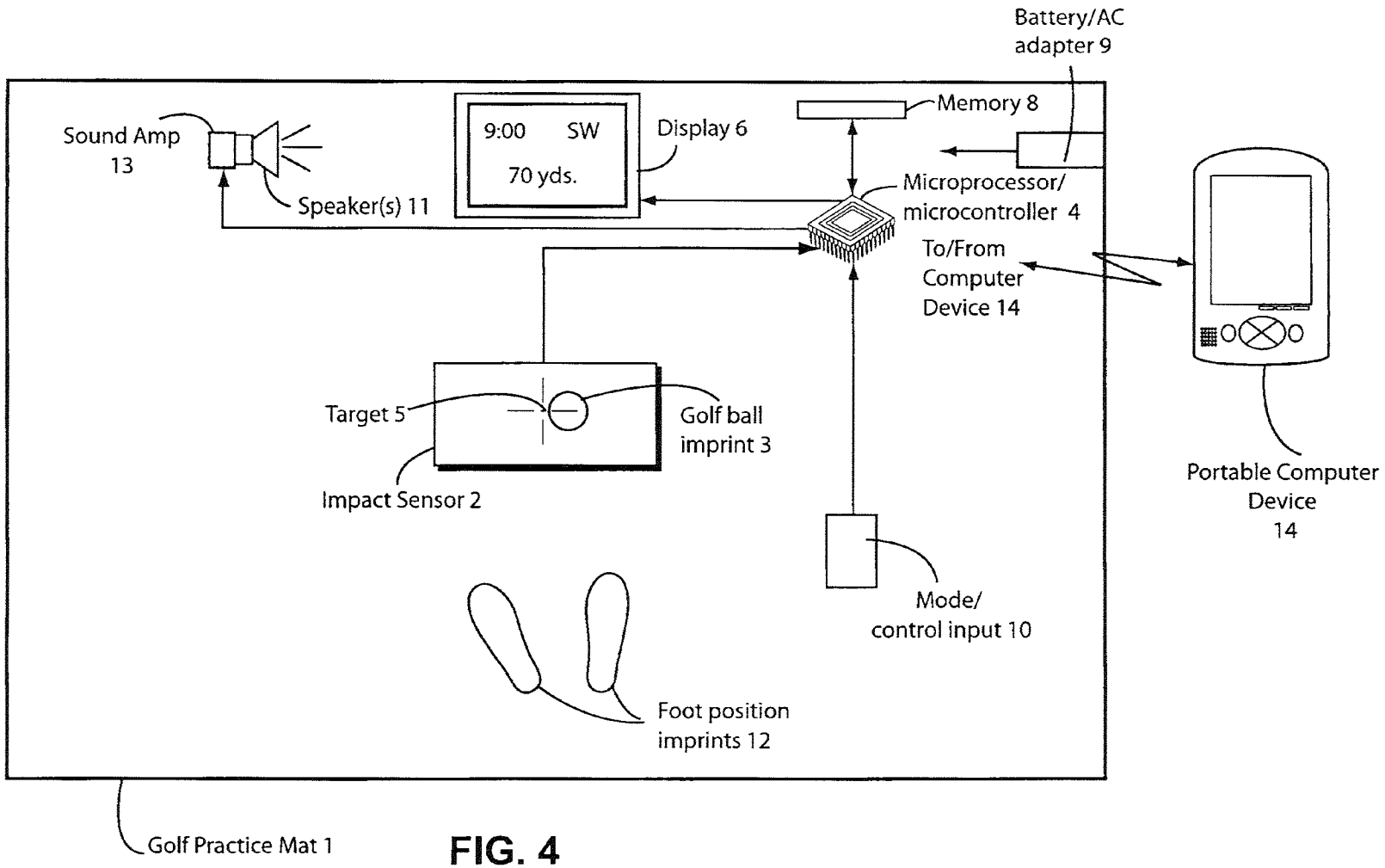
FIG. 4 a block diagram of a further illustrative embodiment of golf practice equipment in accordance with an illustrative embodiment of the present invention.

FIG. 4 is a block diagram of a further illustrative embodiment of golf practice equipment in accordance with an illustrative embodiment of the present invention. Components shown that have already been described in conjunction with FIG. 1 include corresponding identical labels and will not be described again. Added to the golf practice mat 1 shown in FIG. 1 is a portable computing device 14 which, in the illustrative embodiment shown in FIG. 4, wirelessly communicates with microcontroller 4. It should be understood that portable computer device 14 may, for example, communicate with microcontroller 4 in a wired mode of communication where, for example, a USB port associated with portable computing device 14, is coupled to a USB port (not shown) associated with golf practice mat 1 that in turn is coupled to microcontroller 4.

Portable computing device 14, in the FIG. 4 illustrative implementation, may be utilized (after powering up and being loaded with appropriate graphics data and software) to display a menu of modes for the user to select, including a manual mode of operation or a preprogrammed mode. If, for example, the manual mode of operation is selected, and a sand wedge is chosen with a 9:00 backswing, the swing sequence shown in FIGS. 3A-3F is displayed. In such an illustrative implementation, a user is able to pause at any of the shot sequence time windows shown in FIGS. 3A-3F to perfect the swing sequence at his or her own pace. In an illustrative embodiment, an audio description of each stage in the swing sequence is generated via sound amplifier(s)/speaker(s) 11, 13 to walk the user through the stroke. After the instructional video or directly after the mode input (if the user chooses to skip the instructional sequence), the selected input mode is communicated to microcontroller 4. Alternatively, as indicated above, the mode control may be entered via the golf practice mat control keys/switches 10.

FIGS. 5A and 5B are illustrative memory tables that are utilized by microcontroller 4 during mode entry and distance calculation in accordance with one exemplary embodiment. The distance values shown generally correspond to those identified at Dave Pelz's short game golf schools. Initially, in accordance with such an exemplary embodiment, a manual or preprogrammed play mode is entered either directly by a user choosing from a menu or by microcontroller 4 defaulting into a default mode. Default mode may result in initiation of any desired stroke, such as mode S2, which, as is shown in FIG. 5B, a 9:00 backswing stroke shown in FIG. 3A using a sand wedge.

It should be recognized that manual modes L1-L3, S1-S3 and P1-P3 are merely illustrative modes. Each and every golf club and type of backswing/stroke may, if desired, be incorporated into an illustrative embodiment of the present invention.

An illustrative embodiment of the present invention also contemplates an automatic mode of operation where microcontroller 4, if an automatic programmed mode is selected, controls the system to, for example, display a club and backswing, show an instructional swing sequence and await a user to practice the stroke using practice mat 1.

After detecting output signals from impact sensor 2, receiving and analyzing such impact sensor data, a shot result message is displayed utilizing, for example, the FIG. 5A memory table. For example, if the club selected was a sand wedge and the selected stroke was a 9:00 back swing, i.e., mode S2, if the impact sensor data reveals that the user's club face contacted impact sensor 2 at appropriate contact points, then the distance 70 yards is displayed together with an indication of the club utilized and, if desired, the stroke backswing (9:00).

In accordance with an illustrative embodiment, if the impact sensor data reveals that the club face was open upon contact of the club face with impact sensor 2, then a ball flight "right" display will be shown as is graphically indicated in FIG. 11A. In accordance with an illustrative embodiment, as shown in FIG. 11A, a pictorial or other representation of the club head data analysis may be displayed. Similarly, if the club face was closed based on the impact sensor/club face data analysis, a ball flight "left" display is generated as indicated in FIG. 11B. It should be recognized that if the impact sensor data indicates that the club head is very slightly closed, a straight ball flight may still result since the club head may be perpendicular to the horizontal axis at the precise time of ball impact. The microcontroller data analysis preferably will take this phenomena into account. If the club face impact sensor data shows that the club face was substantially perpendicular to the crosshair target horizontal axis a ball flight "straight" display may be generated, as is shown in FIG. 11C.

FIG. 6 is an illustrative schematic/block diagram showing a golf practice mat 1 modified to include a putting extension 20. Components shown that have already been described in conjunction with FIGS. 1 and 4 include corresponding identical labels and will not be described again.

As shown in FIG. 6, a putting extension 20 is utilized to permit a user to practice putting and is fabricated using an artificial turf of the type simulating a golf green. Golf green practice mats per se are well known, including those that have distance markers and backswing and follow through alignment indications imprinted thereon as is shown in FIG. 6 for the three foot and 5 foot putts.

As can be seen in FIG. 6, in the exemplary implementation identified ball placement markers are shown at 3 feet, 5 feet and 7 feet from cup 23. In the illustrative implementation, microcontroller 4 is coupled to a conductor 18 that in turn is coupled to a port (not shown) on the periphery of golf mat 1. Putting extension 20 includes a connector (not shown) that couples conductor 18 to a conductor 18' which in turn is coupled to cup 23.

In accordance with an illustrative implementation, when a user putts a ball that rolls into cup 23, the ball is funneled to a bottom portion of cup 23 so as to close a switch (not shown) that generates a signal on conductors 18' and 18 to provide microcontroller 4 with a signal indicating a made putt.

In accordance with an illustrative embodiment of the present invention, a user may enter a putting mode, by, for example, selecting one of various putting modes from a menu via portable computing device 14 or by selection via control key(s) associated with mode control input 10.

In accordance with one illustrative implementation, a putting instructional videographic sequence may be displayed on portable computer device 14 or display 26 to show the user an example of correct putting form.

Various putting modes may be selected such as, for example, putting from 3 feet, 5 feet, 7 feet or any combination thereof. Additionally, in one mode of operation, a selection may be made of a predetermined number of putts, such as 10 putts or 20 putts.

In an exemplary embodiment, a user will have a program selected period of time to complete the putts. For example, 90 seconds may be allocated for the user to complete ten 5 foot putts. In this example, at the end of the time period, the user's number of made putts and number of putts taken may be displayed. It should be recognized that the time period for putting may be any desired time.

Additionally, as will be appreciated by those skilled in the art, alternative/more sophisticated methods of keeping track of the number of putts taken, the length of the putt taken and the putts made may be utilized and more sophisticated putting statistics may be displayed. For example, as will be appreciated by those skilled in the art, a light emitter and photodetector pair disposed in the vicinity of cup 23 and aligned perpendicularly to the longitudinal axis of the putting extension may be utilized to detect a putting attempt by detecting an interrupted light beam by a putt. Additional, light emitter/photodetector pairs may be used to detect, for example, whether the putt was a 3 foot, 5 foot or 7 foot attempt.

FIG. 6 also shows a putting extension 20' in dashed lines that indicate an alternative physical disposition for mounting the putting extension. In accordance with an alternative embodiment, putting extension 20' may, if desired, utilize part of the original golf practice mat 1 rectangular surface as the initial starting point for putting. In accordance with this exemplary embodiment, putting extension 20' will be constituted by golf green simulating artificial turf. In accordance with an illustrative implementation, putting extension 20' may be split at 21 and designed to mate substantially seamlessly with the remainder of the putting extension 20' (not shown) that extends to the left of the left-hand border of golf practice mat 1 and replicates putting extension 20 shown in FIG. 6.

Further, as shown in FIG. 6, in accordance with an illustrative embodiment of golf practice mat 1, display 26 may be, for example, an LCD flat panel television display screen. Each of the displays shown in FIGS. 1 and 4 also may, for example, include a flat panel LCD display that is part of broadcast/cable TV. When putting extension 20' is utilized in conjunction with a TV display, putting practice may be coincide with the user watches the TV 26 showing, for example, a golf tournament or an instructional video of any desired golf stroke.

Figure 7:
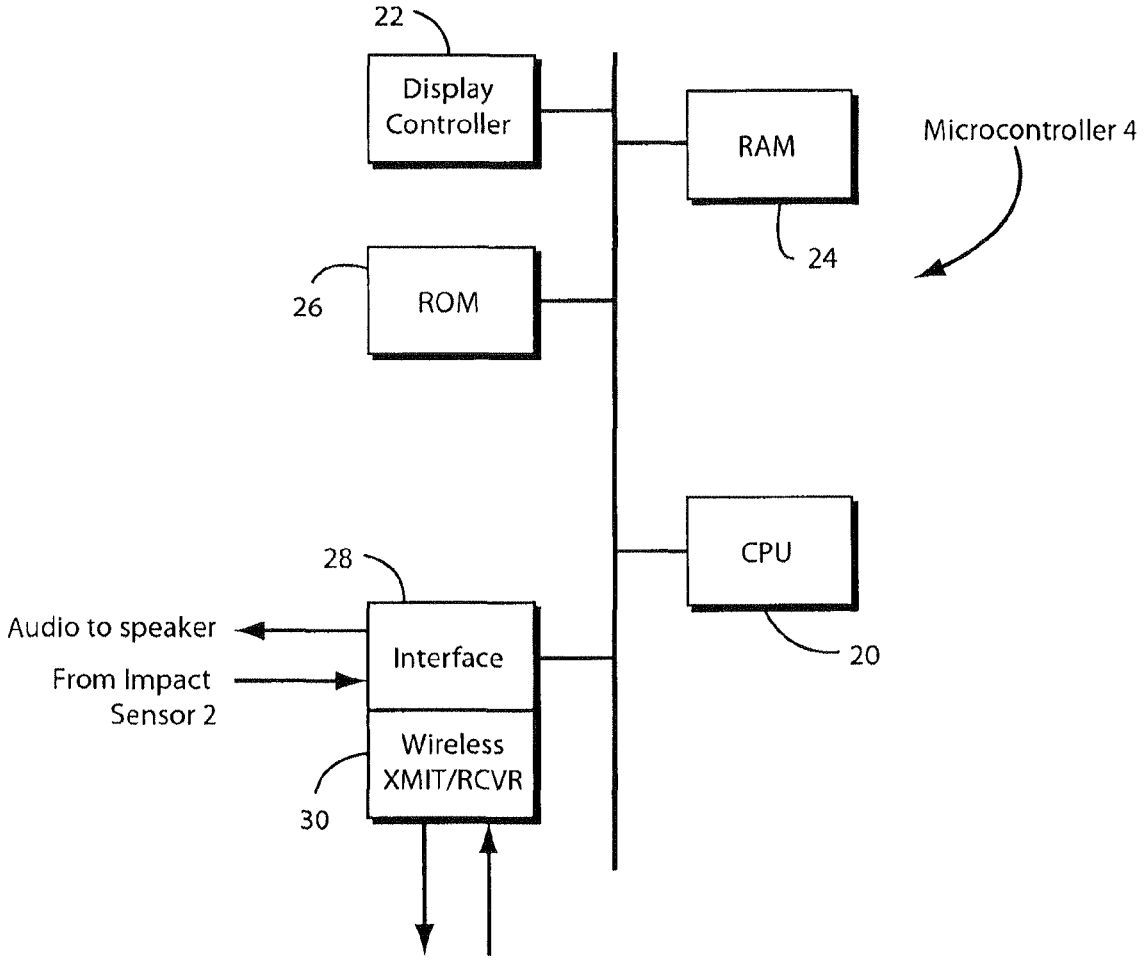
FIG. 7 is an exemplary block diagram showing the components of an illustrative microcontroller.

FIG. 7 is an exemplary block diagram showing illustrative components of microcontroller 4. Microcontroller 4 includes a CPU core 20 for executing a set of instructions stored, for example, in read only memory (ROM) 26. CPU 20 provides display generating control signals for controlling display controller 22 which may, for example, be an LCD display controller for generating the display on display screen 6.

The program stored in ROM 26 additionally controls communications between CPU 20 and portable (and/or any other) computer device 14 via interface 28, which preferably takes place in a wireless mode utilizing wireless transmitter/receiver circuitry 30 embodied in microcontroller 4.

Additionally, CPU 20 processes data input from impact sensor 2 under the control of the software stored in ROM 26. ROM 26 additionally may store memory tables such as those shown in FIGS. 5A and 5B. Alternatively, such tables may be stored in memory 8 shown in FIGS. 1, 4 and 6. Microcontroller 4 also has access to RAM 24 to store dynamic data that will change during program operation.

Microcontroller 4 may be a single chip microcontroller that, for example, includes a timer module that will allow the microcontroller to perform time period dependent tasks. In a illustrative embodiment, microcontroller 4 also includes a wide array of ports (e.g., USB, IEEE Firewire, etc.) to allow data to flow between the microcontroller and other devices, such as a PC or portable computing device 14, to permit operations in a wired or wireless communication modes. It is also contemplated that interface 28/wireless XMIT/RCVR 30 support Internet communications to permit golf simulations involving a user and one or more remotely located friends.

Microcontroller 4 may be implemented in an illustrative embodiment by any of a wide array of commercially available microprocessor/microcontrollers such as, for example, a Motorola 68HC11 microcontroller. The nature of the microcontroller selected may vary depending upon the sophistication of the desired implementation.

Figure 8:
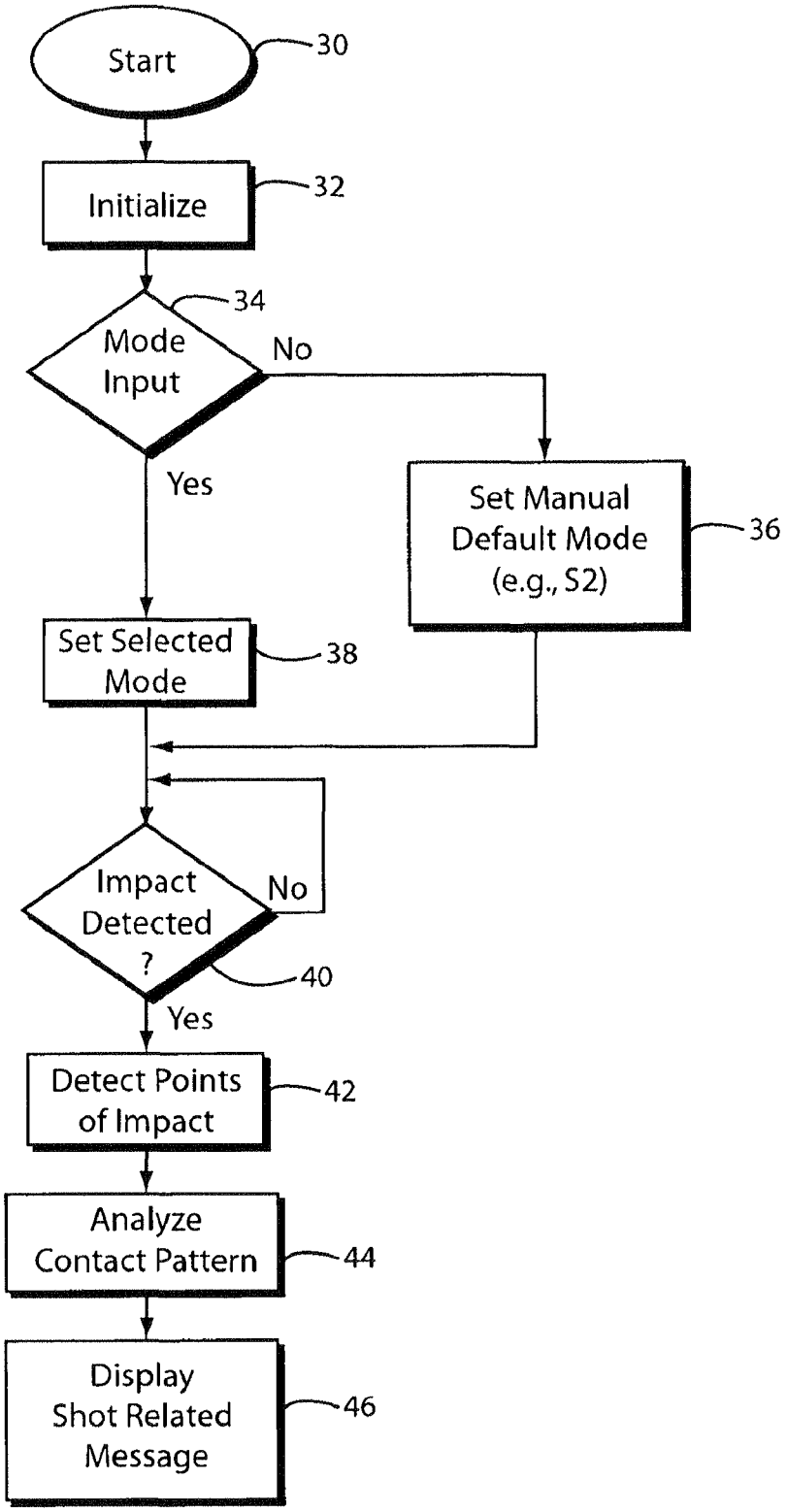
FIG. 8 is a flowchart delineating an exemplary sequence of operations performed by microcontroller 4.

FIG. 8 is a flowchart delineating the sequence of operations performed by microcontroller 4. After the FIG. 1 golf practice mat electronics is provided with power, microcontroller 30 initiates power on-related initialization operations (30, 32).

Additionally, in an illustrative embodiment, microcontroller 4 generates an operational mode selection menu (not shown) on display 6 (32). Such a mode menu permits a user to select a manual mode of operation in which any mode such as L1-L3, S1-S3 and P1-P3 may be input via, for example, mode control keys 10 or alternatively via portable computing device 14. The mode selection menu may, in an illustrative implementation, provide the user with an option of selecting a further automatic mode menu to select one of several automated program control sequences running through a variety of different clubs and strokes. In more sophisticated implementations, a set of golf holes may be selected for simulated play via a menu selection.

Microcontroller 4 then checks to determine whether the user has selected/input a mode (34). After a predetermined period of time has passed after the mode menu display, if no mode has been input, microcontroller 4 defaults to a manual default mode that may, for example, result in the selection of mode S2 thereby selecting a sand wedge with a 9:00 backswing.

If a mode input has been detected, microcontroller 4 sets the selected mode (38). For example, if mode S2 is selected distance calculations are based upon analysis of impact data and a stored distance data for a sand wedge with a 9:00 backswing.

A check is then made to determine whether an output signal has been generated by impact sensor 2 (40). If not, the routine loops back in a wait mode to continuously check to determine if a club head impact has been detected. In accordance with an illustrative embodiment, one or more vibration sensors may be utilized (not shown) to detect an impact outside the range of impact sensor 2. In accordance with such an embodiment, if the vibration sensor detects contact with golf practice mat outside the confines of impact sensor 2, a display may be generated to request, for example, that the user try again.

When the check at block 40 detects an impact, microcontroller 4 detects the various points of impact and stores corresponding data points in a microprocessor RAM memory that may be resident in either memory 8 or the internal microcontroller RAM 24 shown in FIG. 7.

Thereafter, microcontroller 4 analyzes the contact pattern (44), as will be explained further below in conjunction with the flowchart of FIG. 12, and displays a shot-related display/message (46). In an exemplary implementation, a message may be generated to indicate the club and stroke used and the resulting shot distance, e.g., sand wedge, 9:00 stroke, 70 yards distance as shown in FIG. 1. The display of the club backswing and distance provides a reinforcing feedback mechanism for the user to associate a particular club and backswing with a distance to promote proper club and swing selection during an actual round of golf. In an illustrative implementation, a three-dimensional simulation of the resulting shot may be displayed on display 6 such as is shown in FIG. 13.

Figure 9:
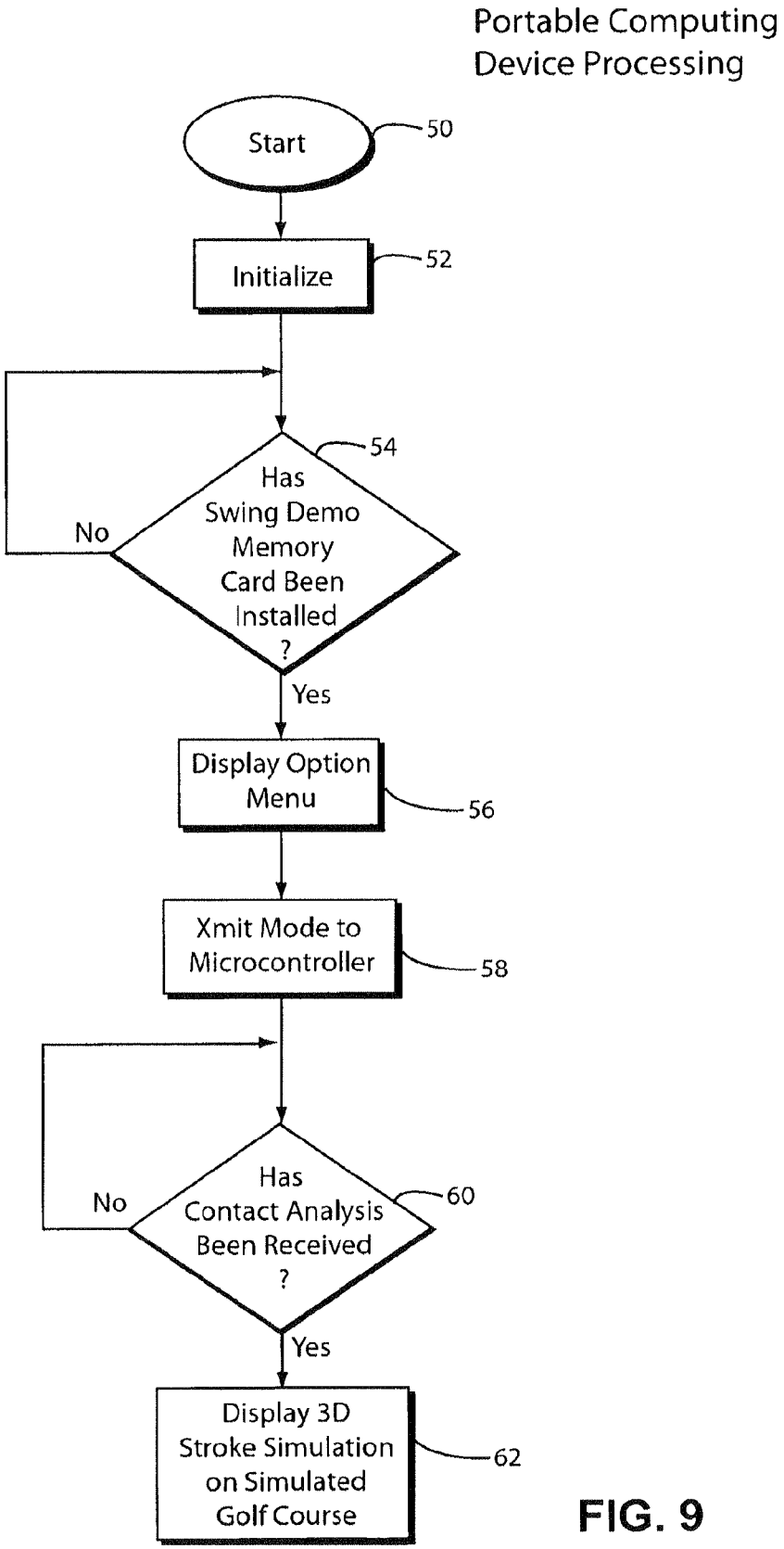
FIG. 9 is a flowchart illustrating an illustrative sequence of operations performed by the portable computer device shown in FIG. 4.

FIG. 9 is a flowchart illustrating the sequence of operations performed by portable (or other) computer device 14 shown in FIG. 4. As indicated in FIG. 9, after power is turned on, portable computer device 14 initiates power-on initialization processing (50), (52). In accordance with an exemplary implementation, software associated with golf practice mat 1 is executed by portable computing device 14 to determine if a memory module/card has been inserted that includes, for example instructional swing audio and video sequences corresponding to the swing sequences shown in FIGS. 3A-3F (54). It is contemplated that a variety of instructional sequence memory modules may be utilized from a variety of golf instructors/schools. Such sequences may, if desired, be preloaded into computing device 14.

Upon detecting that a graphics data card/memory module has been inserted, a options menu is preferably generated on the portable computing device's display screen for the user to select an operational mode (56). After a user selects an operational mode, the mode is preferably wirelessly transmitted to microcontroller 4 (58).

Portable computing device 14 then enters a wait mode and continually checks to determine whether a ball contact analysis has been received from microcontroller 4 (60).

The ball contact analysis in an illustrative embodiment will indicate the yardage obtained as a result of the user stroke. In more sophisticated implementations such as is described below, an indication of ball flight including the projected direction of the ball based on an analysis of club face angle data as, for example, it changes over time also is included.

With respect to the distance data, although optimum distances are recorded in a memory table as shown in FIG. 5A, such distances assume contact with impact sensor 2 at, or within a threshold distance from target 5. If contact is detected to the right of target 5 shown in FIG. 4, a "fat" shot is detected and a distance related to the data in the FIG. 5A table is generated that reflects a lesser distance than is shown, depending upon the degree to which the stroke data is offset from target 5.

After the contact analysis data has been received, portable computing device 14 will generate a 3-D stroke simulation on a simulated golf course hole (62) such as is shown in FIG. 13. Such simulations may be of varying degrees of sophistication. For example, golf holes may be simulated replicating or relating to holes on well known courses.

The software may be designed to automatically choose the appropriate club for the user depending upon the results of the prior stroke. It should be understood that the three clubs identified in FIG. 5A are merely illustrative. For example, it should be understood that, if desired, data with respect to a full set of golf clubs, including all irons and fairway woods may be utilized. It is also apparent that such golf simulation could be embodied in a video game application.

FIG. 10 is an illustrative version of the FIG. 8 flowchart depicting microcontroller 4 processing operations, where the system includes a portable (or other) computing device 14. Flowchart blocks shown that have already been described in conjunction with FIG. 8 and include corresponding identical labels will not be described again unless further description is required due to interaction between the microcontroller and portable device 14. Although microcontroller 4 checks for mode input (34) as in the flowchart of FIG. 8, the mode input processing looks to receive the mode input from portable computing device 14 rather than mode/control switches 10 on practice mat 1.

After microcontroller 4 analyzes the golf club contact pattern (44), in addition to displaying a shot related message on display 6 (46), the analysis is transmitted to portable computing device 14 for generation of the portable computing device's 3D stroke simulation on a simulated golf course such as is shown in FIG. 13. In accordance with alternative implementations, the analysis may be transmitted to a portable computing device or a desk top PC and then transmitted to remote computing devices via, for example, the Internet. In this way users may interact with remotely located golfing buddies. In accordance with such an implementation, competitive/multi-player golfing is contemplated.

Figure 12:
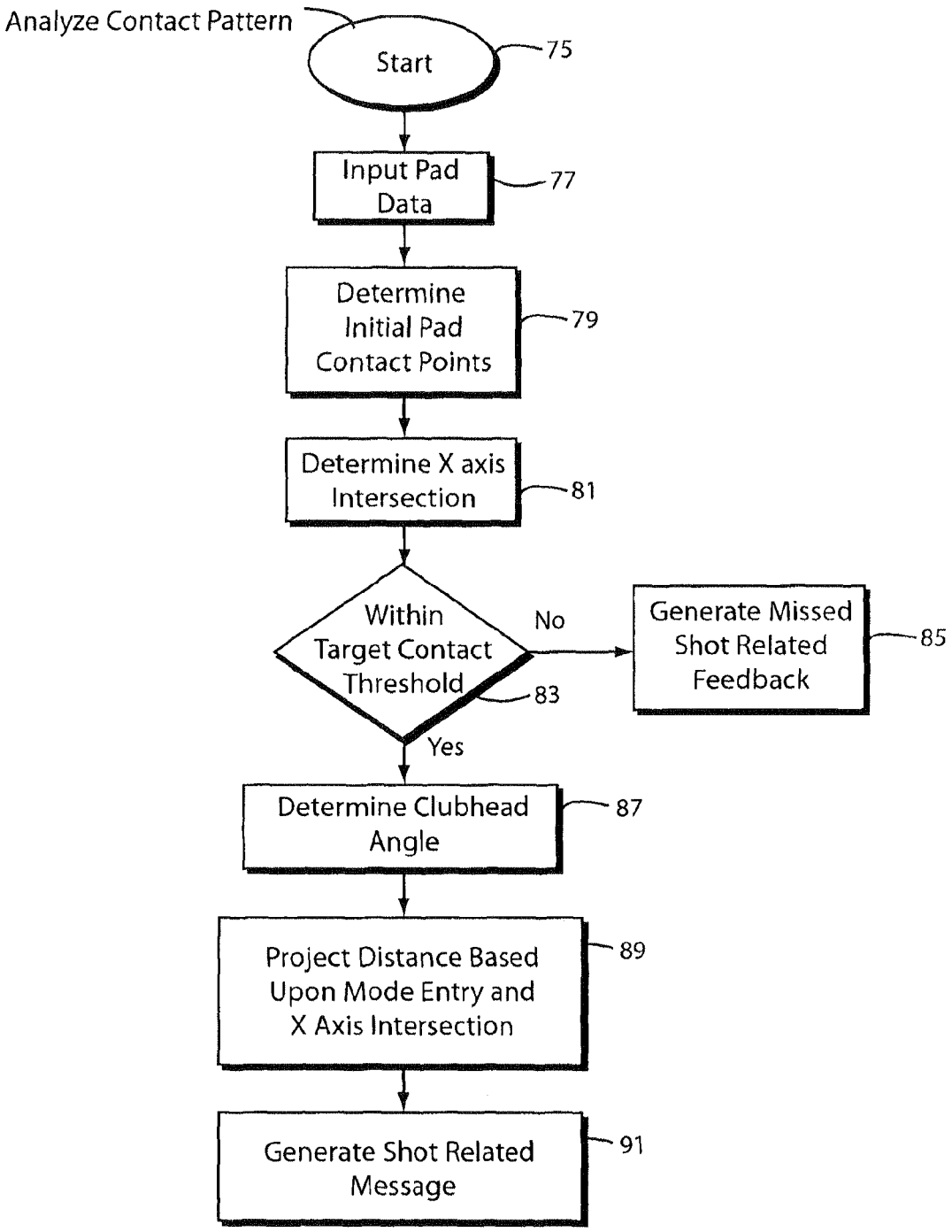
FIG. 12 is a flowchart delineating the sequence of operations performed by microcontroller 4 as part of the analyze contact pattern analysis shown in FIG. 10, in accordance with one illustrative, non-limiting implementation.
Figure 13:
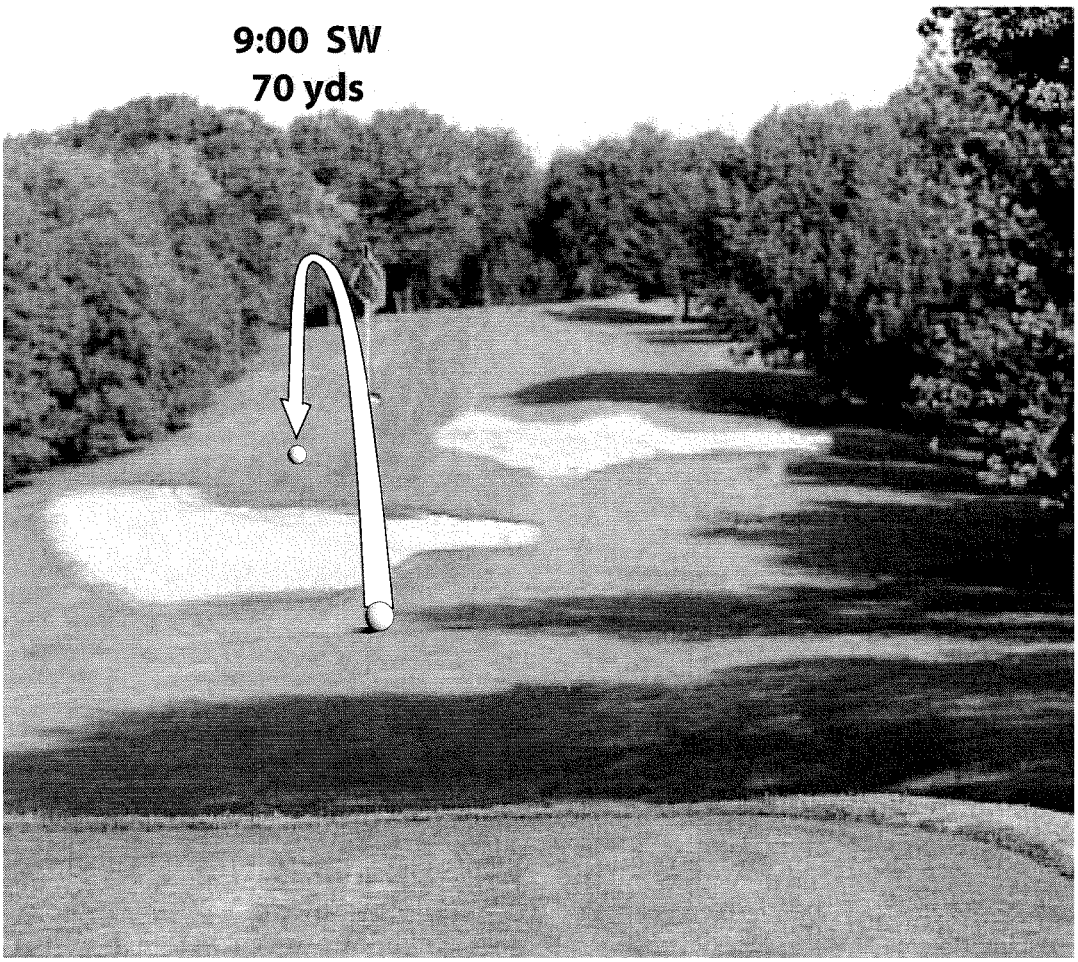
FIG. 13 is an illustration of a three dimensional display of a golf stroke based upon analysis of impact data from the practice surface described herein.

FIG. 12 is a flowchart delineating the sequence of operations performed by microcontroller 4 as part of the contact pattern analysis (44) shown in FIG. 10 in accordance with one illustrative, non-limiting implementation. At the beginning of the analyze contact pattern processing, input data from impact sensor 2 is read by microcontroller 4 (75, 77). Based on the input pad data read, initial pad contact points are determined, where the target 5, shown in FIGS. 1, 4 and 6 is utilized as the origin of an x, y coordinate reference frame, as shown in FIG. 11A, B and C (79).

Based on the initial pad contact point data, a straight line approximation of the data representing the club head contact with the mat is generated. Based upon the straight line representation of the club head contact data, a determination is made as to where the club head intersected the x-axis, indicating an offset from the target 5 (81). In more sophisticated further illustrative implementations, the impact data may be analyzed to determine the extent to which the club face is closing during the period of contact with the practice mat surface and an indication of such may, if desired, be provided to the user.

A check is then made to determine whether the club contacted the x-axis within a predetermined threshold distance from target 5 (83).

If the processing at block 83 indicates that the club face contact was outside the target contact x-axis distance threshold, a missed shot-related feedback message is generated on the user's display 6 and/or alternatively, on the portable (or other) computing device 14 display.

The straight line approximation indicating the points of initial contact with impact sensor 2 is utilized to determine club head angle at impact (87). If, for example, as shown in FIG. 11A, the club head strikes impact sensor 2 in the angular relation shown in FIG. 11A, it is projected that the ball will travel to the right of the target. Alternatively, if the angular disposition of the club face is determined to be as shown in FIG. 11B, the ball flight is determined to be left of the target. If, however, the projected straight line shows a club face angular relation as shown in FIG. 11C, the ball flight is predicted to go straight.

Thereafter, based upon the club/backswing mode entry and x-axis intersection, a projected distance is generated (89). Such distance, as indicated above, may either be the distance shown in the FIG. 5A table or a lesser distance depending upon the point of impact on impact sensor 2.

Thereafter, a shot-related message is displayed to the user (91). By way of example only, the shot related message may include the club used, the backswing stroke (9:00) and the projected distance. Alternatively, a three-dimensional display as is shown in FIG. 13 may be generated for display on display 6, 26.

In an alternative embodiment, golf practice mat 1 may be utilized in conjunction with a rubberized golf tee of the type utilized in driving ranges. In accordance with a further embodiment of the present invention, a sensor (not shown) may be disposed in the tee to determine whether, for example, a driver appropriately contacted the ball by determining whether there has been contact with the tee. In a more sophisticated embodiment, in addition to measuring whether the tee has been contacted by the club head, the direction of movement may be sensed by, for example, one or more accelerometers mounted in a lower portion of the tee to provide data for determining the likely direction of ball flight. As in the other embodiments described above, a display of shot related indicia is contemplated for display to the user.

FIG. 13 is an illustration of a three dimensional display of a golf shot based upon the analysis of impact data from the practice surface described herein. As shown in FIG. 13, in view of the club head/impact sensor 2 contact analysis by microcontroller 4 based upon the FIG. 12 or alternative processing, a simulated shot may be generated showing, for example, the directional ball path, the distance traveled, the club utilized and the backswing (e.g., 9:00). Complete holes may be played in this fashion. Simulated putting may be performed using data obtained from a putting extension described above in conjunction with FIG. 6. As noted above, a sequence of different holes on a variety of simulated golf courses may be displayed. In a multi-user mode, the shot data for more than one user may be simulated and displayed.

Based upon the foregoing description of various illustrative embodiments, a wide range of golf practice training apparatus having a wide variety of features may be implemented providing a wide range of feedback and shot-related projections. The desired degree of accuracy of such feedback and shot-related projections may vary greatly depending upon the desired application goals. It should be understood that the accuracy of shot projections will vary depending upon the amount of resolution provided by impact sensor 2. In accordance with many illustrative implementations, a low cost, coarse projection may function as a highly desirable, practical golf training device. Other illustrative implementations may desirably incorporate higher degrees of accuracy.

In the illustrative, non-limiting embodiments which follow, the practice mats shown, for example, in FIGS. 1, 4, and 6 are modified to incorporate the following illustrative hardware and software targeted to exemplify a high resolution implementation of the training apparatus described above. It should be understood that the ball striking theories/equations presented herein are illustrative only and provide an example of methodology that may be utilized to provide the feedback and shot-related projections useful in, for example, perfecting a golfer's ball striking. As will be appreciated by those skilled in the art, the methodology described herein should not be construed as limiting the scope of the appended claims and may be readily adapted to using other ball striking theories/equations to provide for alternative shot-related projections that may be more in line with the recommendations of, for example, a particular golf professional/golf schools.

Above ground golf stroke analysis concepts typically observationally attempt to diagnose a golfer's stroke as he/she swings a club through an arc that, hopefully, passes through the center of the ball, yielding a shot that, hopefully, goes a reasonable distance toward the target flag at the next green. Such analyses often get bogged down attempting to correlate deviations of the golfer's swing, from a prescribed perfect swing, with the actual resulting deviations of the ball, veering off the perfect path to the target.

While such above-ground analyses are often helpful at curing particular eccentricities in the golfer's swing, there is nonetheless a wealth of information available "below ground" that can also help the golfer using, for example, the practice mat 1 and impact sensor 2 described above. That is, rather than diagnosing the visible arc of the golfer's swing from the side and the rear, illustrative implementations determine just how close the club face actually came to an optimum impact with the center of the ball.

Even though a golfer executes a seemingly proper swing, the ball can still fly awry of the target line. This is because, regardless of how perfect the golfer's swing appears to be to the untrained observer, it is how perfect the impact of the club face is with the center of the ball that determines where the shot will go. Just a small 'delta' right or left, up or down, face open or face closed, can 'juke' a shot well off the perfect path. The illustrative embodiment that follows endeavors to measure these small 'deltas' in club face position and angle, and show how far each stroke was off the perfect impact.

In the illustrative implementation, these small 'deltas' from a perfect model are measured by an array of pressure sensors within the mat, which indicate:

[1] the initial strike where the club first contacts the mat

[2] the strike path the club takes as it slides across the mat

[3] the downward pressure exerted by the club into the mat along the path, and

[4] any angular rotation of the club face and/or the swing itself.

The following discussion provides detailed information of an illustrative embodiment for a sand wedge stroke for a right-hand [RH] golfer, disclosed generally in FIGS. 14-24, and supported next by illustrative detailed program flowcharts of FIGS. 25-34. A left-hand [LH] stroke would, of course, be accommodated by a mirror-image of the present RH embodiment.

Figures 1, 15B:
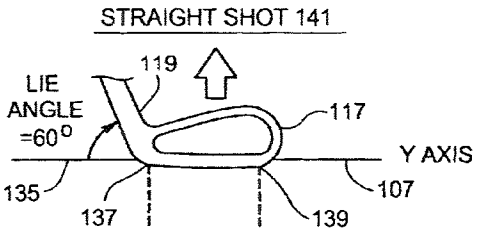
Figures 2, 15B:
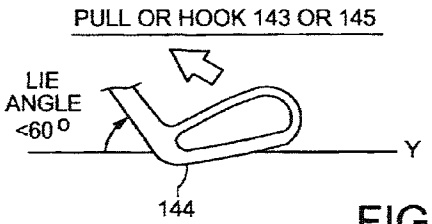
Figures 3, 15B:
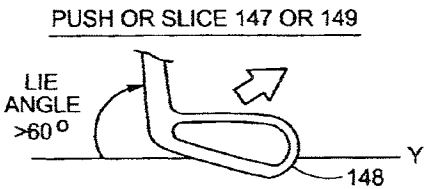
Figures 1, 15A:
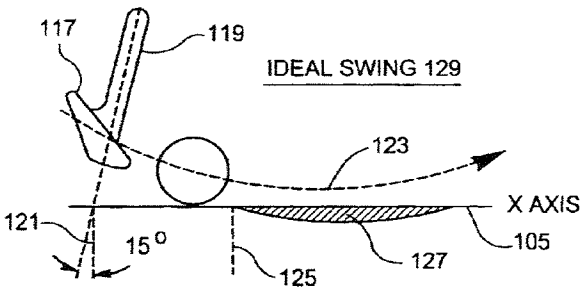
Figures 2, 15A:
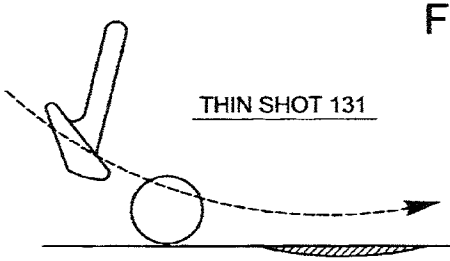
Figures 3, 15A:
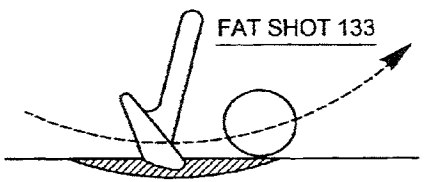
Figure 16:
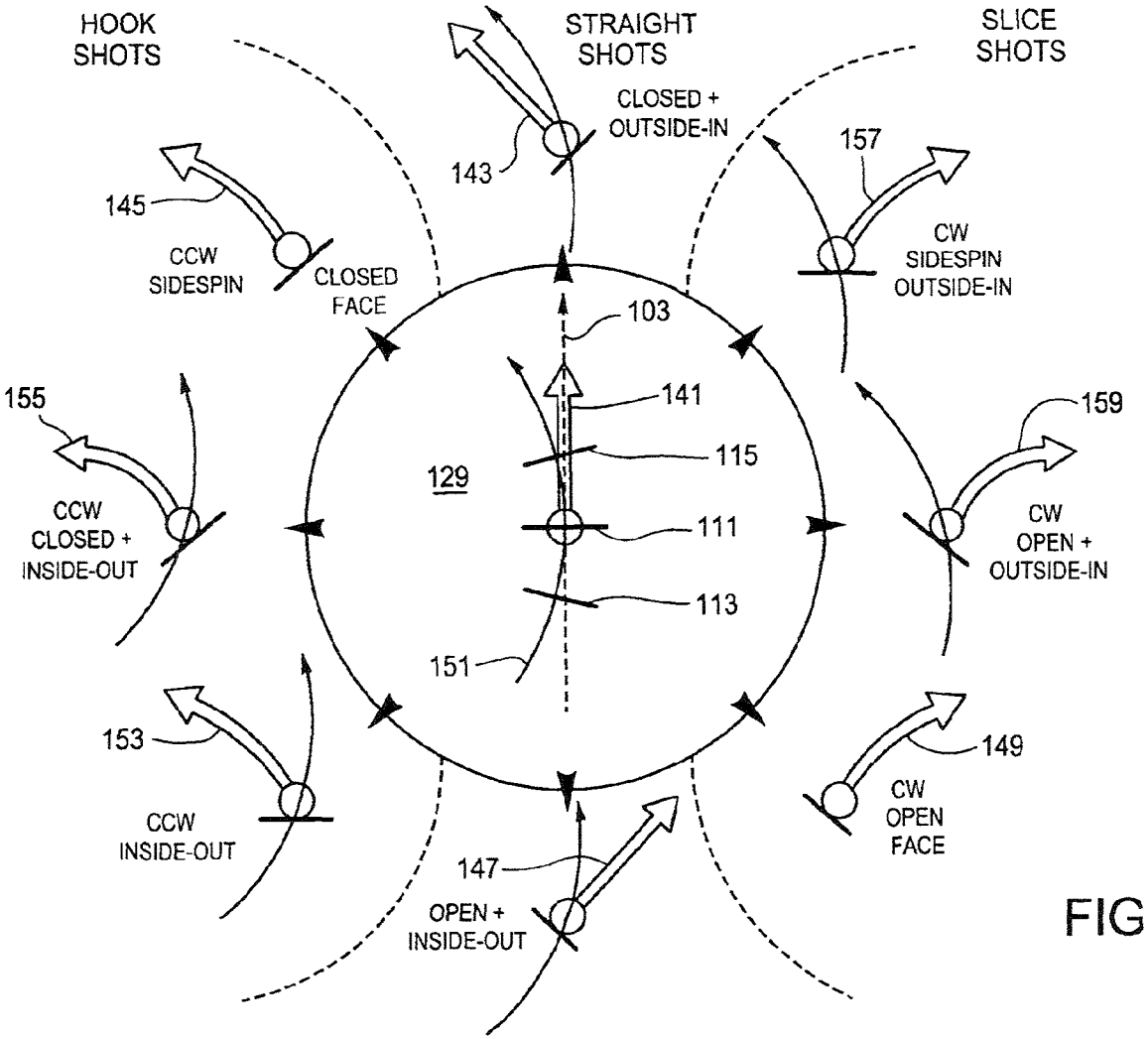
FIG. 16 illustratively depicts possible shot variations in the horizontal plane.
Figure 17:
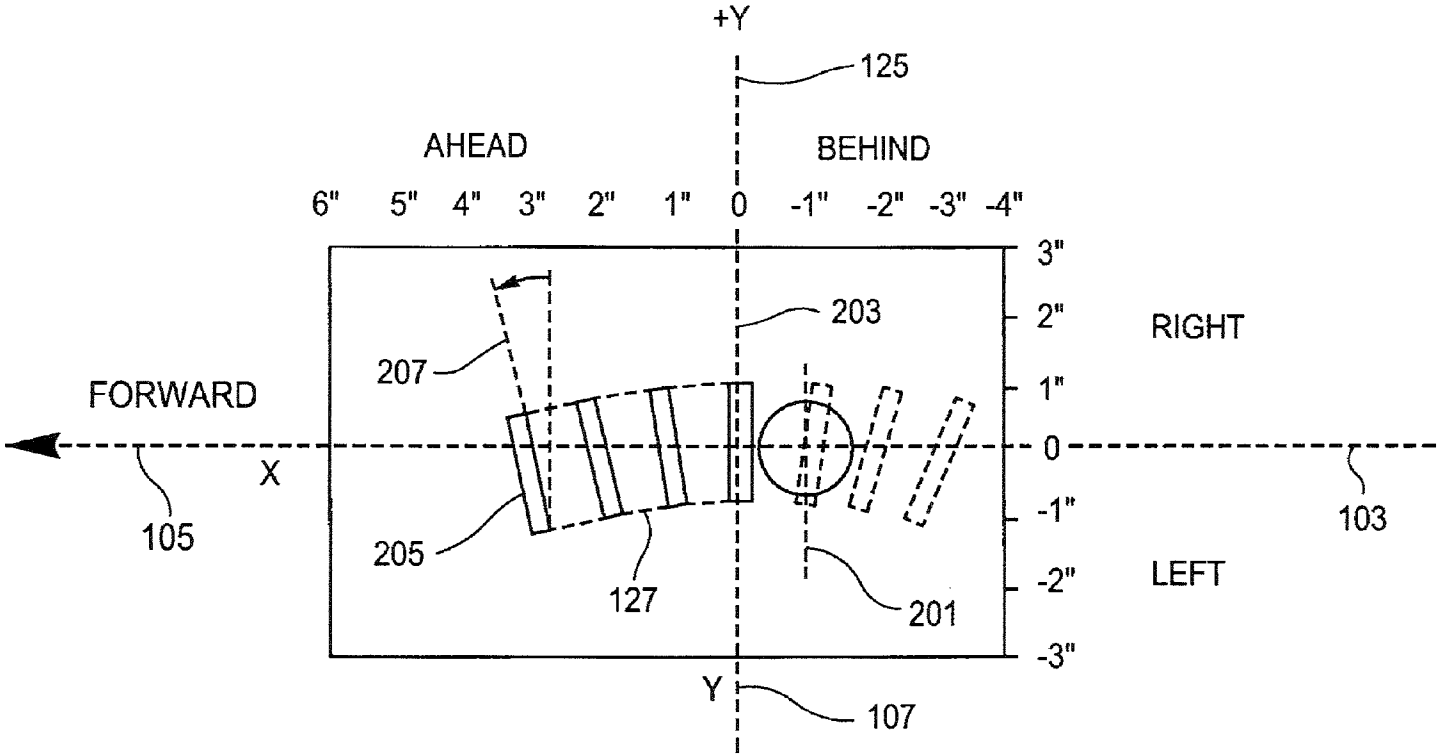
FIG. 17 provides an exemplary overview of how this illustrative embodiment works with respect to the floor mat sensor array.

More specifically, FIGS. 14-16 show some of the fundamental golf stroke concepts that underlie an illustrative implementation of the present invention. FIGS. 17-19 give an overview of how one illustrative embodiment works. FIGS. 20-24 show the specific mechanisms and processes which enable this particular high resolution, illustrative embodiment.

Figure 25:
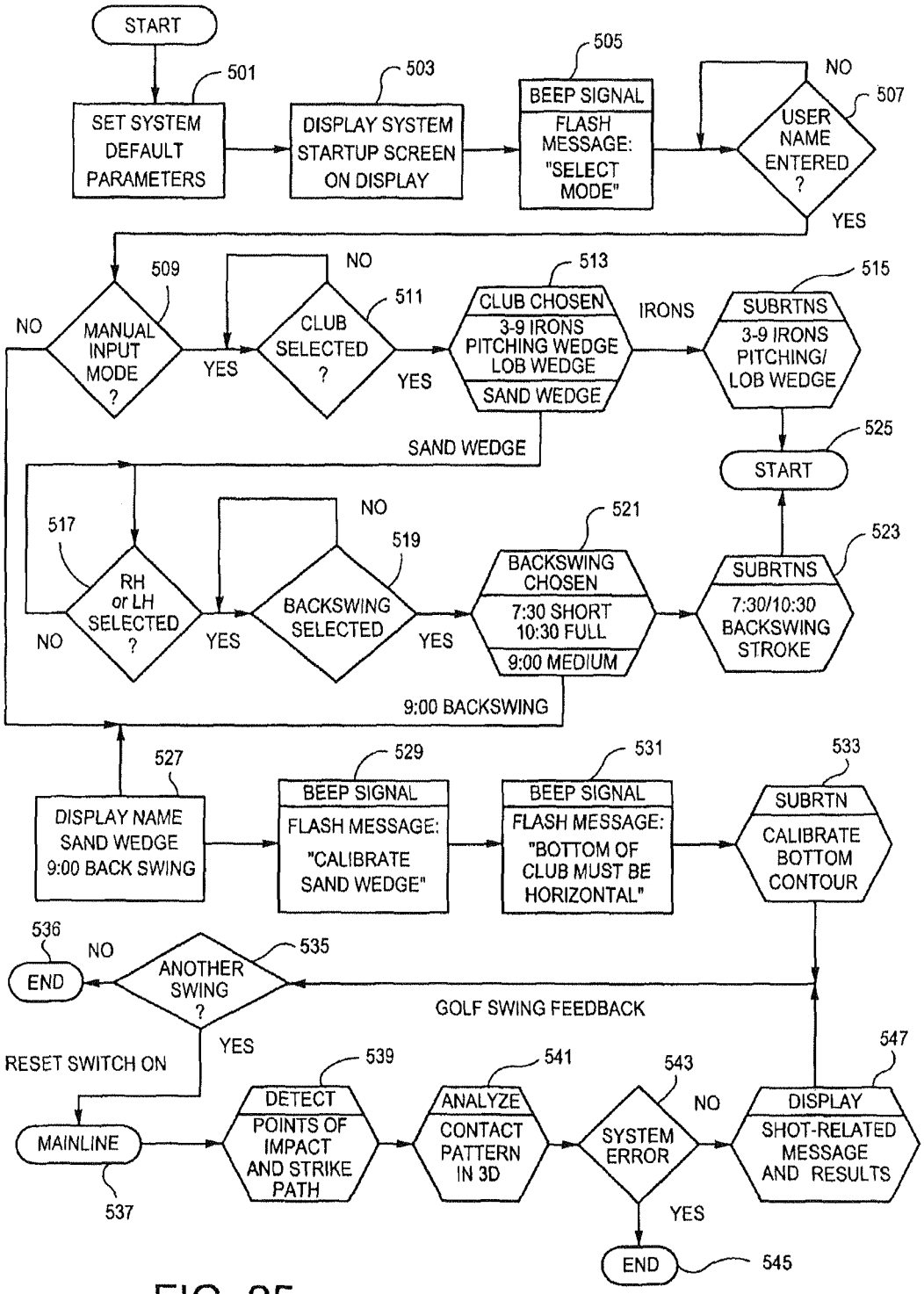
FIG. 25 is a high-level mainline program flowchart that controls the whole process, and calls the first layer of subroutines.

As for the program flowcharts, FIG. 25 is the high-level mainline program that controls the whole process, and calls the first layer of subroutines. FIGS. 26-28 and 34 represent the first layer of subroutines which calibrate the given golf club to a perfectly flat bottom edge, detect the next golf swing, analyze the data surrounding that swing, and then display the results of that swing back to the golfer.

Figure 29:
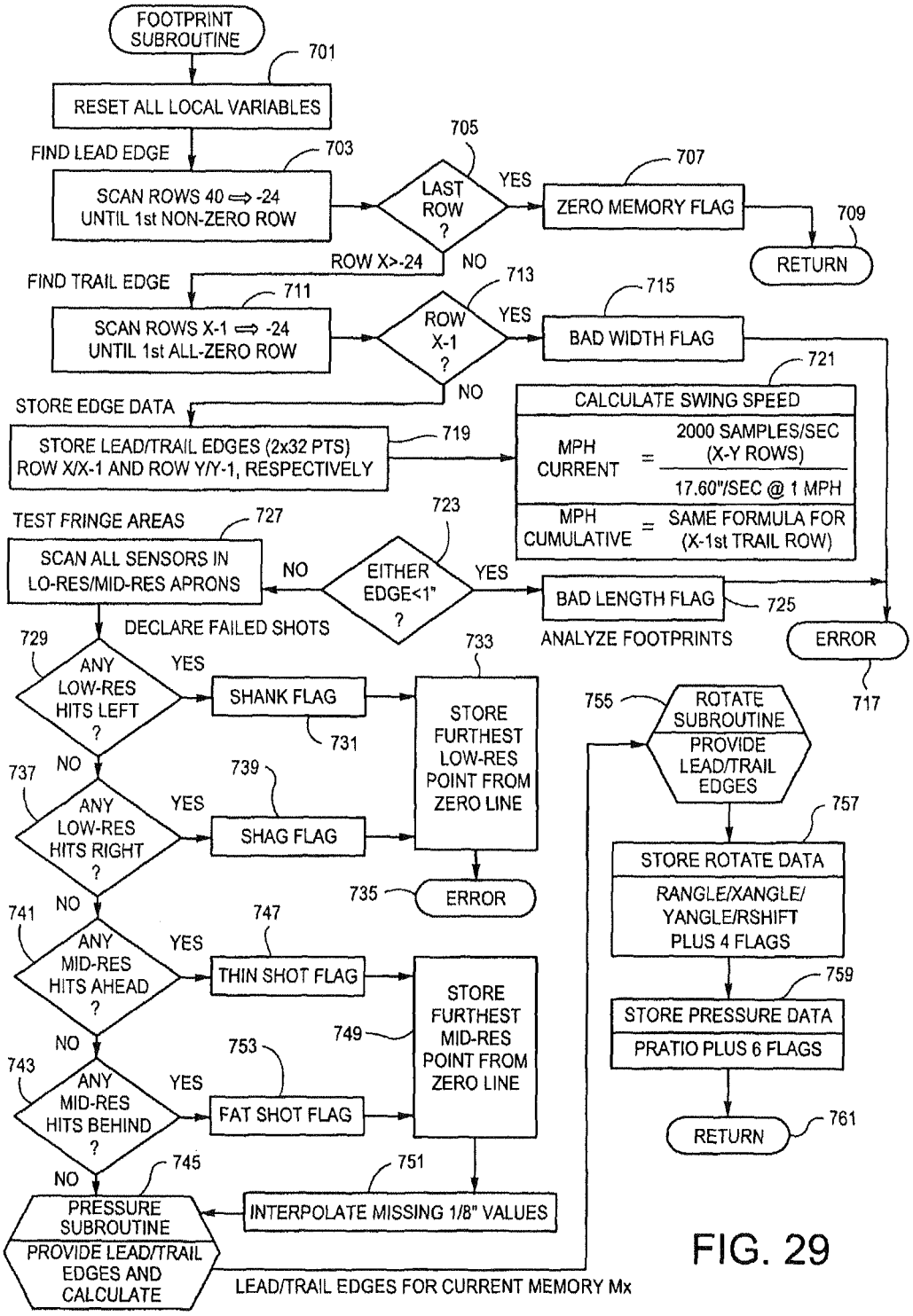
FIG. 29 is a flowchart that delineates the sequence of operations in the FOOTPRINT subroutine in the illustrative implementation.
Figure 30:
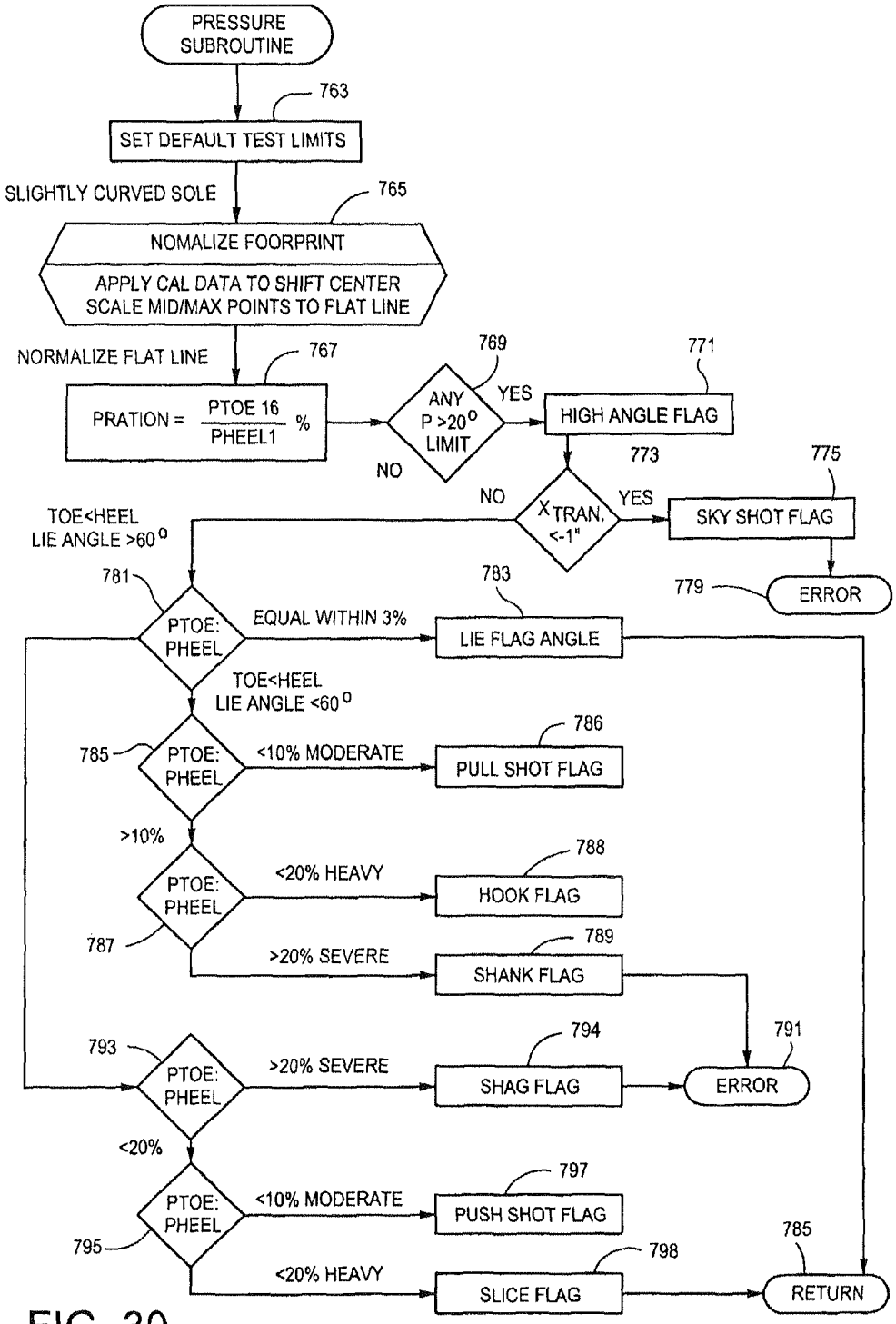
FIG. 30 is a flowchart that delineates the sequence of operations in the PRESSURE subroutine in this example, designed to analyze the pressure gradient across the current footprint in memory bank Mx and test for any excessive force, downward into the ground, or "tilted" toward the toe or heel.
Figure 31:
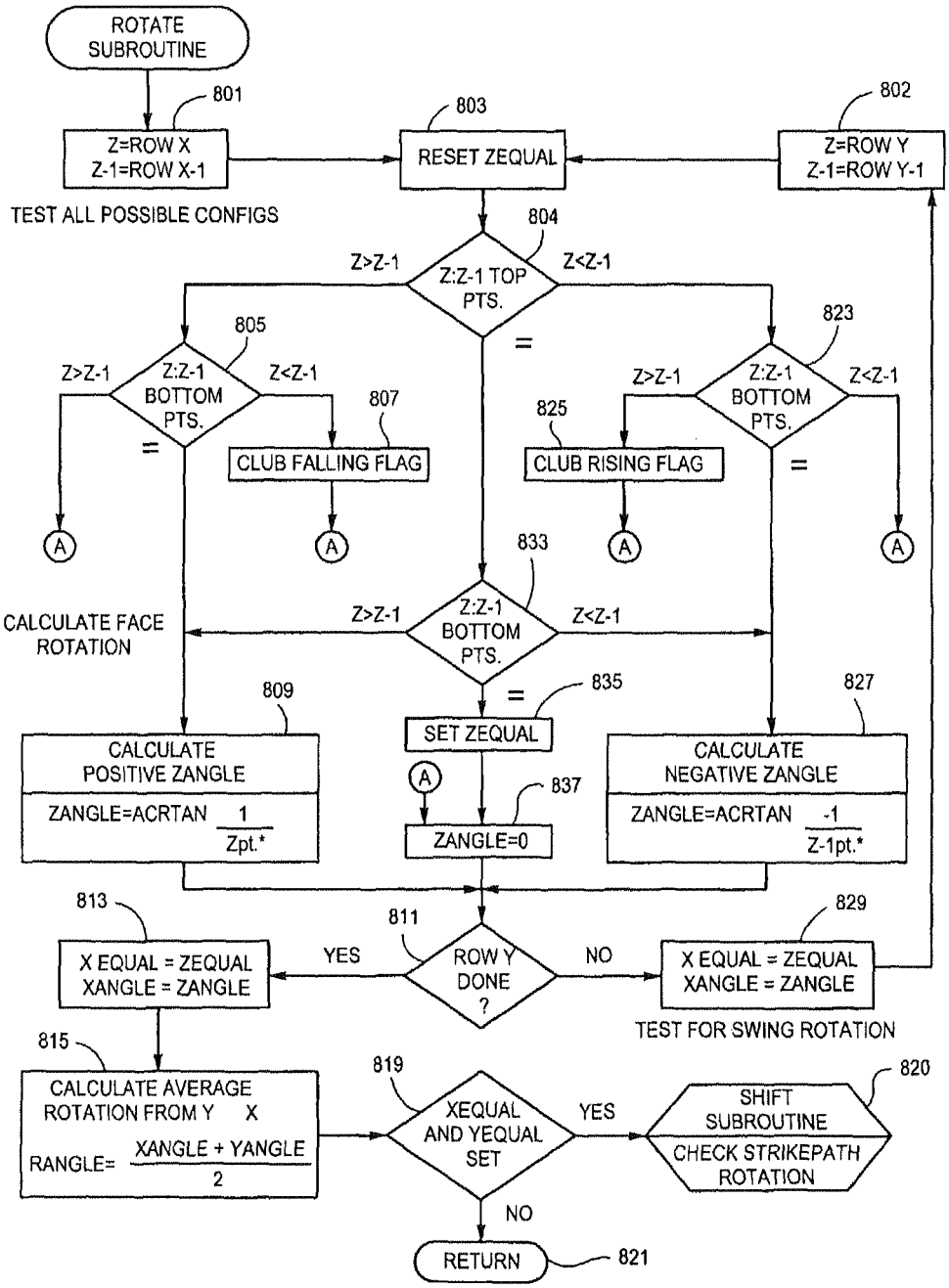
FIG. 31 is a flowchart that delineates the sequence of operations in the ROTATE subroutine in an illustrative implementation designed to calculate all row-to-row transitions.
Figure 32:
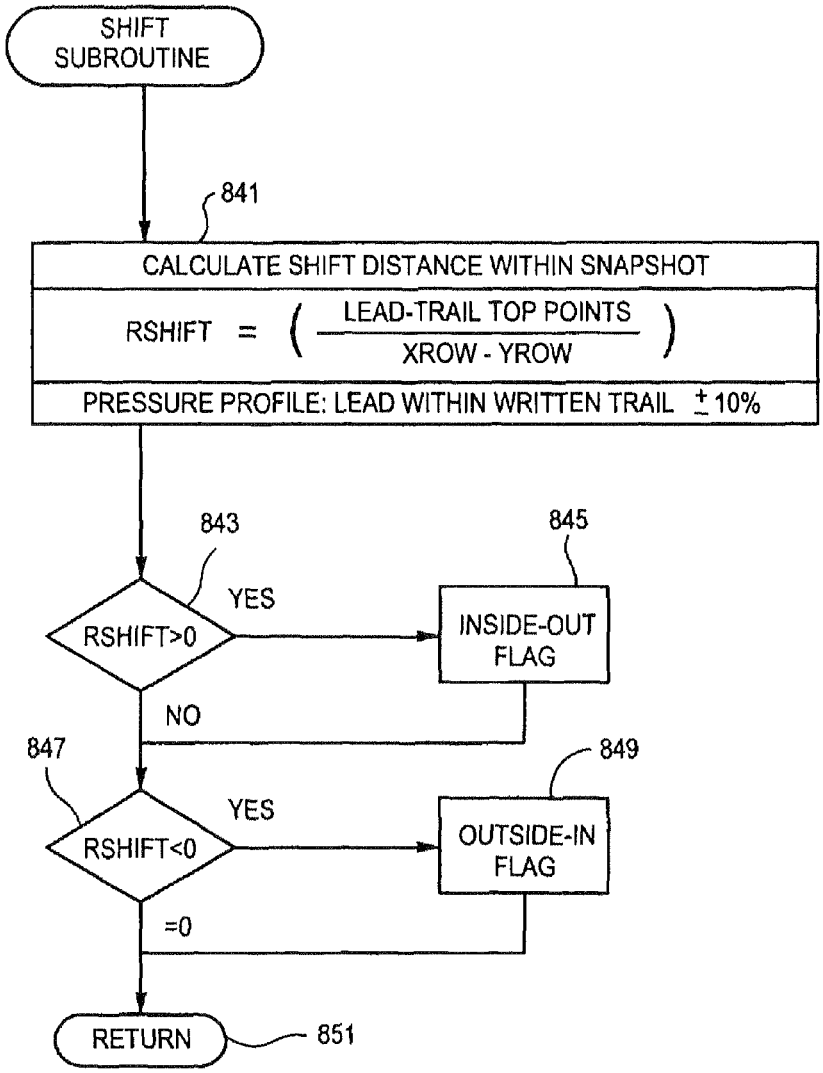
FIG. 32 is a flowchart that delineates the sequence of operations in the SHIFT sub-subroutine in an illustrative implementation.
Figure 33:
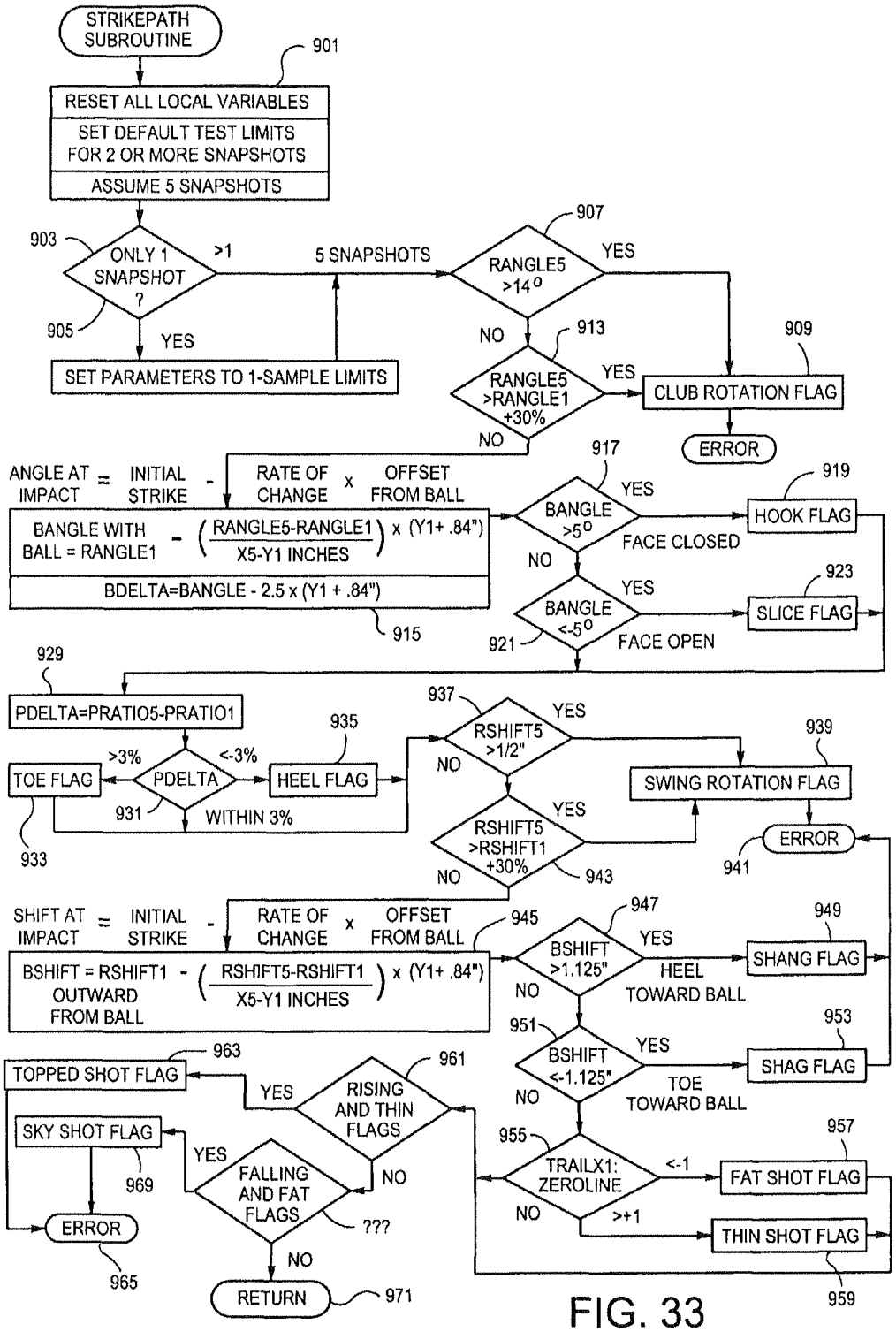
FIG. 33 is a flowchart that delineates the sequence of operations in the STRIKE PATH routine that is designed to extract as much cumulative information as possible across all 5 snapshots in this illustrative implementation.

FIGS. 29 and 33 represent the 2nd layer of analytical subroutines, entitled "Footprint" and "Strike Path", which analyze each segment of the golf strike and then its overall path along the mat, respectively. FIGS. 30-32 represent the 3rd and 4th layers of sub-subroutines that perform lower order tests and calculations that are ultimately used to declare whether the current shot is a "thumbs up" or "thumbs down" and then why and by how much.

Figure 14A:
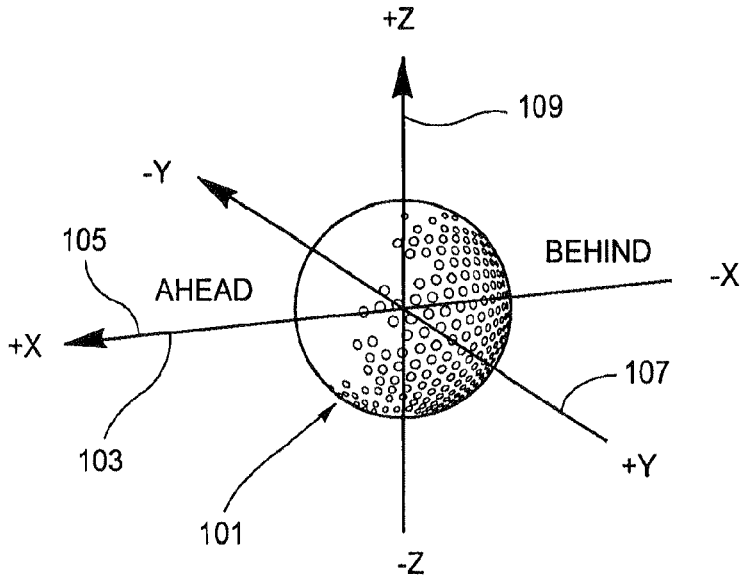
FIG. 14A shows the 3 orthogonal axes that go through the center of golf ball 101, all of which are oriented with respect to an imaginary target line 103 drawn from the ball straight to the target—the flag at the next hole.

Turning to FIG. 14*a*, this figure shows the 3 orthogonal axes that go through the center of golf ball 101, all of which are oriented with respect to an imaginary target line 103 drawn from the ball straight to the target—the flag at the next hole.

The "X" or forward axis 105 is coaxial with target line 103, allowing the golfer to visually align the path of the ball with the target flag. The X axis is positive for strokes that strike ahead of the ball—typically resulting in "thin" shots, and negative for strokes that land behind the ball—typically resulting in "fat" shots.

Similarly, by visualizing the "Y" or horizontal axis 107 allows the golfer to visually align with the ball, e.g., to adjust his/her stance prior to swinging. As will be explained further below, the Y axis is positive to identify the position of shots that "hook" or veer left, and negative to identify the position of shots that "slice" or veer right.

The "Z" or vertical axis 109 is typically oriented positive to identify the position of shots that rise up, as the name "skied" shots suggests, and negative for strokes that exert a downward force into the ground.

Figure 14B:
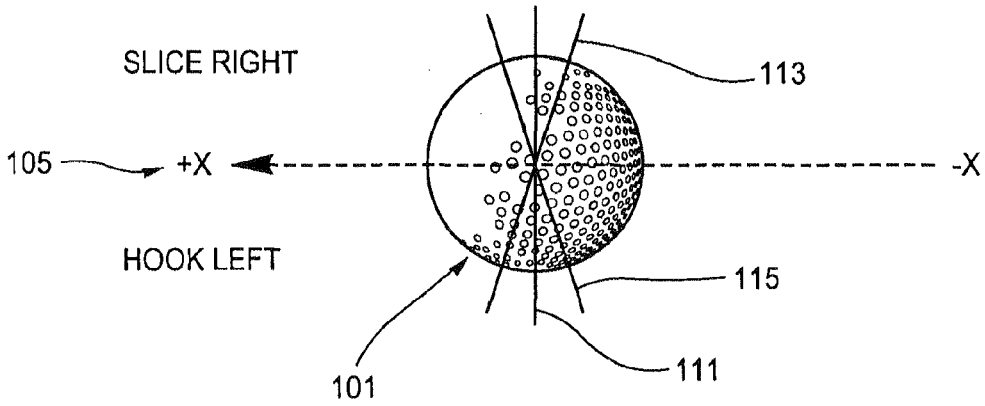
FIG. 14B looks down on the ball 101 to explain the relationship of the club face to the center of the ball.

FIG. 14*b* looks down on the ball 101 to explain the relationship of the club face to the center of the ball. For orientation, target line 103 is drawn through the geometric center of the ball. Given that the golfer's wrists must rotate the club head around the shaft, the 3 straight lines drawn through the center here represent 3 possibilities of how the club face can impact the ball:

[1] ideally, the club face will be squared up 111, or perpendicular to the target line 103, which normally generates a "straight shot" to the target; or

[2] the club face is being turned too slowly into the ball, impacting it with an open face 113 which normally generates a pull or "hook" to the left; or

[3] the club face is being turned too fast into the ball, impacting it with a closed face 115 which normally generates a push or "slice" to the right.

All of the abovementioned shots are graphically depicted, along with their underlying dynamics of motion, in FIGS. 15 and 16, described below. It should be noted that the analytic threshold criteria used herein as to when a given stroke delta becomes an "error" shot are illustrative and are considered "rule-of-thumb", pending further refinement with empirical data as this device is used. For example, the club face criterion ">5° open" upon ball impact, presently used to declare a "hook" shot error, could be tightened to ">2.5° open" if further empirical evidence points that way.

Before analyzing why a particular sand wedge shot went bad, it is helpful to first define what an ideal swing would be. The criteria for an ideal swing shown below is set forth for purposes of illustrating the methodology described herein. In this example, we first identify what the independent controlling parameters of a sand wedge stroke are, and secondly, what the ideal values would be for an ideal straight shot:

TABLE 1

| Typical Sand Wedge Club Angles | |
|---|---|
| Lie Angle | Club shaft has a built in horizontal lie angle @ 60° up from the ground |
| Vertical Angle | Club shaft has a built in downward angle of attack @ 8° off true vertical [see FIG. 2] |
| Loft Angle | Club face has a built in wedge-shaped angle @ 56° up from the ground at the rear |
| Lines across Club Face | Club has standard horizontal lines across the face, such that the $5^{th}$ line is typically 3/4" up the face |
| Contour of Bottom Sole | Contour of various club bottoms curve at a radius ranging from 20" [virtually flat] to 3" [ends curve up sharply] |

Table 1 defines the illustrative shaft angles that the sand wedge must be held at in order to execute an ideal stroke with respect to the ground. The next table 2 defines the illustrative positions, angles and rotations that the shaft and club face must swing through to execute an ideal stroke with respect to the ball:

TABLE 2

| Ideal Sand Wedge Golf Stroke Parameters | |
|---|---|
| Type of Swing | standard 9 o'clock backswing [per FIG. 3] |
| Shaft: vertical angle | golfer swings club shaft with a downward angle of attack leaning 8° forward off true vertical [see Table 1 and FIG. 2] |
| Swing Angle down into ball | downward angle of attack @ 15° into the ground at point of impact downward through the ball [per FIG. 2] |
| Swing Arc through ball | downward semi-circle orbit in the plane of the lie angle @ 60° up from ground toward the golfer |
| Shaft: horizontal angle | golfer swings through ball at the club's built-in lie angle @ 60° so that the club bottom is perfectly horizontal |
| Motion of Swing | Gliding motion across mat exerts modest pressure down, halfway between surface skimming and a downward spike |
| Pressure down on the mat | club exerts a modest downward [normal] strike force on the mat, where the toe and heel of club exert equal pressure |
| Club Face: Impact Angle | club face impacts the ball flush with its horizontal axis Y at the center of ball [perpendicular to its forward axis X] |
| Club Face: Horizontal | club impacts the ball at the center of the club face [typically at the 1-1/8" center of its 2-1/4" width] |
| Club Face: Vertical | club face impacts the forward axis of ball at the $5^{th}$ line up [typically 3/4" up the face from its bottom edge] |
| Club Rotation about shaft | club face rotates @ 2.5° per inch of travel as it passes through the ball [30° per foot before and after impact*] |
| Strike Line | bottom sole of club face makes initial contact with the mat, creating a pressure line typically over 2" long |

TABLE 2-continued

| Ideal Sand Wedge Golf Stroke Parameters | |
|---|---|
| Zero Line on the mat | club strikes the mat at the Zero Line imprinted on the mat @ .84" ahead of center of ball [see calculation below**] |
| Club Footprint | Strike Line width extended across beveled front edge of sole, generally .160" to .220" [only .125" width is needed] |
| Strike Path across the mat | club maintains contact with the mat for at least 1" to 4" past the initial Zero Line |
| Snapshot | very fast sensors allow up to 5 snapshots or readouts of the club footprint as it moves down the strike path across mat |
| Club Speed | speed across mat is derived from deltas calculated between $1^{st}$ ==> $2^{nd}$ snapshot, typically 82-95 mph for an avg golfer |

*Club face rotation rate from over 10 years of empirical data from pro tour players by golf pro/expert/trainer/writer A.J. Bonar, as described in his book '*AJ Reveals the Truth about Golf*', pp. 55-57, published by AJ Golf [2003]

**Zero Line distance ahead of ball is calculated from the ball's .84" radius, the club's 56° loft angle, the $5^{th}$ line 3/4" up the club face, and the swing's 15° angle of attack, to yield approx. the .84" radius of the ball, as follows: Height of club off ground at impact: Zc = .84" − (.75" sin 56°) = .22" Distance of Zero Line ahead of ball: Xz = Zc/tan 15° = .821"

All of the abovementioned lines, positions, angles and rotations are graphically depicted, along with their underlying dynamics of motion, in FIGS. 15 and 16, described next. Similarly, all of the abovementioned footprints, paths and snapshots are graphically depicted, along with their underlying dynamics of motion, in FIGS. 17 and 18, described later.

FIG. 15A illustratively depicts how deviations in vertical X-Z alignment of the club can be detected by horizontal arrays of pressure sensors in an illustrative embodiment of the present invention.

At the top, club head 117 is being driven downward by the shaft 119 through the center of the ball at the proper 15° swing angle of attack 121. The swing arc 123 first strikes the mat ahead of the ball right at Zero Line 125, and then continues down strike path 127 at a modest depth into the ground. This is considered an ideal swing 129 along the X axis 105 in the vertical plane.

In contrast, if club head 117 comes in too high, it will strike the ground well ahead of the ball [if at all], and generally leave a strike path of only slight depth. This will result in a thin shot 131, as depicted in the center. Also, at an extreme, a thin shot can become a topped shot, as will be discussed later.

At the other extreme, if club head 117 comes in too low, it will strike the ground behind the ball, and generally leave a strike path of more severe depth. This will result in a fat shot 133, as shown at the bottom. Also, a fat shot can become a skied shot, as will be discussed later.

FIG. 15B depicts how deviations in vertical Y-Z alignment of the club can be detected by horizontal arrays of pressure sensors in an illustrative embodiment of the present invention.

At the top, club head 117 is shown passing through the ball [obscured from view] perfectly horizontal with the ground along the Y axis 107. As a result, shaft 119 makes a perfect 60° lie angle 135, which exerts equal pressure on the heel 137 and toe 139 across the 2" bottom edge. Coupled with the ideal swing 129 of FIG. 15A, this results in a straight shot 141 toward the target.

In contrast, if shaft 119 is tilted too far back, the lie angle drops below 60° which is considered too upright for a good shot. This 'delta' from the proper vertical shaft angle is reflected as heavy pressure at the heel 144 and light-to-zero pressure at the toe. This Z rotation typically will result in a pull 143 or hook 145 to the left, as depicted in the center of FIG. 15B, because the face is actually closing at ball impact and is already aiming left.

At the other extreme, if shaft 119 is tilted too far forward, the lie angle rises above 60° which is considered too fiat for a good shot. This delta from the proper vertical shaft angle is reflected as heavy pressure at the toe 148 and light-to-zero pressure at the heel. This Z rotation will typically result in a push 147 or slice 149 to the right, as depicted at the bottom of FIG. 15B, since the face is actually opening at ball impact and is already aiming right.

In geometric terms, these toe-to-heel pressure deltas serve to identify and quantify either a CCW [too upright] or CW [too flat] rotation of the club head 117 in the vertical Y-Z plane around the forward X axis 105.

FIG. 16 depicts the possible shot variations in the horizontal plane. For greater understanding, the 9 possibilities shown in FIG. 16 have been arranged in a simple "Wheel of Horizontal Trajectories" like spokes of a wheel every hour and a half. They are logically dispersed so that all 3 'Hook' shots are on the left, all 3 'Slice' shots are on the right and all 3 'Straight' shots are in the middle, with the highly sought-after ideal swing 129 appearing in the center hub.

The target line 103 points straight up for all 9 cases and the large arrows depict the general direction of the resulting shot. The 9 shot variations shown in FIG. 16 are based on the 3 possible horizontal face angles in combination with 3 possible swing arcs:

TABLE 3

Face Angles and Swing Arcs

| Face Angle at ball impact | Swing Arc through the ball |
|---|---|
| Square 111 | Centered 151 |
| Open 113 | Inside-Out 153 |
| Closed 115 | Outside-In 157 |

Ideal Swing

Center Hub—starting with the best case, the ideal swing 129 in the center hub shows the ideal rotation of the club face through the center of the ball. Namely, the face is open 113 just prior to impact with the ball center, squared up 111 just as it impacts the center, and closed 115 just after impact. When this ideal face rotation is combined with a centered swing 151, the result is the desired straight shot 141 to the target.

Changing the Face Angle only

10:30—next, just varying one variable, the face angle, from squared up 111 to closed 115==>yields a hook left 145. The curved 'hook' deviation is due primarily to the CCW sidespin imparted as the ball rolls off the closed face. 4:30—similarly, varying the face angle from squared up 111 to open 113==>yields a slice right 149. The curved 'slice' deviation is due primarily to the CW sidespin imparted as the ball rolls off the open face toward the toe.

Changing the Swing Arc Only

7:30—as parallel motion dynamics to the above 2 cases, just varying another variable, the swing arc, from centered 151 to inside-out 153==>yields another hook left 145. In this case, the curved 'hook' is due to CCW spin imparted by the club face sliding outward within the stroke arc, just as its name suggests—i.e., the golfer's follow-through came further out overhead. 1:30—similarly, varying the swing arc, from centered 151 to outside-in 157==>yields another slice right 149. In this case, the curved 'slice' is due to CW spin imparted by the club face sliding inward within the stroke arc—i.e., the golfer's follow-through went further back over the shoulder.

Combining Opposing Sidespin Forces

12:00—as countering motion dynamics to the above cases, varying both variables—face angle and swing arc—in opposing directions tends to straighten out the shot. Namely, combining a closed face 115 with an outside-in swing 157==>yields a pull shot 143 straight left. The 2 opposing CW/CCW sidespins negate each other, essentially straightening out a hook.

6:00—similarly, combining the mirror-image variables, an open face 113 with an inside-out swing 153==>yields a push shot 147 straight right. Once again, the 2 opposing sidespin rotations tend to negate each other, straightening out what would otherwise be a slice.

Combining Parallel Sidespin Forces

9:00—as reinforcing motion dynamics to the above cases, varying both variables—face angle and swing arc—in parallel directions tends to magnify the shot error. Namely, combining a closed face 115 with an inside-out swing 153==>yields a hook sharply left 155. The 2 parallel CCW/CCW sidespins reinforce each other, essentially doubling the hook's severity.

3:00—similarly, combining the mirror-image variables, an open face 113 with an outside-in swing 157==>yields a slice sharply right 159. Once again, the 2 parallel sidespin rotations tend to reinforce each other, doubling the severity of what would otherwise have been an ordinary slice.

What the Wheel of Horizontal Trajectories in FIG. 16 means to the instant implementation is this: once the analysis routine has identified and quantified the face angle and swing arc variables for a given stroke, the output routine can easily classify them as to their degree of error [e.g., simple hook, pull shot, or severe hook], quickly calculate the initial direction of each shot, and turn ON single or multiple error indicators as feedback to the errant golfer.

FIG. 17 provides an overview of how this illustrative embodiment works, relying primarily on the floor mat sensor array depicted. This array contains successive rows of impact sensors, that may, for example, be the above-described commercially available Tactilus sensors. As indicated above, the Tactilus sensor element is essentially a thin flexible or rigid sheet that is densely packed with sensing points or pixels. These sensing points can be spaced as close as 1 mm (0.04") apart and can collect data as rapidly as 2,000 readings per second. The sensing points may use capacitance, resistance or piezoresistance architectures. These small impact sensors are illustratively arranged as discussed in more detail at FIG. 22 and register and readout any changes in pressure as the given golf club initially strikes and then slides down the mat. The sensors as described in the above-identified '586 patent may likewise be utilized herein.

As the club swings through the ball, the ball impact line 201 becomes the reference focal point. This is because the quality of the shot is determined by how close the golfer got the center of the club face to impact line 201, which is coaxial with the ball's horizontal axis 107.

This proximity of the club face to the impact line 201 can be worked backward from the strike line 203, following golf professional A J Bonar's teachings as to proper sand wedge stroke angles and the strike line distance ahead of the ball [see Table 2]. As a first illustrative parameter, how close the given stroke came to the ball center on impact line 201 can be assessed by how close the golfer's initial strike came to strike line 203.

The sensors next continue to register and readout changes in pressure as the club slides down the mat, revealing both positional and pressure data. As a second illustrative parameter, how close the club's face angle came to being squared up to the ball's forward axis 105 can be assessed by looking at changes to the club's footprint 205 [described in the next FIG. 18] as it moves down strike path 127. These changes in club footprint include its length along Y axis 107, its width along X axis 105, its pressure depth down into Z axis 109 and, importantly, any rotation angle 207 that can be gleaned from this right-to-left positional data [this process will be explained in greater detail at FIG. 24].

Once the footprint rotation angle has been identified and quantified, the initial face angle at the ball impact line 201 can be calculated backward from the first strike point. In the example listed in FIG. 17, the footprint rotation angle 207 was found to be closing @ 2.5° per inch. Since the face was known to be squared up [angle=0°] at the imprinted mat Zero Line 125, the face angle was essentially rotated backward to the ball impact line 201, where it came up as an 'open face' error [angle=−2.1°] as shown on FIG. 17.

In the example shown in FIG. 17:

The swing of the RH club face:

struck the ball at the Ball Impact Line with the face 2.1° Open (based on 0.84" Ball Radius×2.5° Ideal Rotation)= 2.1°)

next struck the mat right at that mat zero line (no+/− error) with the face squared up @ 0° ROTATION ANGLE.

Figure 18A:
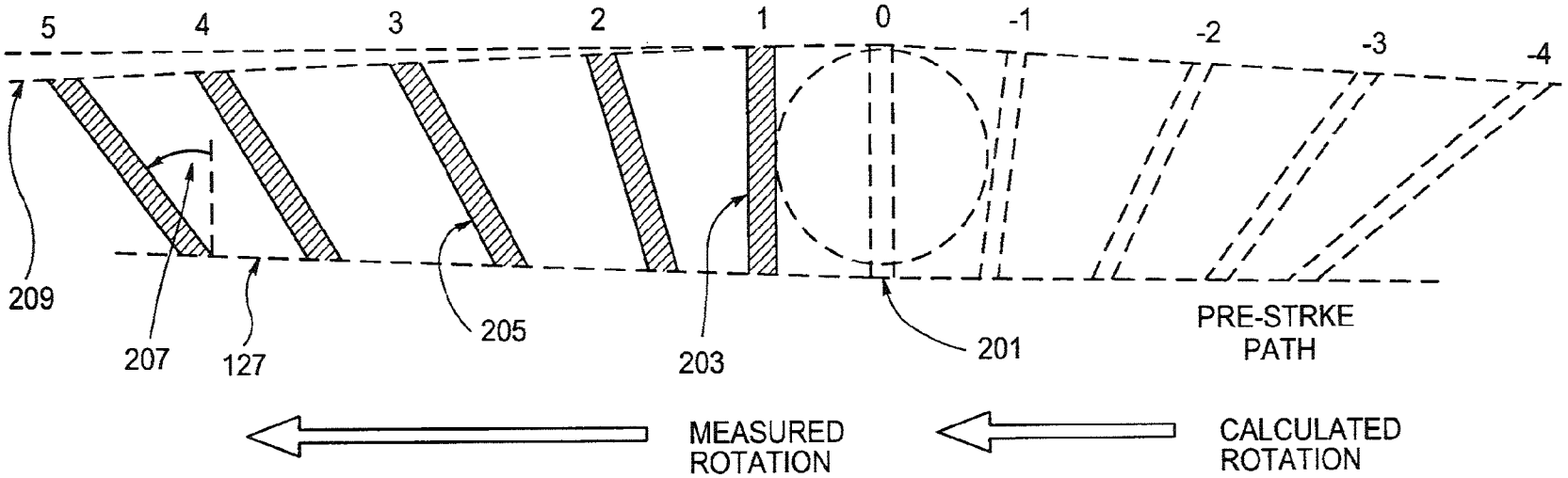
FIG. 18A shows the same sensor array process of FIG. 17 in greater detail, expanded to the concept of successive 'snapshots' 211 of the club footprint moving rapidly from right to left.
Figure 19:
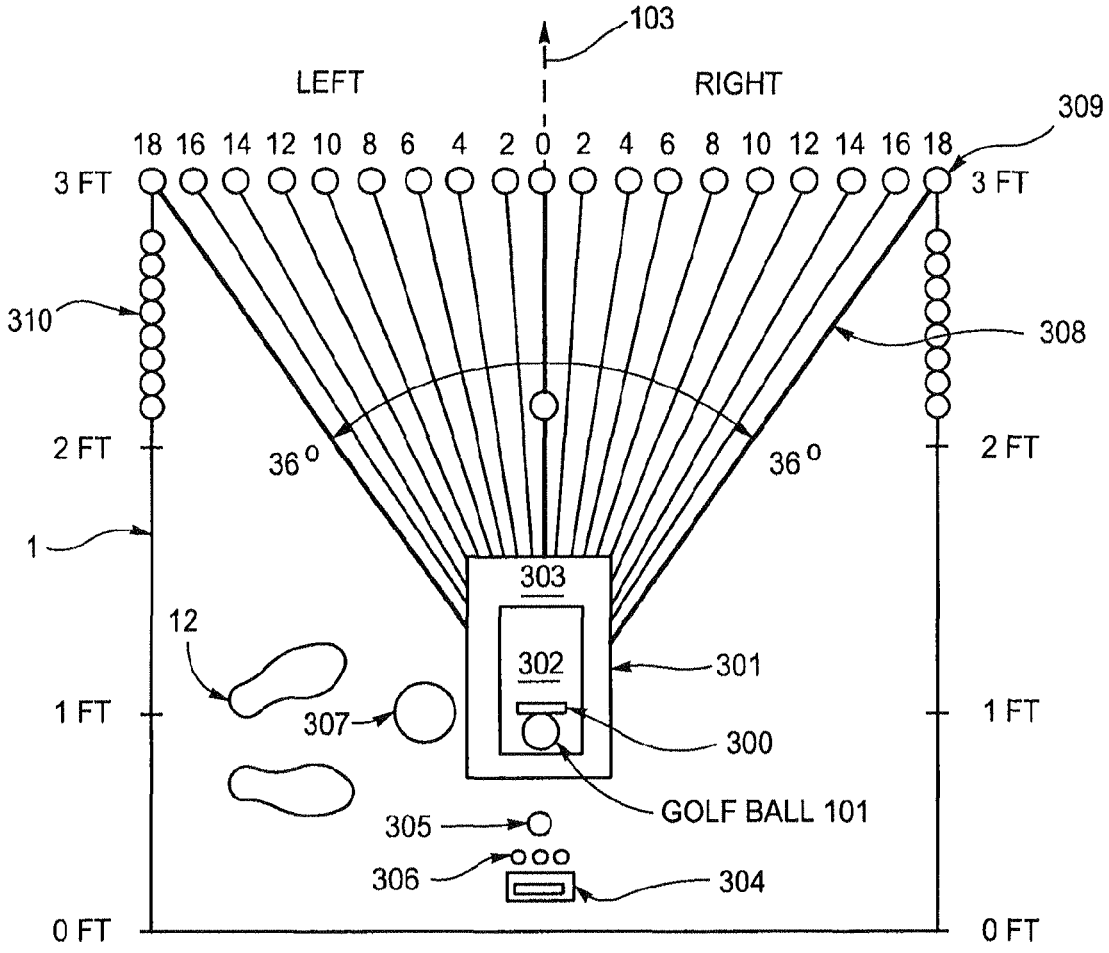
FIG. 19 shows an exemplary layout of a further illustrative embodiment on the golf practice mat 1.

FIG. 18A shows the same sensor array process of FIG. 17 in greater detail, expanded to the concept of successive 'snapshots' 211 of the club footprint 205 moving rapidly from right to left. In the illustrative implementation, these very fast snapshots are based on sensor data being sampled @ 2000 Hertz, which is equivalent to a sample time of 0.0005 seconds.

The following chart tabulates how fast the club head is traveling across the mat at different swing speeds, which put an upper limit on the number of snapshots that can be taken of that motion. For ease of reference, the chart is repeated below.

| | | Below Average Golfer | Average Golfer | Above Average Golfer | Tour Pro |
|---|---|---|---|---|---|
| | SWING SPEED | 80 MPH | 90 MPH | 100 MPH | 120 MPH |
| Strike Path Snapshots | Inches per sec | 1408" | 1584" | 1760" | 2112" |
| | secs per inch | .000710 | .000631 | .000568 | .000474 |
| | secs per 4 inches | .00284 | .00253 | .00227 | .00189 |
| Sampling Rate @ 2000 Hz + .0005 secs | Snapshots per inches | 1.42 | 1.26 | 1.14 | .948 |
| | Snapshots per 4 inches | 5.68 | 5.06 | 4.54 | 3.78 |

As, shown above, the range of speeds varies from 80==>120 mph, corresponding to a below average golfer at the low end and a tour pro at the high end. Thus, the average golfer, assumed to swing at 90 mph, falls nicely within the reach of the 2000 Hz sampling rate. That is, moving at 1584" per second, about 1¼ snapshots can be taken for every inch of travel—which translates to 5 snapshots for 4 inches of travel. And, even for the worst-case 120 mph tour pro, at least 3 snapshots can be taken for the same 4 inches of travel.

The example at the bottom of FIG. 18A shows how 5 snapshots can be taken in just 4 inches of travel. Starting at frame (−4) on the right side, the dotted lines show the pre-strike path of club face, although it has not yet struck the mat and, hence, is not yet registered by the sensors. As the club reaches frame (0), it hits the ball at impact line 201 just prior to striking the mat in frame (1) at strike line 203—right on target. The footprint 205 is now being registered by the sensors, which soon reveal how it has continued to rotate open-to-closed down strike path 127. This angular footprint rotation 207 is recorded as 5 snapshots corresponding to frames (1)==>(5) across just 4 inches of travel down the X axis 105.

In addition, successive lateral shifts across the horizontal Y axis 107 in frames (1)==>(5) reveal a higher-order rotation 209 in the strike path itself. Such positive Y shifts signify that this stroke has an outside-in swing arc. Conversely, had the Y axis shifts been negative [creeping up instead of down, as shown here] this stroke would have had an inside-out swing arc.

Figure 18B:
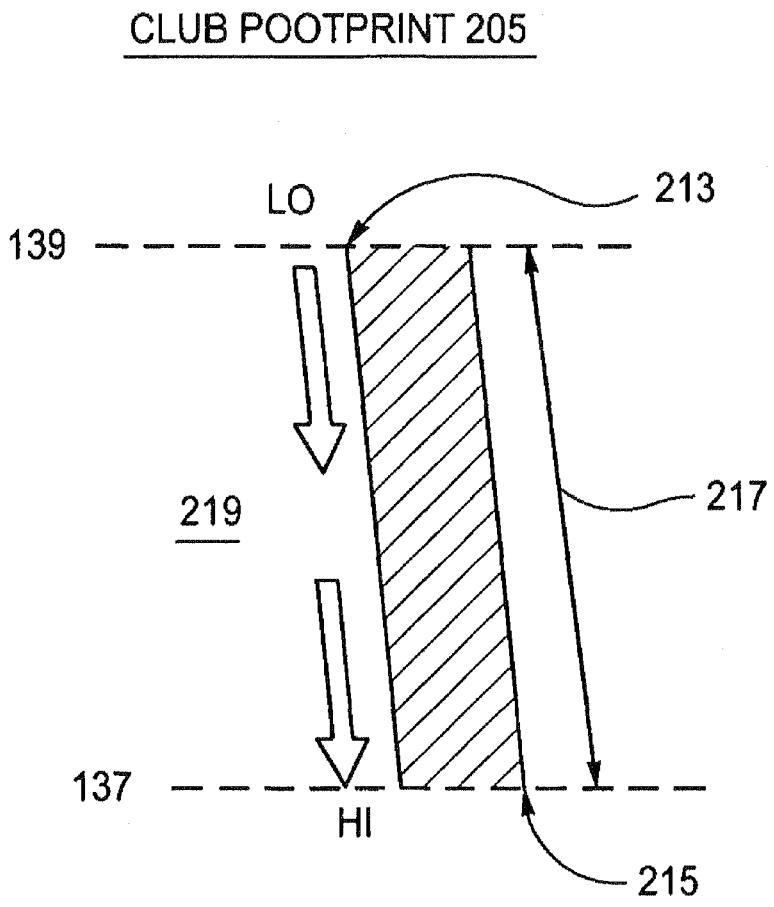
FIG. 18B shows the illustrative club footprint 205 tracked across FIG. 18A in greater detail, expanded to the concept of leading and trailing edges.

FIG. 18B shows the club footprint 205 tracked across FIG. 18A in greater detail, expanded to the concept of leading and trailing edges. Each snapshot 211 of a given footprint has a front or "lead" edge 213 moving at a constant speed across the sensor array. It is closely followed by a rear or "trail" edge 215 that gives width to the footprint. This trail edge 215 and the footprint width is largely dependent on the sampling rate [2000 Hz here] and the width of the sampling pulse, which can be selectively narrowed or expanded, as desired.

Given the right balance of sampling rate and pulse width, the trail edge 215 can effectively represent the first lead edge 213 that occurred at strike line 203. This essentially becomes the footprint reference length, rotation angle, and pressure gradient to which every footprint that follows can be compared. This becomes significant, first, when calculating overall face angle rotation [from lead edge 213] across, say, 5 snapshots; and, second, when rotating the initial strike line 203 [from the first trail edge 215] backward to the ball impact line 201, to see how far the face angle was off of 'square'.

Moreover, there is additional valuable data available from the pressure gradient 219 [in psi 'deltas'], running the length 217 of the footprint from toe 139 to heel 137. In the example here, increasing from low-to-zero pressure at toe 139==>high pressure at heel 137 signifies that the stroke is too upright with a fading lie angle<60°, resulting in a pull 143 or hook 145 [see FIGS. 15B and 16]. Conversely, increasing from low-to-zero pressure at heel 137==>high pressure at toe 139 signifies that the stroke is too flat due to a growing lie angle>60°, resulting in a push 147 or slice 149. In the present example, all of the above calculations in FIG. 18B assume each footprint has been 'normalized' via a standardizing calibration process, to be discussed in FIGS. 19 and 20.

Thus, in summary, in this example, by itself, each snapshot of the club footprint reveals the following:

LEAD EDGE 213 defined by the left-most sensors "ON" during the sample indicates the instantaneous face angle LENGTH 217 indicates how flush the stroke is WRT the ground; clubs with beveled-arc soles must first be normalized TRAIL EDGE 215 selectively defined by the pulse width of sample indicates the instantaneous direction down the STRIKE PATH PRESSURE GRADIENT 219 defined by "ON" sensors highest PSI values during sample LO toe→HI heel (shown here) stroke is TOO UPRIGHT—results in Hook (see FIG. 15B)

HI toe→LO heel (opposite case) stroke is TOO FLAT—results in Slice (see FIG. 15B)

STRIKE PATH taken together, snapshots of successive footprints reveal:

changes in LEADING EDGE—indicate rotation of face angle (see FIG. 14B)

changes in LENGTH—indicates stroke rising off mat prematurely (see FIG. 18A)

changes in PRESSURE GRADIENT—indicate shaft rotating away from original lie angle (see FIG. 15B)

FIG. 19 shows an exemplary layout of the above illustrative embodiment on the golf practice mat 1, which is a further embodiment of FIG. 1.

In this example, the golf ball 101 and mat zero line 300 remain as imprints in the center of the mat. The sensor array 301 comprises a hi-res area 302 surrounded by a lo-res apron 303, which will be described in more detail in FIG. 22.

The entire golf swing training process and facilitating mechanisms can be tracked from one end of the illustrative mat 1 to the other. Starting at the lower end, there is, in this example, a calibration pad 304 where sand wedges with many different sole contours can be 'normalized' to a standard 2" flat length. By this unique mechanism, footprints made by bottom contours with up to a 3" arc can be reconfigured to lie flat on the mat, regardless of their X-Y positional orientation, their Y-Z pressure gradients, or any offsetting angular rotation.

The golfer begins each new swing by simply tapping reset switch 305, indicating that he/she has seen and reviewed the results of last swing and stands ready to swing again. Both the initial calibration and sequential swing processes use the red/yellow/green status LEDs 306 to reflect the status of the CAL or the current swing—e.g., 'green' for ready to go, 'yellow' for processing results, and 'red' for results on display.

The golfer stands in foot imprints 12 and swings at the zero line 300, going through ball imprint 101. Hopefully, the stroke lands entirely within hi-res sensor area 302 so as to create a viable shot, albeit with a bad hook or slice. Should he/she stray from the hi-res area, the lo-res apron 303 will pick up any failed attempts to strike outside the hi-res zone and evaluate the nature of the error shot for feedback to the golfer.

During the given golf swing, microcontroller 4 [not shown, see FIG. 1] detects that a swing has been taken, stores the data in memory, analyzes the data for any viable shots, with or without errors, and if not, flags the nature of any non-viable shot, then finally displays the results of the shot in a user-friendly manner to encourage specific ways to improve on the last stroke.

All of this is done preserving as much raw and calculated information as possible that can serve as constructive feedback to the golfer: for example, displaying how close to a perfect swing he/she was, or what error shot resulted and what most likely caused it. Pertinent calculations and overall summary data are stored as archival data in memory 8 [also not shown] for cumulative trend analysis such as performance deltas and error repetitions.

At the upper end of FIG. 19 are several exemplary LED output arrays built into the mat to provide immediate visual feedback to the golfer. Fanning out from the sensor array 301 is an array of small line-of-sight [LOS] tracer LEDs 308 to dramatize the pathway of the current shot toward the horizon. At the very far end is an array of large LEDs 309 to display viable strokes that veer up to 36° right or left, numbered from R1==>R18 on the right and L1==>L18 on the left [note: only the first 18 of 36 are shown—any shot>36° is considered non-viable]. As a special case, the severity of a 'hook' left or 'slice' right are indicated by turning ON the next higher 1 or 2 LEDs.

The most important LED "0" sits in the center reflecting a perfect shot 141 straight at the target. Immediately in front of LED "0" is another LED that signifies the last stroke achieved a perfect lie angle @ 60° which is perhaps equally as difficult [discussed further at FIG. 21B].

Running down either side of the far end is another array of stroke feedback LEDs 310 that reveal which fatal error[s] the golfer made on the last stroke.

These reflect the primary error shot deviations from the perfect stroke, especially for such errors as 'thin' and 'shank' shots.

All of this is done within the natural vision of the golfer looking toward the horizon following his/her current golf swing. These arrays of LED displays are quite cost-effective in that they are self-contained within the same mat as the sensor array 301 and microcontroller 4, especially where space is limited.

In this example, there is one more illustrative output that acts as a final confirmation of just how close the golfer's current stroke was to an ideal stroke. The initial strike feedback circle 307 pinpoints exactly where his/her initial strike fell with respect to mat Zero Line 300. This is a visual aid to help the golfer judge how much he/she must adjust a stroke to match the ideal strike point in the center of the circle, as opposed to looking at a resulting shot and guessing what must be changed to correct the error [to be discussed at FIG. 21A].

In summary, in this example, exemplary outputs include:

LED's indicate ball direction (based on initial launch data)

shots up to 36° left or right (>36° are bogus, LED 18 flashes)

multiple LEDs indicate HOOK or SLICE (i.e., next higher 1-2 LEDs light up for emphasis, depending on severity of CW/CCW English)

advantages of LED display outputs at end of mat:

(A) LEDs conveniently constructed/operated/portable within the same mat as the sensor array (B) instantaneous visual feedback without looking up, coupled with LOS tracer path LEDs for effect (C) very reliable, very inexpensive, self-explanatory—hence, a highly cost-effective output.

Figures 1, 20A:
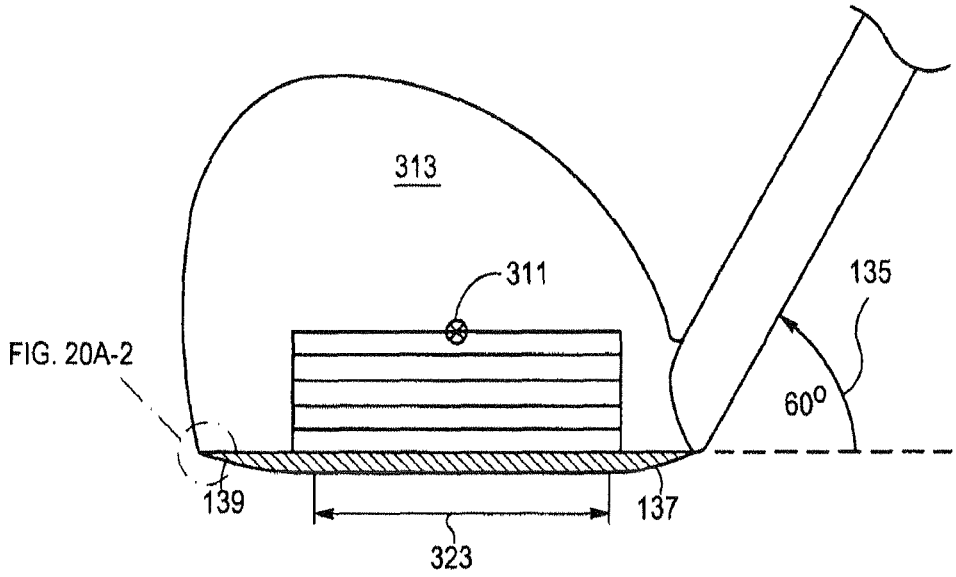
Figures 2, 20A:
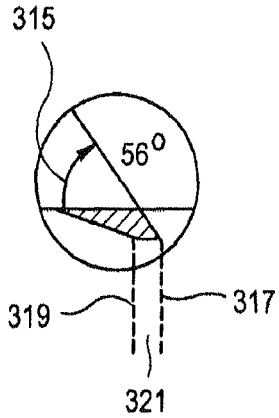
Figure 20B:
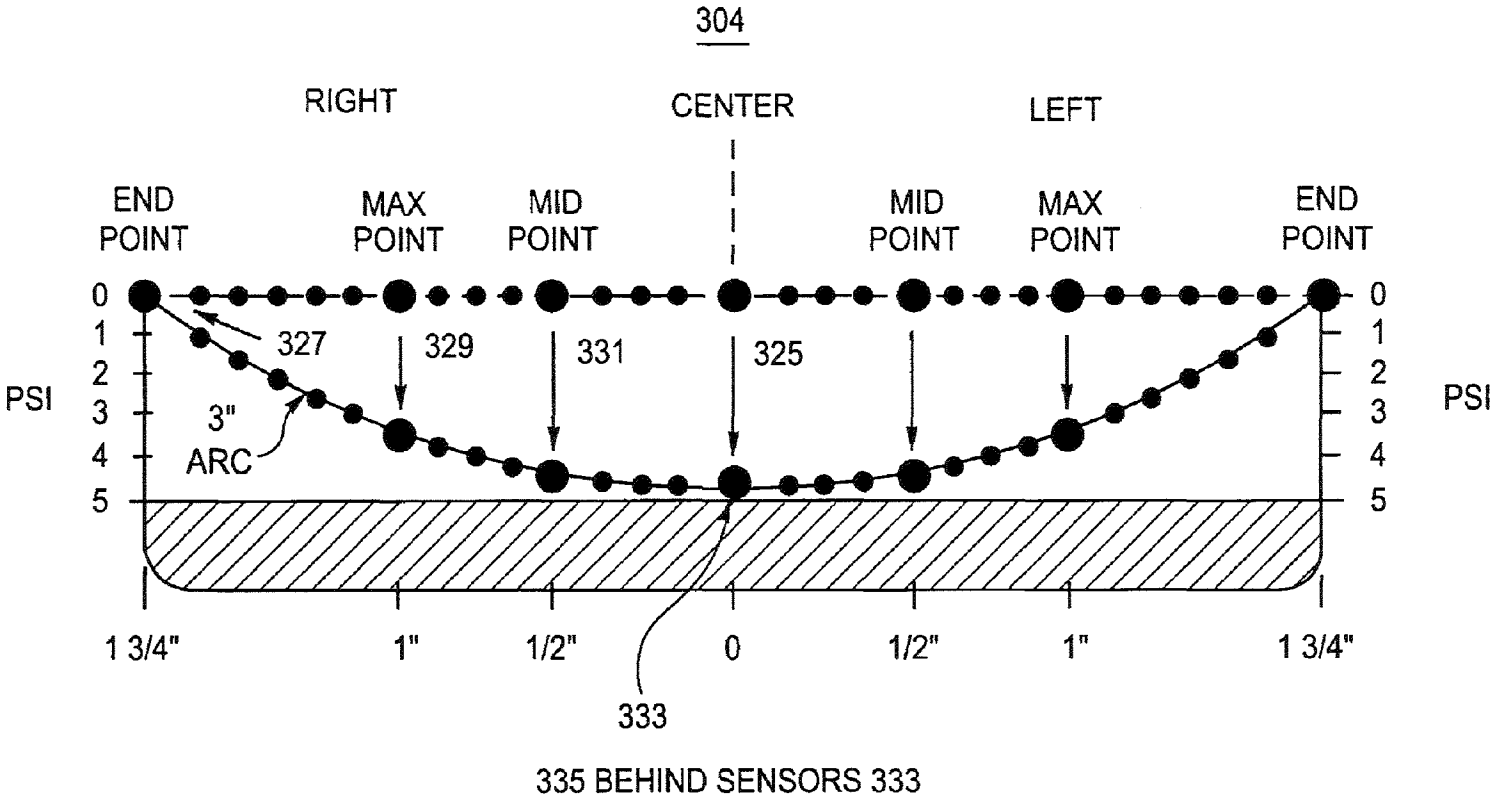
FIG. 20B shows how an illustrative embodiment of that normalizes different contours for the bottom edge to a standard 2" length.

FIG. 20A shows the nominal dimensions of a typical sand wedge, with which most manufacturers seem to comply, except for the contour of the bottom edge, or sole, which can vary significantly from one to the next [discussed in more detail at FIG. 20B].

An important point on the sand wedge is the center 311 of the $5^{th}$ line up the club face 313: this is the ideal impact point 311 with the center of golf ball 101. According to golf professional, A J Bonar, this is the point on the club face that must match squared up with the ball's X axis centerline 105 in order to achieve an ideal straight shot 141 toward the target.

FIG. 20A also shows how the club's heel 137 and toe 139 are often curved upward from bottom flat length 323 which is seldom longer than 2 inches. The side view inset shows the 56° loft angle 315 of the club face and its minimum 0.160" thick sole 321. This min thickness of 0.160" guarantees that, as the club strikes the mat with a 15° downward angle of attack, the club footprint will span at least two rows of sensors spaced 0.125" apart. The inset also shows how the lead edge 317 and trail edge 319 of a footprint for the strike line 203 are initially generated.

FIG. 20B shows how an illustrative embodiment of the present invention normalizes various different contours for the bottom edge to a standard 2" length. The example shown here accommodates a worst-case club with a 3" arc. Calibration pad 304 comprises, for example, 2 rows of 29 Tactilus sensors, each calibrated to a range of 1==>5 psi. The front row of sensors 333 and back row 335 are separated by 0.125", representing the lead edge 317 and trail edge 319 of the sole, respectively.

The golfer simply inserts his/her sand wedge into the CAL pad perfectly horizontal, with gradually increasing pressure downward. As the deepest point 325 on the sole contour reaches the bottom, the pressure sensor 333 beneath it registers 5 psi max and signals the golfer to stop pushing down. As the club is pushed down, the CAL pad continuously monitors pressure at each end 327 to verify that the club bottom has remained horizontal.

The CAL routine next stores all 58 pressure values, with the deepest point 325 marked as Cal Ref. The routine first determines how far Cal Ref is off center, and shifts the entire set of 29 values left or right until Cal Ref reaches the center. The routine then calculates how much each neighboring sensor 331 must be scaled up to reach the same uniform pressure depth of 5 psi, out to a maximum distance 329 of 1 inch on either side of the Cal Ref point. This same standardization process is likewise applied to the trail edge 319.

This normalization of the club sole essentially 'zeroes out' the pressure gradient 219 from heel 137==>toe 139 so that, for all analytic purposes, the club footprint appears perfectly flat when horizontal. To reduce the amount of data that must be stored, accessed and archived, the normalized contour for each club is simplified down to just the shift distance for Cal Ref 325 and the scale factors for Mid points 331 and Max points 329.

Figure 21A:
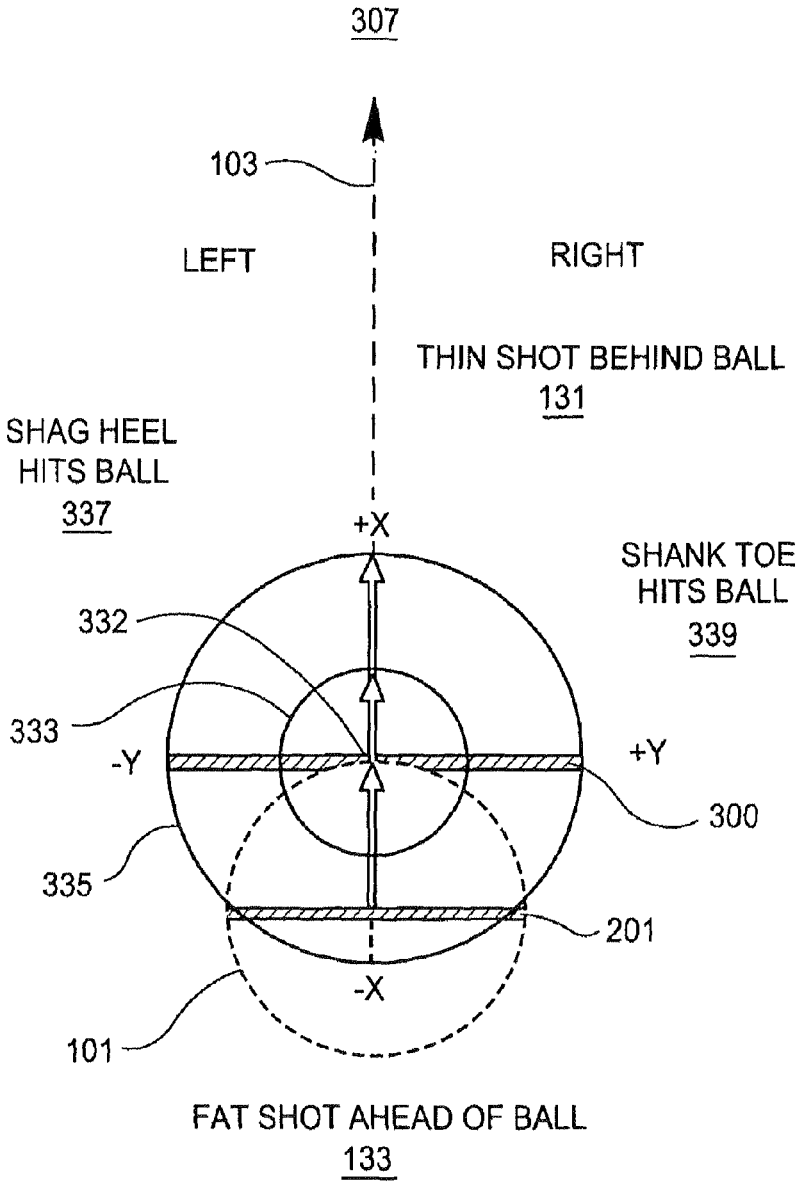
FIG. 21A depicts an illustrative Initial Strike Feedback Circle 307 which pinpoints exactly where the golfer's initial strike fell with respect to Zero Line 300.

FIG. 21A depicts an illustrative Initial Strike Feedback Circle 307 which pinpoints exactly where the golfer's initial strike fell with respect to Zero Line 300. The idea behind this is to stimulate the golfer to adjust his/her stroke on the next swing to match the ideal strike point 332 in the center of the circle.

Two circles are drawn around the center of the mat zero line 203, which is the ideal strike point 332. These circles are populated with closely-packed LEDs 1/16" apart that can be individually activated. The inner circle has a ½" radius representing a desired strike area 333 that yields reasonable-to-exceptional shots. The outer circle has a 1⅛" radius [half the nominal club face width of 2¼"] representing a viable shot area 335 where shots are marginal at best. Outside these circles are non-viable shots, including such extremes as thin shots 131, fat shots 133, shags 337 and shanks 339.

The idea is to display the radial distance from the ideal strike point 332 to the center of the golfer's initial strike line 203. This small delta dramatizes exactly how close the golfer got to executing the elusive perfect shot. Rather than being discouraged by witnessing error shots that veer off by tens of yards, the golfer will be encouraged when he/she realizes the correction is literally a fraction of an inch down at the Zero Line. This is an effective visual aid to help the golfer judge how much he must adjust his stroke to match the ideal strike point, e.g., in the center of the circle.

Figure 21B:
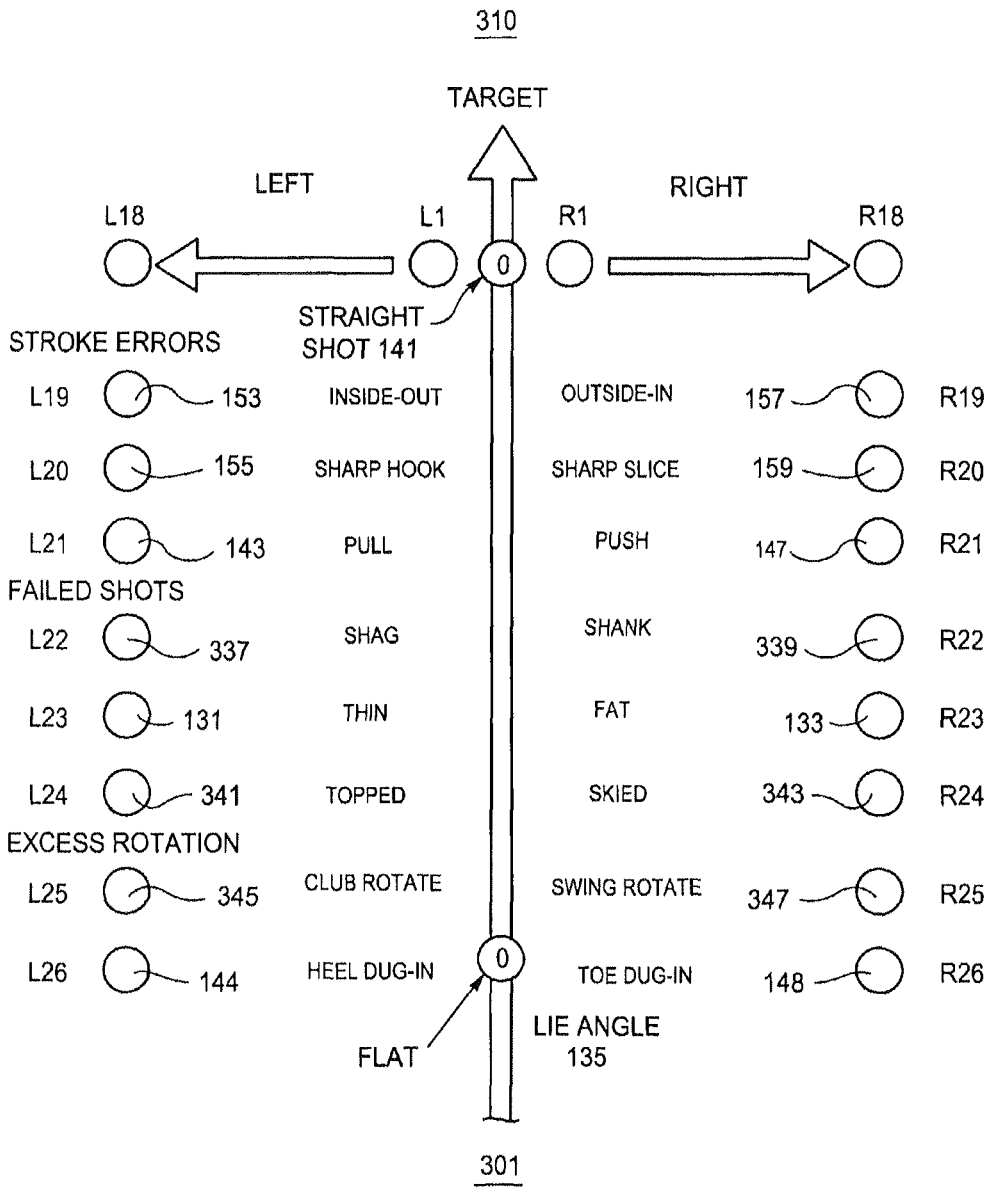
FIG. 21B illustratively depicts the overall stroke feedback lights 310 which display the error[s] arising from the current shot, aligned Left or Right, as applicable.

FIG. 21B depicts the overall stroke feedback lights 310 which display the error[s] arising from the current shot, aligned Left or Right, as applicable (see FIGS. 15, 16 and 19). There are 3 levels of errors in the Left/Right categories: 3 stroke errors each; 3 failed shots each; and 2 excess rotations each. LEDs L18 and R18 signify that the current shot went off at an angle>35° which is essentially a non-viable shot similar to a shag 337 or a fat shot 133. After each swing, the golfer can quickly review the LEDs to see which and how many errors applied. Display of these errors is discussed in greater detail in FIG. 34.

The primary goal of this practice mat is to steer the golfer ever closer to turning ON the straight shot LED "0" in the center of the mat. A secondary goal is to reward the golfer for turning ON the flat lie angle LED 135 on the target line out to LED "0"—even if he/she did not succeed at a straight shot.

Figure 22:
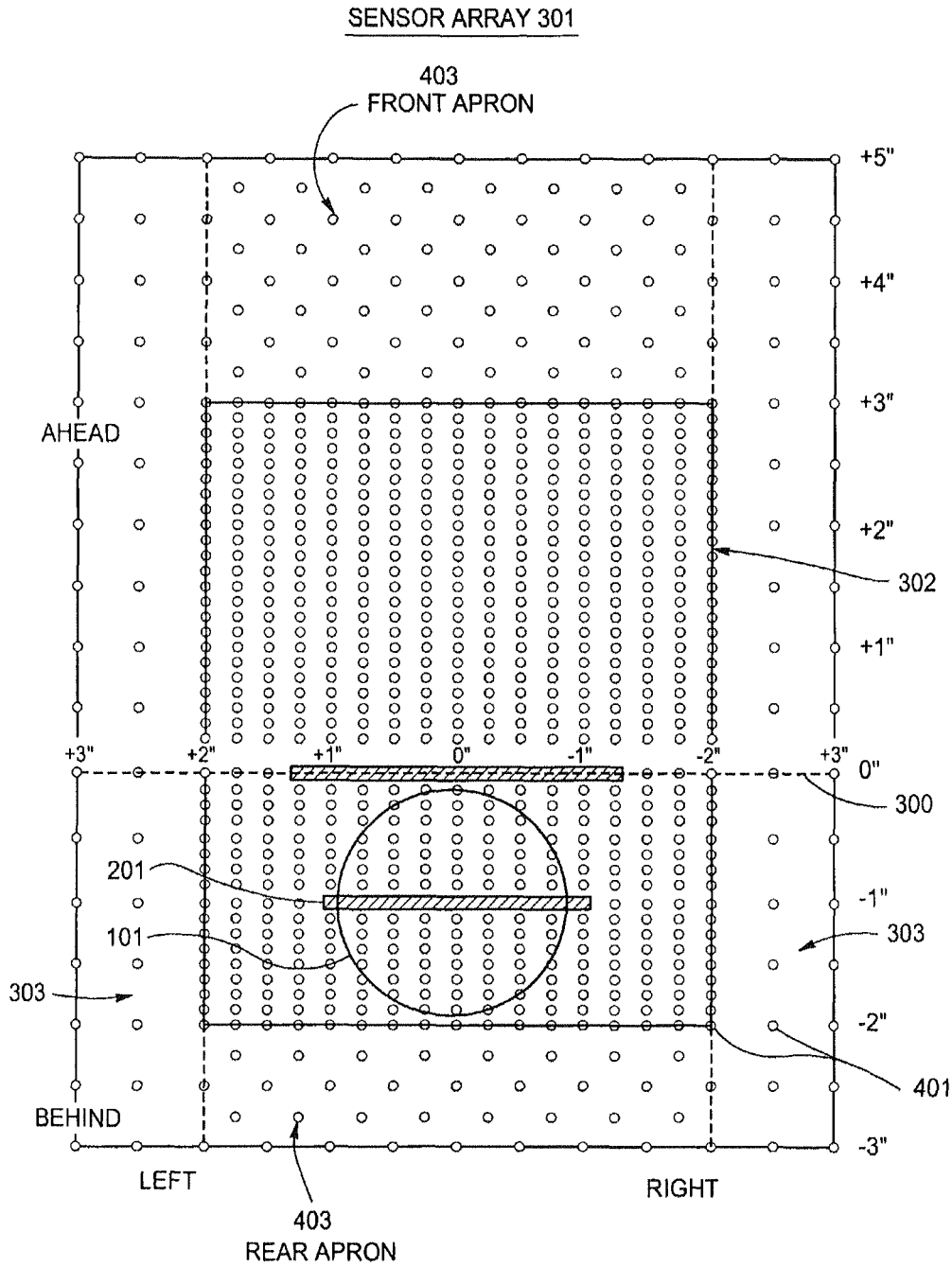
FIG. 22 shows the focal point of an illustrative embodiment of impact sensor 2/Sensor Array 301.

FIG. 22 shows an illustrative embodiment of the Sensor Array 301 that is one illustrative implementation of impact sensor 2 identified above. Other than the golf ball imprint 101, the mat Zero Line 300 is the primary reference point for array 301. This is the visual reference the golfer must use to gauge his swing arc, club face rotation, and impact point.

The sensor array 301 comprises a central hi-resolution (hi-res) strike area 302 surrounded by lo-resolution (lo-res) side aprons 303. In this example, these arrays contain successive rows of impact sensors, may be implemented by the Tactilus sensors described above (or the '586 patent tactile sensor incorporated by reference earlier). The small impact sensors 401 have a diameter of only 0.004" [1 cm], so they can be readily configured into the densely populated hi-res array of ⅛" columns by 1/16" rows [0.0625"], as shown in FIG. 22. This high level of sensor concentration is necessary to achieve a maximum resolution capable of detecting<2.5° angular rotation 207 of footprint 205, as will be discussed in FIG. 24.

The right and left side lo-res side aprons 303 are generally reduced to a ¼" resolution, with a mid-res front and rear apron 403 at 3/16" resolution, due to alternate overlapping at ⅛" intervals. The resolution was reduced in these peripheral areas simply because no viable golf shot can be generated that far from the Zero Line 300. Hence, these lo- and mid-res sensors are merely present to detect failed shots as feedback to the errant golfer. Thus, the golfer can strike anywhere within the overall 6"×8" area and get some level of constructive feedback.

The hi-res area runs reaches 2" behind the Zero Line 300 to pick up possible viable "fat" shots 133 behind the ball, and likewise reaches 5" ahead to pick up possible viable "thin" shots 131 considerably ahead of the ball 101. More importantly, the 5" extended hi-res area ahead of the ball allows more space to possibly get 5 snapshots of a high-speed golf swing @ 100+ mph, as described in FIG. 18A.

The idea for employing such a long stretch of forward hi-res sensors is to capture as many snapshots as possible of a given stroke. Each additional snapshot inherently improves data integrity and, equally important, permits the system to detect very small rotation angles in the swing arc and/or the club face, e.g., <2°, that might otherwise go unnoticed. This was process was described in FIG. 18A with respect to strike path rotation 209 and footprint rotation 207, respectively.

Although the sensor array may be of a wide variety of specific configurations, in this example, the illustrative array is configured as follows:

| SENSOR ARRAY 6" wide × 8" long | |
|---|---|
| LEVEL OF RESOLUTION | |
| CENTER STRIKE AREA | 4"W × 5"L @1/16" accuracy per 1/8" row |
| FRONT APRON | 4"W × 2"L @1/4" overlapped each 1/8" |
| REAR APRON | 4"W × 1"L @1/4" overlapped each 1/8" |
| SIDE APRONS | 1"W × 8"L @1/4" accuracy |

Figure 23:
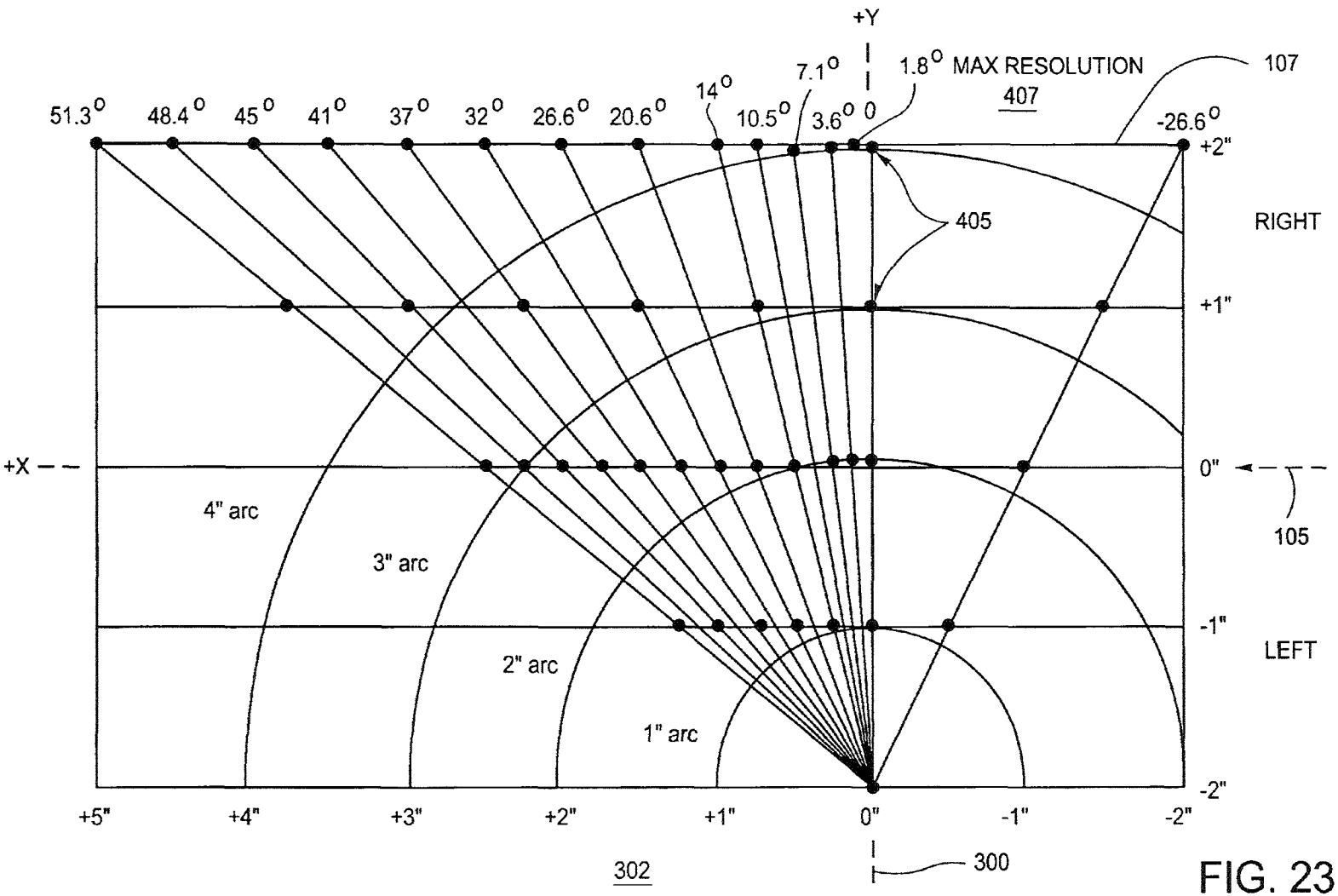
FIG. 23 provides an illustrative overview of the hi-resolution sensor array 302.

FIG. 23 provides an overview of the hi-res sensor array 302. This chart shows the theoretical limits on rotational angles that can be measured within the 4"×7" hi-res sensor area. The horizontal "0" line in the center is the forward X axis 105, while the vertical Zero Line 300 is coaxial with the horizontal Y axis 107, shown in FIG. 14A.

As can be seen from the top row of angles, the 7 inches along X provide a substantial range of measurable rotations from −26°==>+51° with respect to zero reference sensors 405. The four arcs were drawn at 1"==>4" radii to illustrate how the worst-case rotation of a 2" long footprint can be tracked.

The minimum angle detectable [i.e., maximum resolution possible 407] from the hi-res sensor array 302 is shown at the top of FIG. 23. It is almost not discernable at an extremely small 1.8° on this actual size chart [1-to-1 scale]. This is important for being able to detect and track very small angular changes in footprint 205, as will now be explained in greater depth.

In summary, the high resolution sensor array in the illustrative implementation has the following exemplary characteristics:

Overview of Hi-Res Sensor Array 302 range of 51°↔ −27° in angular RH rotation CCW sensors spaced @ ⅛" intervals across Y sensors detect 2" club footprint anywhere from +2">Y>−2"

sensors can next track any amount of footprint rotation

Figure 24:
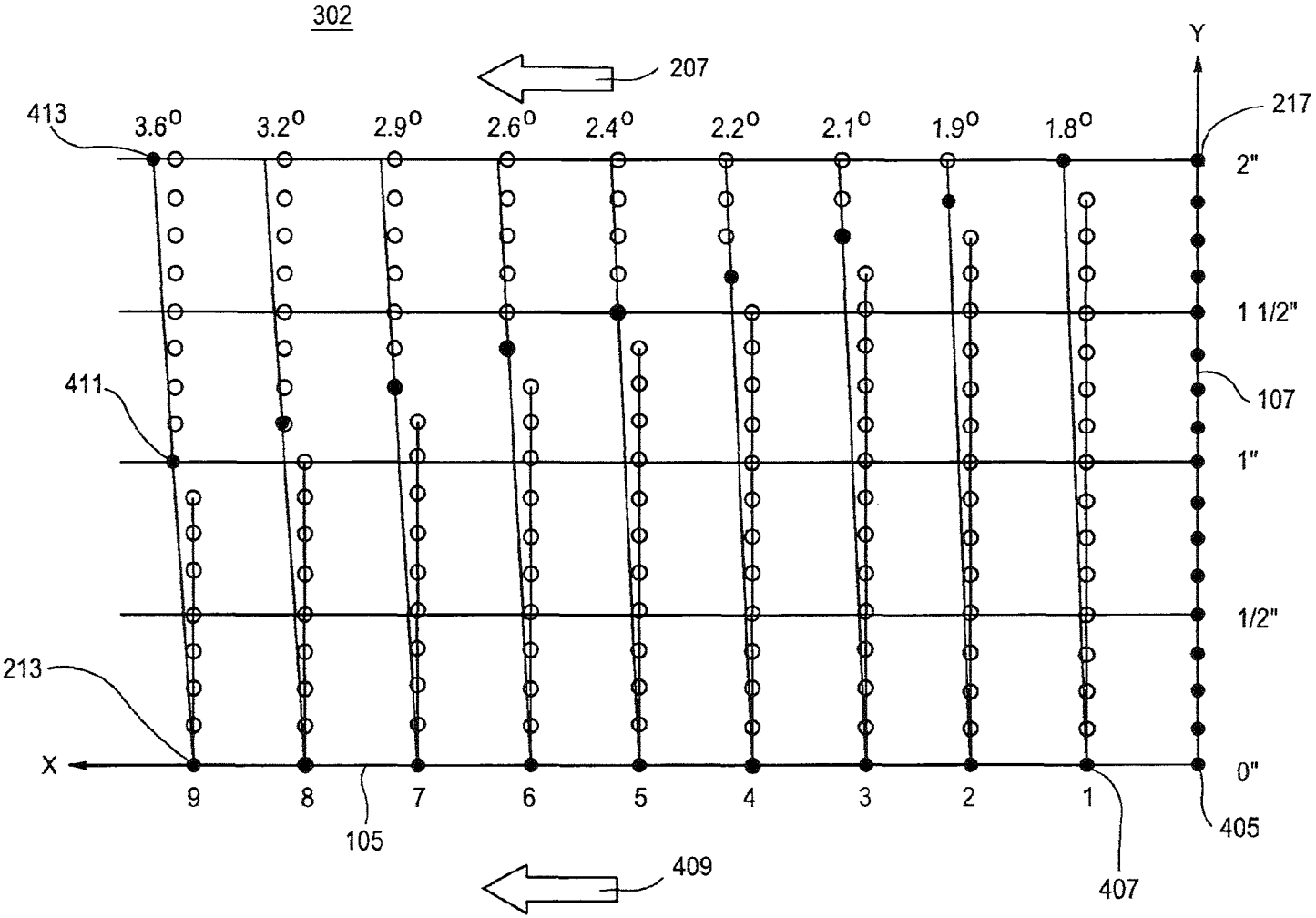
FIG. 24 illustrates how hi-resolution sensor array 302 is capable of measuring club face rotation with a high degree of data integrity.

The MAX RESOLUTION is 1.8° rotation in 1/16" for typical 2" flat footprint of golf club (see next FIG. 24)

FIG. 24 illustrates how hi-res sensor array 302 is capable of measuring any club face rotation down to a minimum angle of, for example, 1.8° [max resolution 407] with a high degree of data integrity. This chart contains a series of row-to-row transitions 409, proceeding from right-to-left across the drawing. Each transition 409 shows a precise angle increment that can be measured with the present hi-res sensor configuration. That is, FIG. 22 shows that array 302 is configured as ⅛" columns [across FIG. 24 here] and 1/16" rows [up and down FIG. 24 here].

At the far right of FIG. 24 are zero reference sensors 405 from which all 9 row-to-row transitions 207 are measured. For example, in the 1st transition for min angle 1.8°, the rotation from zero reference 405 across one row 1/16" away creates the angle 1.8° at the top of the 2-inch length 217. In the 2nd transition, the top 2 sensors turn ON, creating an angle of 1.9°, and so on. In the 9th transition at the far left, the top 9 sensors turn ON, creating an angle of 3.6° that spans a 3rd row ⅛" away. Hence, from 3.6° on out, the rotational angles can actually be measured with twice the level of integrity.

Thus, the hi-res sensor array 302, as presently configured, is capable of measuring the smallest incremental deltas in position, rotation and pressure that might affect a stroke. Such data enables "rule-of-thumb" low-level analyses and all high-level evaluations of golf strokes that deviate from the ideal sand wedge stroke shown in FIGS. 15-16 and tabulated in Tables 1-3.

In the example in FIG. 24, it should be understood that:

the solid vertical line represents LEAD edge of club footprint 2" long for a RH swing, the footprint rotates CCW, as shown above angular (club face) rotation is indicated by footprint 'deltas' in 2 ways:

1) within each footprint, by deltas (transitions) between LEAD and TRAIL edges
2) within successive snapshots, by deltas between farthest LEAD and initial TRAIL edges.

for large rotations>3.5°, as exemplified in the 9$^{th}$ transition:

1) the bottom of the LEAD EDGE of the footprint is anchored in Row N
2) the Angle of Rotation is defined by the depth of the transition into Row NH (1/16" ahead)
3) a large rotation>3.8° will span more than 2 rows starting with Row N+2 (see FIG. 23).

FIGS. 25-34 describe illustrative detailed program flowcharts that support the illustrative embodiment disclosed generally in FIGS. 14-24. FIG. 25 expands the flowchart of earlier FIG. 8.

To avoid confusion, the reader should recognize that, as a convention for all flowcharts and subroutine descriptions herein, the letters X, Y and Z are interchangeably used for 3 independent purposes:

[1] to represent the forward X axis, horizontal Y axis, and vertical Z axis [per FIG. 14A]

[2] to represent 2 sets of sensor/memory rows, such as Lead edge X and Trail edge Y

[3] to act as internal loop counters X/Y/Z, generally incremented as X+1, Y+1, Z+1

FIG. 25 is an illustrative high level mainline program that controls the whole process described herein and calls the first layer of subroutines. In its capacity as overall supervisor, the mainline program does all the system level housekeeping chores, interfaces directly with the golfer, and delegates the workload to its first layer of subroutines. In this example, this includes the primary trainer functions of calibrating the given golf club to a flat bottom edge, detecting the next golf swing, analyzing the data surrounding that swing, and then displaying the results of that swing to the golfer.

The first step after startup is to reset all system level switches and counters and set the system parameters back to their default state (501). The system then displays a start up screen on, for example, an external display 14 or on display 6 for the golfer (503). It then issues, for example, a beep alert and flashes a "Select Mode" (505) message to the user, asking the user for his name, what club he would like, and whether to use auto or manual input mode. The system then waits for the user to enter his name (507), select the manual input mode (509) and select a club (511).

Function block 513 shows some exemplary clubs the user has to chose from, including irons 3-9, pitching wedge, lob wedge, and sand wedge. In the present illustrative example, the user chooses a sand wedge. Had he chosen a 3-9 iron or a pitching wedge or a lob wedge, the mainline routine would have swapped in the appropriate iron subroutine or wedge subroutine (515) and returned to start (525). In this case, with the sand wedge chosen, the program next asks whether right-hand or left-hand has been selected (517), with right-hand being selected in this example.

The routine then checks to determine whether a backswing rotation was selected (519). In this instance, the user has selected a 9:00 backswing. Had he chosen the short 7:30 backswing or a full 10:30 backswing (521), the mainline routine would have swapped in the appropriate 7:30 or 10:30 backswing subroutine (523) and returned to start (535). The program then displays the user's name, the choice of sand wedge and the 9:00 backswing (527).

In this example, the program next issues a beep alert and flashes two messages to the user "Calibrate sand wedge" (529) and "The bottom of the club must be perfectly horizontal" (531).

Figure 26:
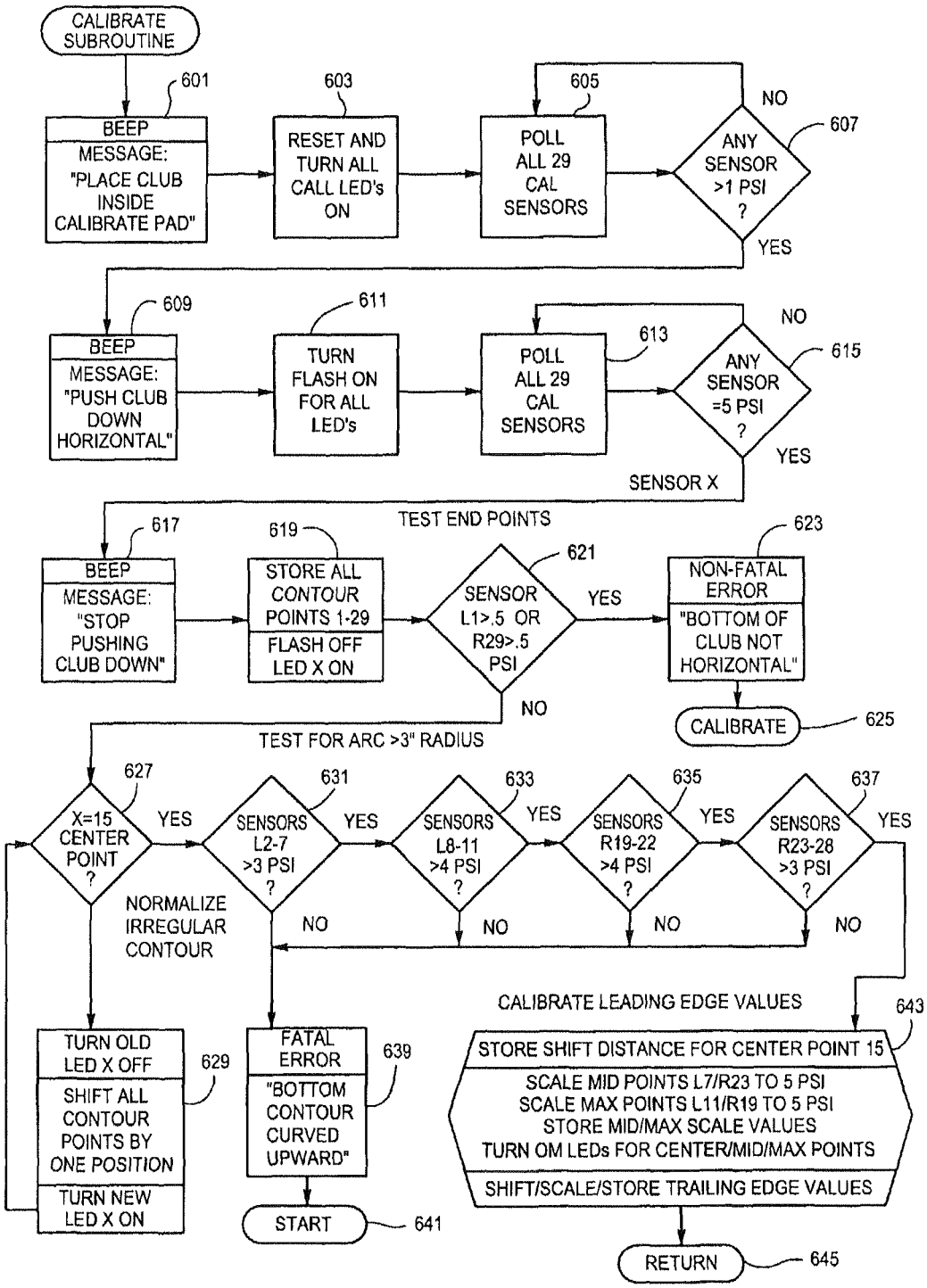
FIG. 26 is a flowchart that delineates the sequence of operations in the CALIBRATE routine, the 1st of 4 primary-level subroutines in an illustrative implementation.

The mainline routine next calls its first major subroutine Calibrate (533), which "normalizes" any irregular bottom edge contour to perfectly flat, as will be shown in the flowchart of FIG. 26.

Once the preliminary step of calibrating the golfer's sand wedge is completed, the mainline routine enters a loop that processes each golf swing, as explained below. When the golfer is ready to take another swing, he hits the reset switch on the mat (535). Upon detection of the golfer's reset, the mainline routine (537) first calls the Detect subroutine (539) which scans for the impact of the golf club on the mat. Once this has occurred, the mainline routine then calls the Analyze subroutine (541) which examines the three-dimensional contact pattern from sensors 2 in the mat 1 and determines what kind of shot would result from such a pattern.

When the subroutine is finished, the mainline routine tests for any system error (543) and ends the program (545) upon such an error. If there is no system error, the mainline routine then calls the final subroutine Display (547) that issues a shot-related message and various forms of feedback containing the results of the last shot taken. The mainline routine repeats this cycle for as long as the golfer wishes to keep swinging. When he is done, and the reset switch remains idle for a preset timeframe (535), system will time out and end the program (536).

FIG. 26 is a flowchart that delineates the sequence of operations in the CALIBRATE routine, the 1st of 4 primary-level subroutines. As shown in FIG. 20B, there is a front row of 29 sensors and matching LEDs for the Lead Edge, and a parallel back row of 29 sensors and LEDs for the Trail Edge. They are numbered 1-14 for the left side, 15 for the center, and 16-29 for the right side, with L7/R23 acting as MID points [½" from center] and L11/R19 acting as MAX points [1" from center].

While only the Lead Edge front row is discussed here, the back row is also processed in parallel in the exact same manner. For this process of 'normalizing' any irregularly curved bottom edge to a flat edge, all 29 sensors have been initially calibrated @ 1-5 psi.

The illustrative program first issues a beep alert and flashes a message to the golfer, "place your club inside the Calibration Pad" [601]. It then resets all internal switches and counters, and turns on all CAL LEDs [603]. It then enters a loop where it polls all 29 CAL sensors [605] until a sensor goes above the Min threshold of 1 psi [607], which indicates the club has been inserted.

The program next issues a beep alert and flashes a message to the golfer, "push your club down perfectly horizontal" [609] and starts flashing all LEDs [611]. It then enters a loop where it polls all 29 CAL sensors [613] until the first sensor X reaches the Max threshold of 5 psi [615], indicating the club has been pushed all the way to the bottom of the pad.

The program next issues a beep alert and flashes the message, "stop pushing your club down" [617], turns off the flashing LEDs, turns the LED X on, and stores all resulting sensor readings as contour points 1-29 for both Lead and Trail edges [619]. At this point, the program checks the end conditions of the sensor array to see if either end of the club is tilted [621]. If so, it issues a non-fatal error message to the golfer "the bottom of your club is not horizontal" and returns to restart CALIBRATE [625] for another try.

If the club passes the horizontal test, the program next enters its process loop to calibrate any sensors left or right of sensor X that are not perfectly horizontal—that is, any sensors that have not reached Max threshold 5 psi.

The first step in the CAL process loop is to see if sensor X is in the middle at center point 15 [627]. If not, the program turns off LED X, shifts all contour points by one position, turns on the LED at new position X, and returns to test for center point 15 again [629].

Once sensor X appears at center point 15 [627], the program next tests whether the sensors left and right of center exceed the max curvature allowed by the system [an arc>3" radius]. It does this by testing 2 groups of end sensors that must be greater than 3 psi [631, 637] and 2 groups of mid sensors that must be greater than 4 psi [633, 635] which indicates that all points on the curved bottom of the club lie on an arc>3" radius. If not, the program issues a fatal error message to the golfer, "the bottom contour of your club is curved upward" [639] and returns to START over [641].

Once this test is passed, the CAL program can calibrate the Lead Edge values in the following sequence [643] prior to its return [645]:

[1] store the original contour values for all 29 sensors
[2] store the shift distance for center point 15 [which may be zero]
[3] scale the MID points L7/R23 up to the max 5 psi reference level
[4] scale the MAX points L11/R29 up to the max 5 psi reference level
[5] store the scale values for MID/MAX
[6] turn on the associated LEDs for center/MID/MAX points
[7] repeat above steps 1-6 for the Trail Edge [usually the same values]

This calibration process serves to 'normalize' the bottom edge of any club, which is generally curved upward on both ends at different arc curve rates, to a flat edge that lies perfectly horizontal for parametric analysis purposes.

Figure 27:
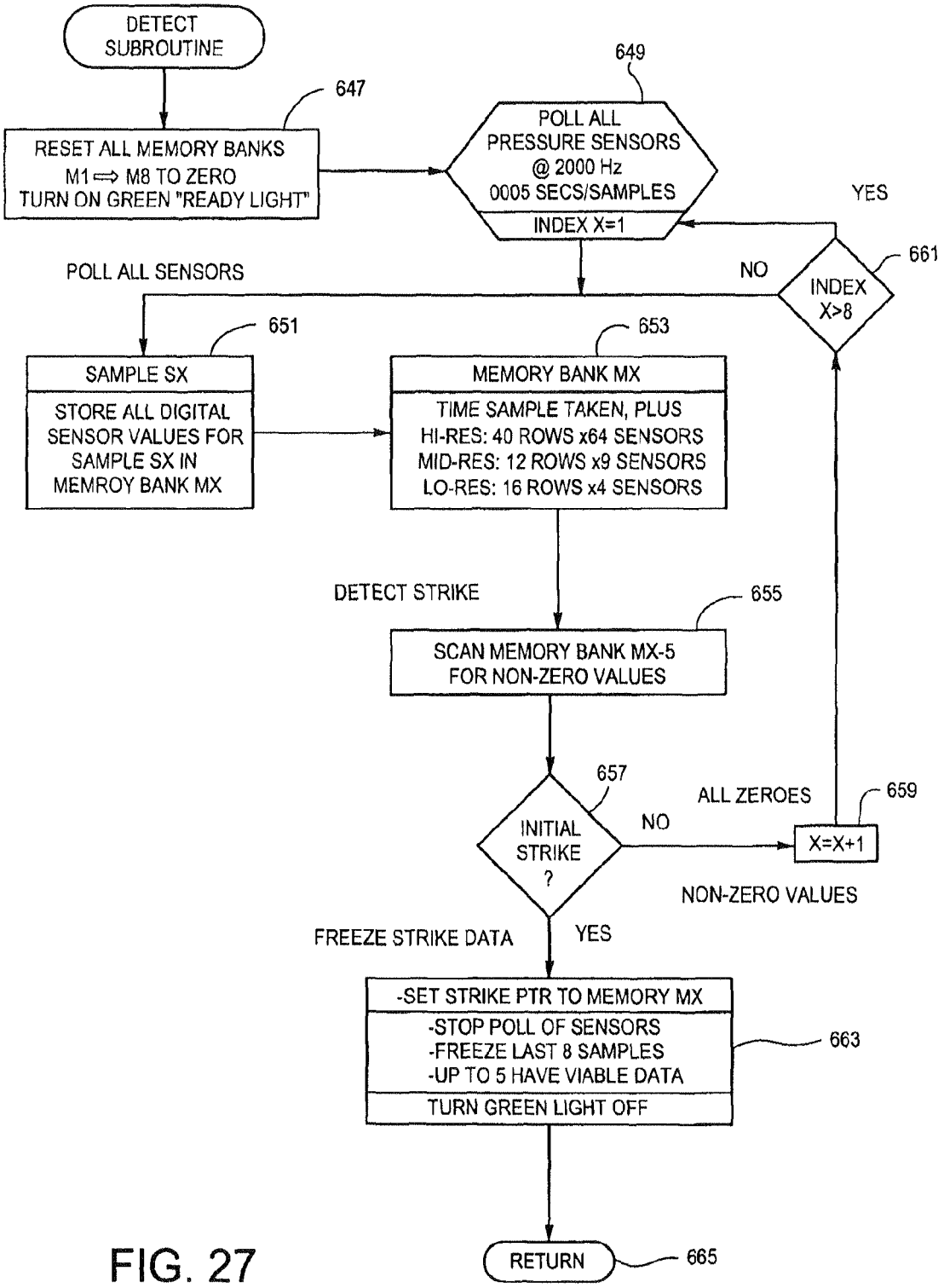
FIG. 27 is a flowchart that delineates the sequence of operations in subroutine Detect which, when launched, monitors the entire sensor array in an illustrative implementation.

FIG. 27 is a flowchart that delineates the sequence of operations in the first Mainline subroutine Detect which, when launched, constantly monitors the entire sensor array 301 for the exact time and place where the club first contacts the mat. It then continues to take successive snapshots 211 of the strike path 127 as the club moves at 80 mph==>120 mph across the mat, until the club eventually lifts up off the mat, as depicted earlier in FIG. 18A.

The subroutine first does its housekeeping chores, primarily resetting all memory banks, e.g., M1==>M8, to zero, and then turns on the green "ready" light [647] to inform the golfer that the system is ready for a swing at any time. The routine then begins to poll [649] the entire array of pressure sensors at a sampling rate of 2000 Hz, which translates to 0.0005 seconds per sample. Note: in this example to optimize the system's highest level of resolution around the average golf swing, the width of the sampling pulse within each 0.0005 seconds can be selectively varied to keep it ON just long enough for the club footprint's Lead Edge 213 to transition across 2 successive sensor rows at 80 mph, as depicted in FIG. 24.

The subroutine then proceeds to cycle through its eight memory banks Mx, starting with the loop index X=1[649]. Thereafter, for each sample X taken [modulo 8], it converts all analog sensor values to digital, and stores them for sample Sx==>memory bank Mx [651]. That is, for each sample Sx, memory bank Mx stores the time the sample was taken, plus A-to-D values from the following arrays of pressure sensors [per FIG. 22]:

[1] 40 rows×64 sensors from the Hi-Res Array 302
[2] 12 rows×9 sensors from the Mid-Res Arrays 403
[3] 16 rows×4 sensors from the Lo-Res Arrays 303 [653]

The subroutine then scans the preceding memory bank Mx-4 [modulo 8] for any non-zero values [655], which signifies that the golf club has finally struck down on the mat. If the data is all zeroes [657], the loop index X is incremented to X+1 [659] and tested for reaching 8 loop passes [661] where it is reset, modulo 8, back to 1 for the next sample Sx [651].

If the memory scan does find non-zero values, the subroutine sets its Strike Pointer to the first non-zero data point in memory bank Mx-4, turns off the green light, stops the polling of sensors [663] begun at [649] and returns to the Mainline [645]. The last five memory banks Mx, Mx-1, . . . , Mx-4 now contain up to 5 snapshots of the current strike path.

It should be noted that in the illustrative implementation off-loading sampled data to 8 memory banks advantageously provides a flexible built-in engineering design feature. The effect of stopping the cyclic polling is to instantly freeze the last 8 samples [i.e., Mx, Mx-1, . . . , Mx-6, Mx-7]. This allows a potentially slower scanning loop [655] to run asynchronously with a potentially faster sampling loop [651]. That is, the extended memory storage allows the current bank being scanned to "drift" slowly away from the current bank storing fresh samples, up to a cumulative maximum drift time of 8 banks×0.0005 secs=40 microseconds. It can likewise be used to accommodate up to 40 microseconds of any fixed "lag time" needed to perform an intervening A-to-D conversion prior to scanning for non-zero digital data. If more time is needed, "n" banks can be added by modifying test [661] to "index X>modulo 8++n".

Figure 28:
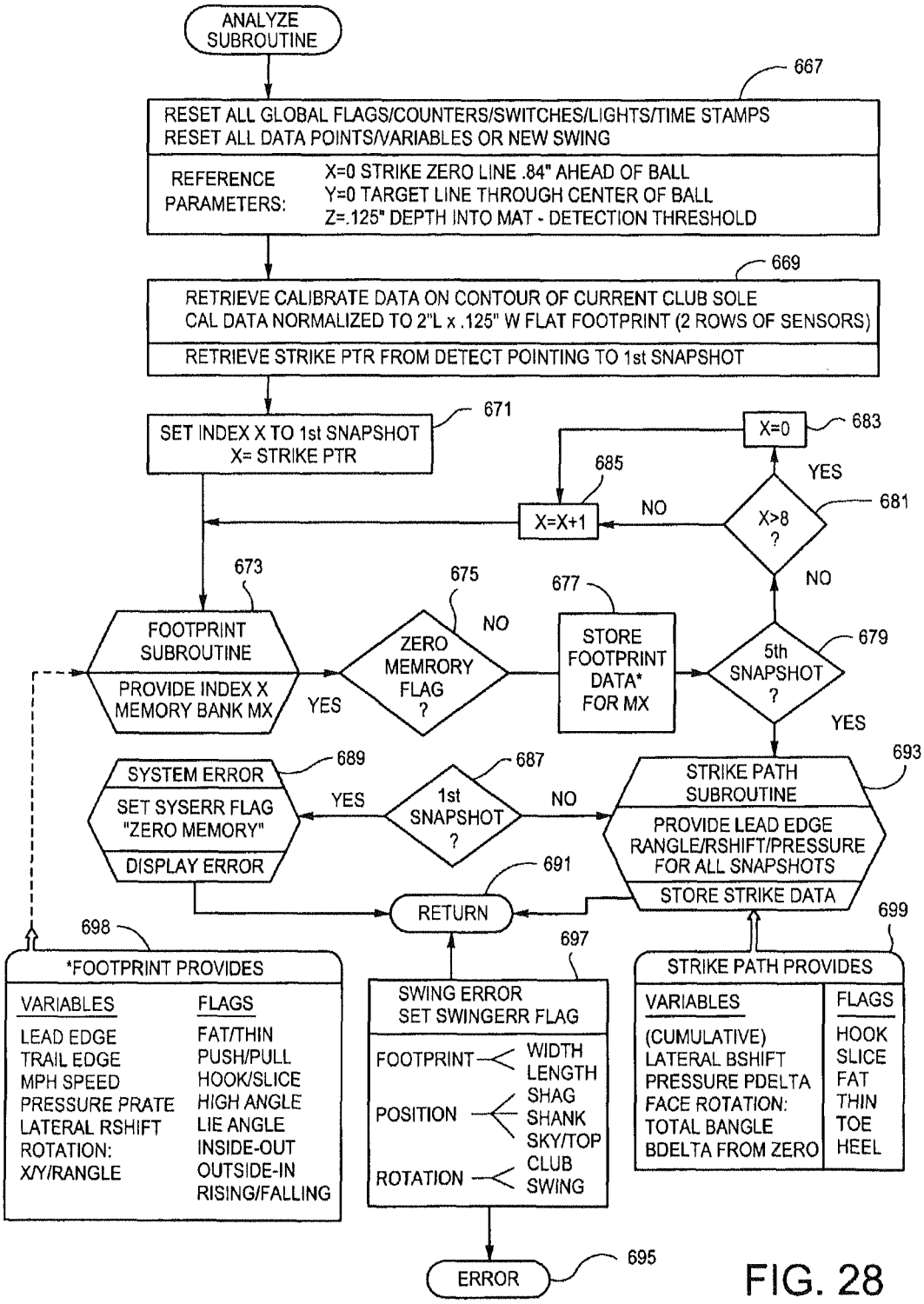
FIG. 28 is a flowchart that delineates the sequence of operations in the subroutine Analyze, which among other things assesses how many independent variables can be isolated and tracked from the range of data available.

FIG. 28 is a flowchart that delineates the sequence of operations in the second Mainline subroutine Analyze, which first assesses how many independent variables can be isolated and tracked from the range of data available. Analyze in this illustrative implementation then evaluates how close each variable came to the threshold of an ideal stroke, classifying wherever possible what type of shot error resulted as a rule-of-thumb.

The subroutine first does its housekeeping chores which, in this case, includes resetting all global flags, counters, switches, lights, and time stamps that are set/reset during first-layer processing, as well as all data points and variables related to each new swing [667].

It then retrieves the CAL data [669] defining the actual contour of the golf club's sole and the center shift and MID/MAX scale factors that normalize the irregular-shaped sole into a standard perfectly flat footprint, 2" long by ⅛" wide [the width of 2 rows of sensors].

Finally, it retrieves the Strike Pointer from the preceding Detect subroutine [669] which points to the first snapshot within memory bank Mx-5 containing the initial strike data.

The subroutine then proceeds to cycle through up to 5 snapshots. It first sets internal loop counter X=Strike Pointer [671] and then calls the Footprint subroutine [673]. Upon Footprint's return, it first checks for a Zero Memory flag [675] which, if it occurs during the first snapshot, is considered a fatal System Error that must be flagged and displayed as a Zero Memory SysErr [689] prior to returning to Analyze [691].

If there is no zero memory flag [675], the subroutine continues on through its primary Footprint loop, storing the most recent Footprint data for snapshot X within current memory bank Mx. The subroutine then checks to see if the loop has reached the 5th and final snapshot [679] and, if not, increments loop counter X [685] after a modulo 8 test [681] and reset [683]. By this process, Analyze goes through Footprint up to 5 times, once for each snapshot.

If it is the 5th snapshot [679] or the Zero Memory flag tells Analyze there is no more data for the next snapshot [687], Analyze then calls the Strike Path subroutine [693] which calculates cumulative data across up to 5 current snapshots. Upon Strike Path's return, it stores all cumulative data generated by Strike Path [693] and returns to Analyze [691].

All variables, flags, and errors generated at this subroutine level are listed at the bottom of FIG. 28. This includes ERROR returns to Analyze [695] reflecting fatal Swing Errors related to the footprint, strike position, or angular rotation [697], forcing an early return to the Mainline [691]. If there were no fatal swing errors, the Footprint subroutine provides all snapshot-by-snapshot data variables and shot-related flags [698]. Finally, if no fatal swing errors were detected through 5 snapshots, the Strike Path subroutine provides all cumulative data variables across the 5 snapshots and any shot-related flags that can be declared from that cumulative data [699].

FIG. 29 is a flowchart that delineates the sequence of operations in the FOOTPRINT subroutine in the illustrative implementation. FOOTPRINT in this example is the first of two 2nd-level subroutines that is designed to extract as much incremental information as possible from a single snapshot, primarily by first eliminating all failed shots for which analysis would have no meaning, and then by analyzing the footprint 205 of all remaining viable shots within each memory bank Mx handed to it by the calling program Analyze.

The following is a function block for the FIG. 29 flowchart:

FUNCTIONS: find LEAD/TRAIL edge calculate current/cumulative MPH

Test fringe areas for failed shots

INPUT PARAMETERS: next memory bank Mx

NOTE: sensor rows are numbered from −3"→+5" in ⅛" increments as −24→+40".

As shown in earlier FIG. 18, much can be learned about the quality of the golfer's swing just from the size of the initial footprint 203 and its horizontal X-Y position and rotational angle 207 [drawn CCW about the Z axis starting from the −Y axis]. Then, expanding this 2D geometric model to 3D, more can be learned from the footprint's initial vertical Y-Z downward pressure and rotational angle from toe to heel [drawn CCW about the X axis starting from the +Y axis] gleaned from small deltas in the pressure gradient 219 across the length 217 of the footprint in the Y-Z plane. Moreover, even more can be learned within each footprint from any small positional and rotational deltas that show up between its Lead edge 213 and its Trail edge 215.

It is noted that the raw sensor data is stored within each memory bank Mx just as it was captured from sensor array 301, namely, as rows −24==>+40 [wherein −Y axis=row 0], which corresponds to all sensor rows from −3==>+5 inches in ⅛" increments Also, each of the 64 rows comprises 16 columns, numbered 1==>64 along the Y axis, which corresponds to the sensor columns from −2==>+2 inches in 1/16" increments.

Footprint first does its housekeeping chores by resetting all local variables [701], including its internal row index X. It then proceeds to define where and how large the footprint is by finding its Lead edge and Trail edge. It does this by scanning down memory Mx from row 40 ==>−24 until it detects the first non-zero row [703], which is the desired Lead edge. If there is no data in Mx, this scan will arrive at the last row −24 without a "hit" [705], which forces a Zero Memory flag [707] and an early Return to Analyze [709].

If this scan does find the Lead edge, i.e., at row X>−24, the subroutine then continues to scan down memory Mx from the next row X−1==>−24 until it detects the first all-zero row [711], which is the desired Trail edge. If the scan stops at the next row X−1[713], then the footprint has no measurable width, which forces a Bad Width flag [715] and an Error return to Analyze [717].

If the footprint is at least two rows wide [713] then the subroutine can store the Lead and Trail edges just found [2×32 data points] which correspond to row X/X−1 and Y/Y−1, respectively [719]. At this point in this example, Footprint has enough information to calculate a rule-of-thumb estimate of the golfer's swing speed, using the formula shown at [721]. This MPH calculation of the club head speed is essentially the sampling rate [2000 samples/second] times the distance the club traveled in one sample [row Y==>row X], divided by the unit rate of speed at 1 MPH [17.6" per second].

As a final check in this example on footprint viability, the subroutine next tests whether either the Lead or Trail edge is less than 1" long. This is because a length of <1" will obscure the location of the center point of the normal-size 2" footprint and preclude measuring most rotational angles. This forces a Bad Length flag [725] and an Error return to Analyze [717].

If both edges are >1" in length [723], Footprint proceeds to scan all sensors in the aprons surrounding the Hi-Res sensor array 302 in an effort to identify any failed shots out in the "fringe areas" of the sensor array 301. It does this by scanning the sensor values [727] from the Lo-Res side aprons 303 and Mid-Res front/rear aprons 403, per FIG. 22.

If there are any Lo-Res hits in the left apron [729] or right apron [737], then the current golf stroke is a "shank" [731] or a "shag" [739], respectively, which forces an Error exit back to Analyze [735] after storing the farthest Lo-Res data point from the Zero Line 300 [733]. If there are any Mid-Res hits ahead of the Zero line [741] or behind the Zero line [743], then the current stroke is a "thin" shot [747] or a "fat" shot [753], respectively.

These latter two shots are still considered viable, so the subroutine first stores the farthest Mid-Res data point from the Zero line [749] and then interpolates all missing ⅛" values [due to the overlapped Mid-Res configuration] to yield a uniform 2" footprint for continuing analysis by subroutine Pressure [745].

If no failed shots are discovered in the "fringe areas", Footprint can then start the detailed analysis of the Lead and Trail edges that it just identified and qualified. It does this by calling its 3rd-layer subroutines, Pressure [745] and Rotate [755], providing them in this illustrative implementation with the club's bottom contour CAL data along with Lead and Trail edge positional data.

Upon return from these 2 subroutines, Footprint stores the results of all their positional and angular calculations. Namely, it stores Rangle, Xangle, Yangle, and Rshift plus 4 shot-related flags from Rotate [757], and it stores Pratio plus 6 shot-related flags from Pressure [759]. Footprint then executes a normal Return back to Analyze [761].

The net value of all these calculations is that, along with the pressure gradient 219 from the raw sensor data, they completely define the footprint in the current memory bank Mx as a 3-dimensional object that has a length of up to 2", a width from the Lead edge to the Trail edge, and a depth contour shaped like the pressure gradient from toe to heel. It is the initial values and changes in position, angle and depth of this 3D object across the mat that help define the quality and direction of the golfer's stroke, as will be described below with the analysis of the other 2nd-level subroutine, STRIKE PATH, at FIG. 33.

FIG. 30 is a flowchart that delineates the sequence of operations in the PRESSURE subroutine in this example, the first of two 3rd-level subroutines, designed to analyze the pressure gradient across the current footprint in memory bank Mx and test for any excessive force, downward into the ground, or "tilted" toward the toe or heel.

The following is a function block for the FIG. 30 flowchart:

INPUT PARAMETERS: LEAD/TRAIL edges pressure values P numbered HEEL1→TOE 16 calibration data<center shift distance scale fore each MID/MAX

FUNCTION: Analyze pressure across footprint

Test for excess downward force: high angle of attack

Test for excess TOE/HEEL pressure: bad lie angle

Lie angle=60°→PTOE=PHEEL→straight shot

Lie angle>60°→PTOE=PHEEL→PUSH shot

Lie angle<60°→PTOE=PHEEL→PULL shot

The former "downward" force is a rule-of-thumb indicator as to how far off the stroke is from the correct vertical shaft alignment. The latter "tilt" force from toe to heel reveals how far the club bottom is from lying perfectly flat, which translates to bad vertical lie angle. That is, if the golfer has swung his club through the ball at the correct built-in, e.g., 60°, lie angle, the bottom will remain perfectly flat as it strikes a path down the mat.

The subroutine first does its housekeeping chores, e.g., by setting its test limits to system defaults [763]. Next, assuming the club sole is slightly curved up at both ends, it sets out to "normalize" the curved bottom by applying the CAL data generated at system startup:

[1] shift all data points by the center shift distance established during the CAL;

[2] apply the scale factors for the right/left Mid and Max points to make them flat

[3] fill in intervening points Center==>Mid==>Max by interpolating the scale factors This normalization process [765] serves to transform any irregular sole contour into a perfectly straight bottom edge that will lie perfectly flat at the preordained 60° lie angle [see FIG. 15B].

Pressure starts off by calculating Pratio [767], which is the ratio of downward pressure at the toe, Ptoe [16th of 16 Lead edge values], to the downward pressure at the heel, Pheel [1st of 16 Lead values] expressed as a percentage. If the pressure P recorded by any sensor exceeds a preset default limit signifying in this illustration that the shaft is tilted forward>20° off vertical [769], the High Angle flag is set [771], which could mature to a "Sky" shot [775] if the Trail edge is <1" behind the ball [773], forcing an early Error return [779].

Assuming no high angle is indicated, Pressure next tests whether the golfer has succeeded at keeping his club flat. That is, if he can keep the toe pressure, Ptoe, within +/−3% of the heel pressure, Pheel, then he is rewarded with a Lie Angle flag [783] and an early Return to Analyze [785]. In an illustrative implementation, this positive feedback flag ultimately tells the output Display routine [FIG. 34] to turn on the sought-after Flat Lie Angle LED 135 [FIG. 21B] which is a commendable achievement for the golfer.

Thus, after shots with no apparent vertical errors are eliminated, all that is left are shots that went astray for one reason or another. Pressure can now assess what type of shot error may have occurred and at what level of severity. In this example, it does this by comparing the toe/heel pressure "delta" to increasing thresholds of severity, preset at 3 default levels: moderate<10% delta; heavy<20% delta; and severe>20% delta.

If Ptoe<Pheel [781], then for shots that veer off to the left of target:

if Ptoe+10%>Pheel [785], then this moderate delta produces a "Pull" shot [786];

if Ptoe+20%>Pheel [787], then this heavy delta produces a "Hook" shot [788];

otherwise, the severe delta>20% of Ptoe produces an uncertain "Shank" shot [789].

If Ptoe>Pheel [781], then for shots that veer off to the right of target:

if Pheel+10%>Ptoe [793], then this moderate delta produces a "Pull" shot [797];

if Pheel+20%>Ptoe [795], then this heavy delta produces a "Slice" shot [798];

otherwise, the severe delta>20% of Pheel produces an uncertain "Shag" shot [794].

Owing to the uncertain nature of the Shank and Shag misfires, which are hit by the hosel and the toe edge respectively, no further analyses can be conducted on them so they exit as a fatal Error [791]. The remaining 4 error shots are still considered viable for further analyses, so they make a normal Return [785].

FIG. 31 is a flowchart that delineates the sequence of operations in the ROTATE subroutine in this illustrative implementation, the second of two 3rd-level subroutines, designed to calculate all row-to-row transitions, as discussed by the 9 examples in FIG. 24. These very small 1/16" transitions can be used to identify and quantify any incremental CCW angular rotation of the club face within each snapshot, as depicted in FIG. 14B.

The following is a function block for the FIG. 31 flowchart:

FUNCTION: calculate row-to-row transitions to find angular rotation of club face INPUT PARAMETERS: LEAD edge (rows X, X−1)

TRAIL edge (rows Y, Y−1)

NOTE: within each row, points are numbered 1→37 from bottom up

Later on in this illustrative implementation, these same incremental rotations per snapshot can be integrated into a larger cumulative rotation across all5 snapshots by the Strike Path routine [FIG. 33]. Since this constant club face rotation is being measured across a greater distance, the cumulative measurement will more accurately define the overall quality of the stroke and which type of shot errors, if any, are working together to send the ball astray, as depicted in FIG. 16.

Rotate performs the same identical rotational analysis on the Lead edge [rows X, X−1] and the Trail edge [rows Y, Y−1] each time it is called by Analyze. To do this it simply sets its internal row pointers, Z and Z−1, first to Lead edge row X and row X−1[801] and, when that loop is done, to Trail edge row Y and row Y−1[802]. In this example, it's only housekeeping chore is to reset its internal Zequal switch [803] at the beginning of each process loop.

Rotate's purpose is to exhaustively test all possible row-to-row transitions, as illustrated in FIG. 24 [for top data points only]. It should be noted here that, within each row of data, there are 32 data points, corresponding to 2" of pressure sensors spaced 1/16" apart, that are numbered 1==>32 from the bottom up, as shown in FIG. 24.

Rotate first tests the top points, Z compared to Z−1[804], to find the direction of rotation:

if Z=Z−1, there is no angular rotation detectable down to the Max resolution of 1.8°;

if Z>Z−1, there is a positive Z angle increasing CCW in an arc to the left of FIG. 23;

if Z<Z−1, there is a negative Z angle decreasing CW in an arc to the right of FIG. 23.

If Z=Z−1 [804], Rotate next tests the bottom points, Z compared to Z−1[833], to confirm the direction of rotation established [at 804]:

if Z=Z−1, there is no angular rotation indicated, so it sets Zequal [835] and Zangle [837];

if Z>Z−1, there is a positive Z angle [809] increasing CCW to the left side of FIG. 23;

if Z<Z−1, there is a negative Z angle [827] decreasing CW to the right side of FIG. 23.

If Z>Z−1[804], Rotate next tests the bottom points, Z compared to Z−1[805], to confirm the direction of rotation established [at 804]:

if Z>Z−1, there is no angular rotation indicated, so it exits out to reset Zangle [837];

if Z=Z−1, there is a positive Z angle [809] increasing CCW to the left side of FIG. 23;

if Z<Z−1, the club is falling down upon the mat [807] so it exits to reset Zangle [837].

If Z<Z−1[804], Rotate next tests the bottom points, Z compared to Z−1[823], to confirm the direction of rotation established [at 804]:

if Z<Z−1, there is no angular rotation indicated, so it exits out to reset Zangle [837];

if Z=Z−1, there is a negative Z angle [827] decreasing CW to the right side of FIG. 23;

if Z<Z−1, the club is rising up off the mat [825] so it exits out to reset Zangle [837].

Depending on the 9 outcomes above, Rotate closes its process loop in one of 3 ways:

For 5 of the outcomes, it resets Zangle to zero [837] indicating there is no rotation;

For 2 of the outcomes, it calculates a positive Zangle [809] as the arctan of 1/Zpoint;

For 2 of the outcomes, it calculates a negative Zangle [827] as the arctan of −1/Zpoint.

Once its process loop is completed, Rotate then tests whether the Trail edge [row Y] has been analyzed [811]. If not, it stores the Zequal/Zangle values into Xequal and Xangle [829] and recycles through its process loop after resetting Zequal [802].

If the Trail edge has been processed [811], it stores the latest Zequal/Zangle values into Yequal and Yangle [813]. Armed with this incremental end point data, Rotate can now calculate its only output value: the average rotation from the Trail edge to the Lead edge [which is the distance from row Y==>row X] as Rangle=(Xangle+Yangle)/2.

Rotate then performs its last process check to see whether the Lead edge or Trail edge indicated any angular rotation within the footprint, which is now reflected by Xequal and Yequal being set [819]. If both are not set, it Returns to Analyze [821]. If both are set, Rotate must call its 4th-level SHIFT sub-subroutine [820] to check whether there is any rotation within the strike path itself. Rotate then executes a Return to Analyze [821].

FIG. 32 is a flowchart that delineates the sequence of operations in the SHIFT sub-subroutine which in this example, despite being the lowest-order module in the entire program flow, declares the highest-order shot errors in the entire golf swing analysis. Namely, it seeks out any Lead-to-Trail lateral position shifts that indicate an inward or outward delta in the golfer's swing arc. This corresponds to an inside-out or an outside-in swing arc that may either help or hurt the resulting trajectory of the ball depending on the angle of the club face, as shown graphically in FIG. 16.

The following is a function block for the FIG. 32 flowchart:

FUNCTION: Test equal-length LEAD/TRAIL edges calculate LEAD-to-TRAIL position shifts to find inward or outward swing variations INPUT PARAMETERS: same as calling routine NOTE: shifts are gradual, often 1/8' per snapshot Shift's purpose is to calculate the amount of lateral shift made by the footprint within the current snapshot: Rshift=(Lead edge−Trail edge) top points/(row X−row Y) [841].

It also double-checks for moderate delta on the pressure profile: Plead<Ptrail+/−10%.

Shift then tests whether Rshift has a non-zero value, which confirms a swing arc delta:

if Rshift>0[843], then the golfer has an inside-out golf swing and a flag is set [845];

if Rshift<0[847], then the golfer has an outside-in golf swing and a flag is set [849];

if Rshift=0[847], then the golfer has a centered golf swing and no flag is set;

for all 3 outcomes, Shift makes a normal Return to Rotate [851].

FIG. 33 is a flowchart that delineates the sequence of operations in the STRIKE PATH routine, the second of two 2nd-level subroutines, which is designed to extract as much cumulative information as possible across all 5 snapshots in this illustrative implementation. By this juncture in the program flow, all failed shots have already been eliminated, so that Strike Path can now analyze the entire strike path 127 of the remaining viable shots within all 5 memory banks Mx, Mx-1, . . . , Mx-4 handed to it by the calling program Analyze. That is, Strike Path can now calculate cumulative deltas in rotational angles, lateral shifts and pressure gradients from 5 successive footprints across the strike path, that inherently carry a 500% greater level of precision than the incremental deltas of a single footprint, as depicted in FIG. 18A.

The following is a function block for the FIG. 33 flowchart:

NOTE: strike path comprises 1-5 snapshots

FUNCTION: this subroutine only looks at HI-RES area every shot in HI-RES gets projected back to ball impact subroutine uses cumulative deltas in angles/shifts/pressure from successive footprints across strike path INPUT PARAMETERS: R angle/R shift across strike path cumulative LEAD edge deltas in position/pressure.

Strike Path first does its housekeeping chores by resetting its local variables and setting its test limits to system defaults for 2 or more snapshots [901]. In order to describe the system at its full capacity here, it is assumed that there are 5 snapshots to be analyzed.

This is established at the outset by testing for just 1 snapshot [903] and, if so, setting the test limits back to a single snapshot [905].

Strike Path first clears the way to calculate cumulative rotational angles by testing for excessive angular rotation by the club face. In this example, it tests if the angle of the 5th footprint>14°, or if that same angle>the angle of the 1st footprint+30%. If so, it sets the fatal error for excess Club Rotation [909] and takes an Error exit.

In this non-limiting example, Strike Path now calculates the cumulative rotational angle across all 5 snapshots [915] and then rotate it backward to the center of the ball to find the club face angle at impact:

$$Bangle=Rangle1-[(Rangle5-Rangle1)/(X5-Y1\text{ inches})]*(Y1+0.84'')$$

where

Bangle is the golfer's club face angle at impact with the center of the ball,

Rangle1 is the first Lead angle upon the club's initial strike,

Rangle5 is the final Lead angle of the last available snapshot 5,

Y1 is the distance of the first Trail angle from the mat Zero Line 300,

X5 is the distance of the final Lead angle from the mat Zero Line 300, 0.84" is the distance from the Zero Line back to the center of the golf ball.

Stated in simple terms, the club face angle at impact Bangle=the initial strike angle−(the rate of angular change)* (the offset distance from the center of the ball)

For relative comparison, Strike Path calculates the angular delta from a perfect strike:

$$Bdelta=Bangle-2.5°*(Y1+0.84'')$$

where

Bdelta is degree of angular error from a perfect strike where the club face angle=0° and Bangle, Y1, and 0.84" are the same as above.

In this example, Strike Path now determines whether the resulting shot went straight or veered off: i.e., if Bangle>5° [917], then the face was closing at impact, resulting in a "hook" [919]; or if Bangle<−5° [921], then the face was opening at impact, resulting in a "slice" [923].

In any event, the illustrative subroutine next calculates the pressure delta across the strike path [929]:

$$Pdelta=Pratio5-Pratio1$$

where

Pdelta is the pressure change from the 1st footprint, Pratio1, to the 5th footprint, Pratio5.

It then tests whether the resulting cumulative toe-to-heel pressure change, Pdelta, is excessive or not [931]. That is, if Pdelta>3%, then the "Toe" gets flagged [933], or else if Pdelta<−3%, then the "Heel" gets flagged [935].

In any event, in the illustrative implementation the subroutine next checks for excessive swing arc rotation. It does this by first testing whether the 5th footprint's lateral shift, Rshift5>½" [937], and second, by testing whether the delta between Rshift5 and the lateral shift of the 1st footprint, Rshift1, was excessive: Rshift5>Rshift1+30% [943]. If either case was true, it sets the fatal Swing Rotation error [939] and takes an Error exit.

In this example, Strike Path can now calculate the cumulative lateral shift across all 5 snapshots [945] and then shift it backward to the center of the ball to find the club face's position at impact:

$$Bshift=Rshift1-[(Rshift5-Rshift1)/(X5-Y1\text{ inches})]*(Y1+0.84'')$$

where

Bshift is the golfer's club face lateral position at impact with the center of the ball, Rshift1 is the first Lead edge shift upon the club's initial strike, Rshift5 is the final Lead edge shift of the last available snapshot 5, Y1 is the distance of the first Trail edge shift from the mat Zero Line 300, X5 is the distance of the final Lead edge shift from the mat Zero Line 300, 0.84" is the distance from the Zero Line back to the center of the golf ball.

Armed with the Bshift at ball impact, the subroutine can now declare positional errors:

if Bshift>1.25", the club heel was shifted toward the ball producing a "Shank" [949];

if Bshift<−1.25", the club toe was shifted toward the ball producing a "Shag" [953];

if either is true, the subroutine has nothing more to analyze and takes an error exit [911].

Otherwise, Strike Path looks at how far the initial strike was behind or ahead of the ball:

if the initial Trail edge<−1" behind the Zero Line, then this is a "Fat" shot [957];

if the initial Trail edge>+1" ahead of the Zero Line, then this is a "Thin" shot [957].

In any event, Strike Path can now finally check for the last fatal shot errors, based on two pairs of flags set earlier by different subroutines in the program flow:

if the "Club Rising" and "Thin Shot" flags are set, then this is a "Topped" shot [963];

if the "Club Falling" and "Fat Shot" flags are set, then this is a "Sky" shot [969];

if either is true, Strike Path takes an Error exit [965]; if not, it takes normal Return [971].

FIGS. 34 A and B is an illustrative flowchart that delineates the sequence of operations in the 4th of 4 primary subroutines in this example, which is also the third and final Mainline subroutine DISPLAY, providing feedback as to the results of the current golf swing to the golfer. It should be understood that feedback may be provided in any one or combination of the diverse feedback types described herein. For purposes of illustration of the wide range of feedback contemplated herein, the exemplary feedback of the illustrative embodiment is offered in 8 different formats at 6 different levels via 4 different media:

TABLE 4

Formats of Output Feedback

| Type of Feedback | Format | Level | Media |
|---|---|---|---|
| Shot Angle Left/Right | Array of L/R lights | Shot direction | LEDs |
| Shot Errors/ Failed Shots | Dedicated Lights | Shot errors/ results | LEDs |
| Club Face Position/Angle | Positional light circle | Strike line position | LEDs |
| Alpha-numeric [above data] | ID, numbers, symbols | [all 3 above] | Display |
| Shot/Swing Ratings | Percentages, graphs | Current shot results | Display |
| Trend Analysis | Numbers, graphs, etc. | All shots over time | Display |
| 3D ball trajectory | Visual graphics | Current shot results | 3D graphics |
| Causes of shot errors | Verbal/Visual cues | Current shot results | Portable |

It is noted that the type, format, level, and media used to present this feedback is merely exemplary, and could be easily presented in a variety of other, effective ways and means. It is also noted that, between the LEDs and Display media, the shot data feedback to the golfer is redundant by design [see LED description at FIG. 16], but different as to the effect of flashing LED lights on the mat, versus alpha-numeric numbers, symbols, graphs, etc. that must be interpreted on a generic CRT or LCD display. On the other hand, the LCD has the advantage of being able to selectively elaborate, e.g., on a given shot error. In any event, the golfer has the choice of which display format is easier to work with.

It should be understood that, in any given implementation, the type of feedback and the media selected will be tailored to the application goals including cost considerations. For example, only LED displays may be used, if desired, in a low cost implementation. In other implementations where cost is not a major consideration, all the forms of feedback described herein may be provided.

Figure 34A:
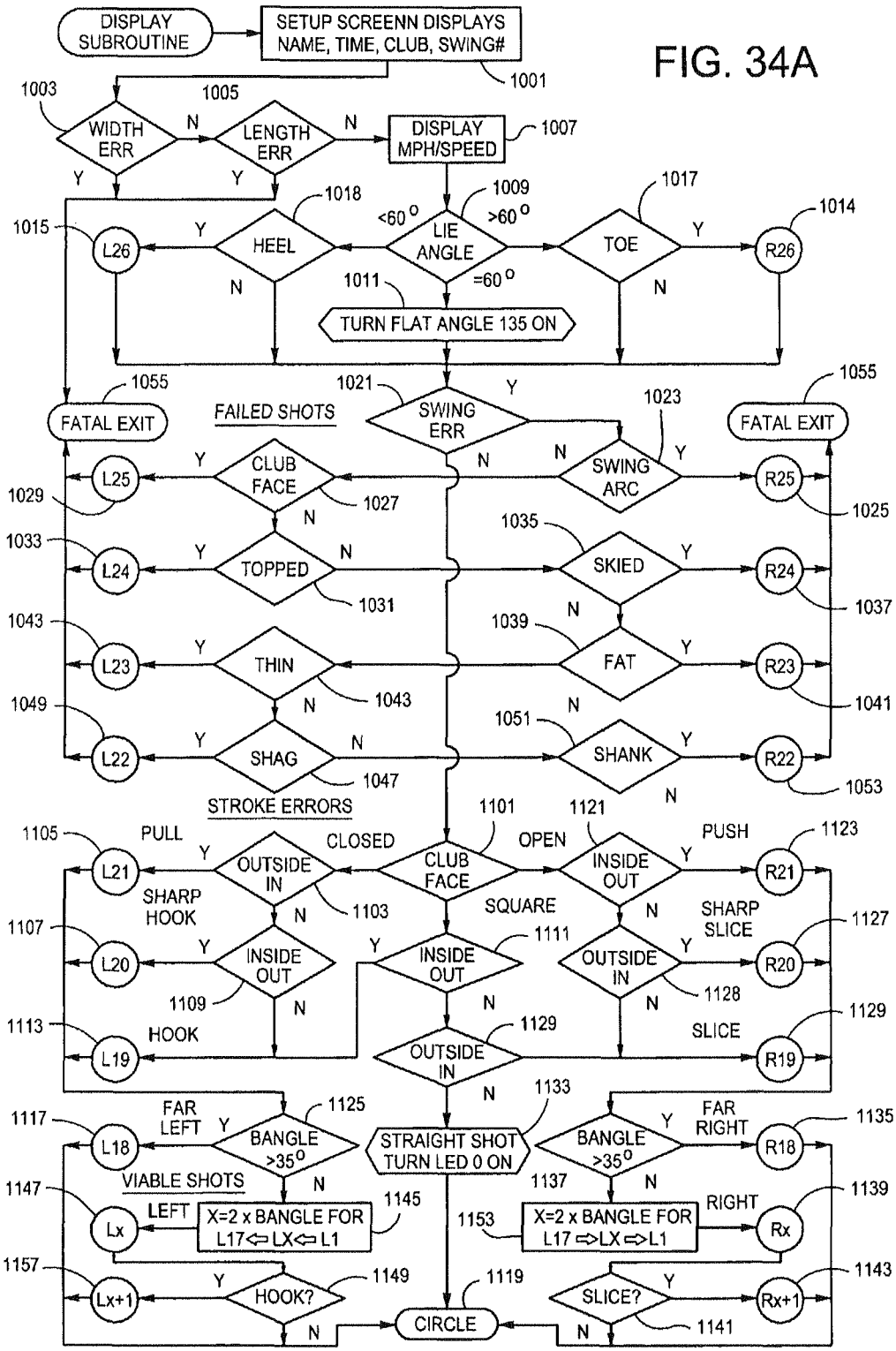
FIGS. 34A and 34B are flowcharts that delineate the sequence of operations of the DISPLAY subroutine in an illustrative implementation.

In this implementation, the Display subroutine operates on the multitude of variables/flags/errors from Analyze, which are listed at the bottom of FIG. 28, to generate parallel shot-related outputs for LCD display 6 and the LED arrays built into the mat, as shown generally in FIG. 16 and in greater detail in FIG. 21B. The flow of the flowchart shown here in FIG. 34A is a top-to-bottom mirror image of the LED array of FIG. 21B, which "declares" the various shot errors depicted earlier in FIGS. 15 and 16. The LEDs of FIG. 21B and the flowchart of FIG. 34A are segmented in this example into four distinct levels of shot viability:

TABLE 5

LED Levels of Shot Viability

| Level | Viability | LED[s] | Predictability from Data Available |
|---|---|---|---|
| 1 | Ideal Shot | 0 [center] | shot data predicts a shot trajectory directly on target |
| 2 | Viable Shots | 1==>17 | enough data to predict at least a starting trajectory |
| 3 | Stroke Errors | 18==>21 | shot may be viable, but doesn't head toward target |
| 4 | Failed Shots | 22==>26 | not enough data to plot a shot direction or trajectory |

Among these four levels, a failed shot [4] may be partially attributable to a shot error [3], such as "club face rotated excessively" [level 4] may lead to a "sharp hook" [level 3]. Similarly, a viable shot [2] may be degraded by one or more stroke errors [3], such as viable shot initially heading off "straight at 6° off target" [level 2] could be aggravated by an inside-out swing arc into a "hook at 8°±off target" [level 3]. Taken to the extreme, an ideal shot [level 1] is essentially a viable shot [level 2] aimed straight at the target without any stroke errors [level 3].

FIG. 34A is divided into 3 major areas: the center follows a straight line down from an ideal lie angle @ 60°, through no detected shot errors, to the desired "straight shot" to the target, signified by LED "0". On the left side are left-oriented LEDs L26==>L22 for failed shots [level 4 above], L21==>L18 for stroke errors [level 3], and L17==>L1 for viable shots [level 2]. On the right side are the corresponding right-oriented LEDs R26==>R22 failed shots, R21==>R18 stroke errors, and R17==>R1 viable shots.

The following is a function block for the FIG. 34A flowchart:

inputs from analyze subroutine (listed at bottom FIG. 28)

outputs to display 6 and LEDs on the mat (FIG. 19)

LED array shown on FIG. 21B as center 0, 1-17 viable shots, 18-26 errors.

In FIG. 34A, Display begins by setting up the shot feedback screen on display 6, including, in this example, the golfer's name, date and time, type of club and swing number [1001]. It first checks for a fatal Width error [1003] and Length error [1005] in the size of the footprint.

If there is one, it takes the FATAL exit [1055] to the end of the program.

If there are no footprint errors, it displays the MPH speed [1007] and tests the lie angle [1009]. If the lie angle is a perfect 60°, Display turns on the desired green "flat angle" LED [1011]. Otherwise, if the lie angle is <60°, it tests the "HEEL dug-in" error [1013] and, if so, sets LED L26 [1015]. As a mirror image, if the lie angle is >60°, it tests the "TOE dug-in" error [1017] and, if so, sets LED R26 [1019]. In any event, all of these paths next flow toward the center to check whether there are any Swing Errors [1021].

In this illustrative implementation, if there are Swing Errors [1021], Display proceeds to test each "failed shot", starting with "excessive swing arc, in or out" [1023] where, if so, it sets R25 [1025]. It next proceeds to test for "excessive club face rotation, open or closed" [1027] where, if so, it sets L25 [1029]. In the same way, it then proceeds to test the remaining failed shots sequentially: "TOPPED" shot [1031] setting L24 if true, then "SKIED" shot [1035] setting R24 if true, then "FAT" shot [1039] setting R23 if true, then "THIN" shot [1043] setting L23 if true, then "SHAG" [1047] setting L22 if true, and finally "SHANK" [1051] setting R22 if true. In all above cases, the subroutine takes the FATAL exit [1055] to the end of the program.

If there are no Swing Errors [1022], there are no more "failed shots", so Display proceeds down the center to test the club face [1101]. If the club face is closed, it goes left to test for shots going left. It first tests for an "outside-in swing arc" [1103] where, if so, it sets L21 to reflect a "PULL" shot [1105]. If not, it next tests for an "inside-out swing arc" [1107] where, if so, it sets L20 to reflect the two CCW forces combining into a "sharp hook left" [1109]. Otherwise, it sets L19 to reflect a simple "HOOK" shot left [1113]. This outcome is also created by a square club face [1101] combining with an "inside-out swing arc" [1111] which also yields a simple "HOOK" at L19 [1113]. All the above outcomes flow down to next test if the club face Bangle is >35° at impact [1115].

If the club face is open [1101], Display goes right to conduct a series of mirror image tests for shots going right. It first tests for an "inside-out swing arc" [1121] where, if so, it sets R21 to reflect a "PUSH" shot to the left [1123]. If not, it next tests for an "outside-in swing arc" [1125] where, if so, it sets R20 to reflect the two CW forces combining into a "sharp slice right" [1127]. Otherwise, it sets R19 to reflect a simple "SLICE" shot right [1131]. This outcome is also created by a square club face [1101] combining with an "outside-in swing arc" [1129] which also yields a simple "SLICE" at R19 [1131]. All the above outcomes flow down to next test if the club face Bangle is >35° at impact [1133].

At this point in the program flow, it should be noted that, in this example, any shot with Bangle>35° is considered a non-viable stroke error. Even though the system can easily continue to process shots with a club face angle>35°, it is of little value for the golfer to know and/or watch his shot going 50 yards far left or right out of play into the next fairway. Therefore, only shots with club face<35° are considered viable and further processed.

Thus, on the left side of FIG. 34A, if Bangle>35° [1115], Display sets L18 to reflect a shot "far left" out of play [1117]. If Bangle<35°, it proceeds to examine the golfer's viable shots to the left by calculating [1145] the appropriate LED Lx to light up [1147]:

Turn on LED Lx, where x=2 times Bangle for any LED between L17<==Lx<==L1

As a final step, Display next checks whether L19 is ON reflecting a HOOK [1149], and if so, sets LED Lx+1 [1151] to signify a "HOOK" left. All above outcomes from L18 on down exit at the bottom to Display process CIRCLE [1119] shown on FIG. 34B.

Similarly, as a mirror image on the right side of FIG. 34A, if Bangle>35° [1133], Display sets R18 to reflect a shot "far right" out of play [1135]. If Bangle<35°, it proceeds to examine the golfer's viable shots to the right by calculating [1137] the appropriate LED Rx to light up [1139]:

Turn on LED Rx, where x=2 times Bangle for any LED between R1==>Rx==>R17

As a final step, Display next checks whether R19 is ON reflecting a SLICE [1131], and if so, sets LED Lx+1 [1143] to signify a "SLICE" left. All above outcomes from R18 on down exit at the bottom to Display process CIRCLE [1119] shown on FIG. 34B.

Moreover, if the current shot has survived the process flow from Lie Angle=60° [1009] down the center of FIG. 34A through tests for a square club face [1101], no arc swings inside-out [1111] or outside-in [1129], then the shot can be declared as the coveted "STRAIGHT SHOT" to the target [1153] for which Display turns on LED "0" and exits to CIRCLE [1119]. This is the ultimate output this practice trainer is intended to promote.

Figure 34B:
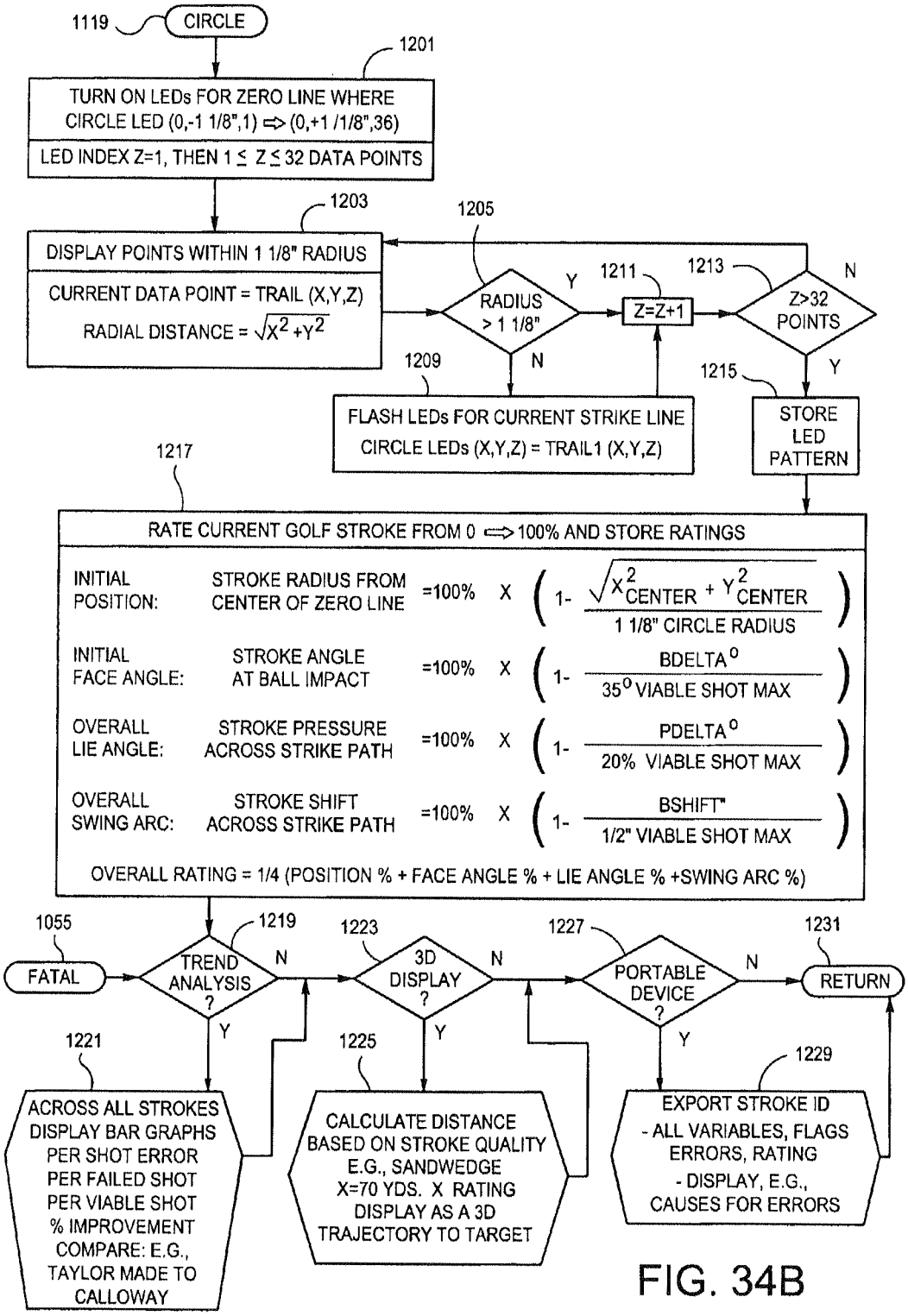

FIG. 34B is divided into three major areas: at the top is the process for "mapping" the golfer's initial Strike Line into the Feedback Circle 307, shown generally on the mat of FIG. 19, and more specifically in FIG. 21A; in the middle, in accordance with one illustrative implementation, are some exemplary formulas as to how the current golf stroke can be rated on a scale of 0==>100% to make the "raw" data more meaningful from a practical result-oriented perspective; at the bottom are some exemplary post-processing feedback mechanisms to extend the raw data in three very different, but valuable directions—namely, trend analysis, 3D graphics, and portable device feedback.

The following is a function block for the FIG. 34B flowchart:

STRIKE LINE=TRAIL EDGE 1 comprising data points 1→32 accessed via LED index Z LEDs in feedback circle 307 are a mirror-image of the HI-RES sensors (X, Y, Z) 302 within 1⅛" radius of the center of zero line (1→36 data points).

Display continues from FIG. 34A at the CIRCLE entry point in FIG. 34B [1119]. In this example, it first turns on the green LEDs for the Zero Line to provide a visual comparison for the golfer's initial Strike Line 203 elsewhere in Feedback Circle 307 [see FIG. 21A]. It does this by running internal index Z from 1==>36 to turn on all 36 LEDs corresponding to the Zero Line, observing the following LED algorithm [1201] holding X=0:

Turn on Circle LED Z=ZeroLine (0, −1.125+Z, Z), where Z runs from 1<=Z<=36

To initialize "mapping" the Strike Line into the Feedback Circle, Display first resets the internal index Z=1[1201] and then proceeds to turn on all 32 LEDs corresponding to the Trail Edge 1 of the initial Strike Line. It does this by first testing the viability of each data point Z comprising Trail Edge 1 of the initial Strike Line, observing the following data algorithm [1203]:

Test current point Z=TrailEdge (X, Y, Z), where Z runs from 1<=Z<=32, and its radial distance Rz from the circle origin "0" is the square root of (Xsquared+Ysquared).

Display next tests if current data point Z lies beyond the 1⅛" radius of Feedback Circle 307 [1205] and, if so, skips to increment index Z [1211]. But, if it is within the 1⅛" radius, it then turns on each LED corresponding to Trail Edge 1 of the initial Strike Line, observing the following LED algorithm [1201]:

Flash red Circle LED (X, Y, Z)=TrailEdge (X, Y, Z), where Z runs from 1<=Z<=32

After incrementing index Z [1211], Display next checks if it has processed all 32 data points [1213] and, if not, returns to test the next data point [1203]. If it has finished, Display stores the resulting LED pattern for later display on the LCD/CRT display. [1215].

In this example, Display next rates the current golf stroke on a scale of 0==>100% and stores the results. The ratings herein are intended to be illustrative. Empirical data and additional or different criteria may be utilized to tailor ratings to enhance the accuracy of the rating as desired. In this example, Display rates the stroke by the degree of relative variation, or 'delta', from an ideal reference value, such as the Zero Line and "squared up" face upon impact with the ball [1217]:

TABLE 6

Parameters for Rating the Current Golf Stroke

| Parameter | Where measured | Value of Parameter |
|---|---|---|
| Radius | from center of Zero Line | Shows how close initial Strike was to Zero Line |
| Bdelta | At impact with ball | Shows how close club face was to squared up |
| Pdelta | Across entire strike path | Show how close club shaft was to lie angle |
| Bshift | Across entire strike path | Shows how close swing arc was to centered |
| Overall | all 4 weighted equally | single metric to quantify stroke for comparison |

It is noted that these rating formulas [1217] are based on absolute values for Bdelta, Pdelta, and B shift. The resulting Overall rating weights each of the 4 parameters equally, but empirical data from future use of this trainer may ultimate suggest the first parameter, radial distance of the Strike Line from the Zero Line, exerts far more than 25% influence.

Upon completing the ratings, Display proceeds to query its higher-level outputs, which is the reentry point for all FATAL shots [1055]. It first tests if a trend analysis has been selected, e.g., via Mode Control Input 10 [1219]. If so, Display performs a trend analysis across all strokes by the same golfer and displays the results, e.g., as bar graphs [1221]. Such analysis could examine, for example, the ratio of viable shots to failed shots, what failed shots are prevalent, which shot errors dominate the golfer's viable shots, what percentage improvement the golfer is making over time in each given category, etc. Further, as described further below, a bar graph may be used in an "optimum club selection" mode to demonstrate, for example, that a TaylorMade 5 iron is a better fit for a given golfer than the same club manufactured by Callaway.

Display next queries whether a 3D display of the current shot or a previous shot has been selected [1223]. If so, Display provides all pertinent trajectory data to a 3D visual graphics engine [1225]. It would also calculate a rule-of-thumb flight distance based on previously stored shot distance data, as shown in FIG. 5A, based on overall stroke quality—e.g., for a sand wedge, in an illustrative implementation, the distance gradient X might equal 70 yards times the overall rating up to 100% [1217]. The resulting graphics would display the flight path of the ball's trajectory toward the target, as depicted in FIG. 13, including any "hook" or "slice" indicated by the data.

Display next queries whether export to, or import from, a wireless portable device 14 has been selected [1227] as shown in FIG. 4. Exporting the current shot data could be used, for example, to update the golfer or a second remote party, such as a golf instructor, as to the results of the current shot, including all significant variables, flags, errors, and ratings [1229]. The hand-held display could then, for example, retrieve verbal audio files and/or tutorial video clips of possible causes for the dominant shot errors identified and what the golfer should do to correct them. The wireless device could also be used to import, for example, specific recommendations on-the-fly from a 'live' instructor as to how to make such corrections on the next swing.

Finally, after clearing all three post-processing queries, Display returns to the calling program [1231] to reset the entire program, upon command, for the golfer's next swing.

The golf training apparatus described herein (particularly the immediately preceding illustrative implementation) may be advantageously utilized to assist in the selection and/or fitting of the optimum golf club, e.g., TaylorMade, Callaway, Ping, etc., tailored to the swing of a user. For example, in accordance with an illustrative implementation, a user may select, e.g., by clicking on an options menu, an optimum club selection mode of operation. The user may then take, for example, five (or ten) swings with a TaylorMade five iron and five (or ten) swings with a Callaway five iron. The club face contact data for each club is then processed and stored, for example, in the manner described above. For example, the output of FIG. 34B, block 1219 may be utilized and bar graphs comparing the strokes with each club may be generated as per block 1221 of FIG. 34B. A comparison of such contact data and shot projection analysis for each club is then made to determine if one club yielded statistically significantly better results than the other club based upon the impact sensor data analysis described above.

In accordance with an illustrative implementation, a recommendation may be displayed to the user as to which club, if any, yielded the better results and was determined to be a better club for that user.

In accordance with an illustrative implementation, this club selection analysis may be augmented by utilizing stored optimum contact data measured based upon the data obtained from a golf professional for each club. In this fashion, even without comparing one manufacturer's club with another manufacturer's club, a comparison of the user's contact data with the optimum data may be used to determine if a given club is appropriate for a user by determining that the user obtained results within a predetermined threshold of the optimum.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A golf swing feedback generating system for use by a user practicing a golf swing with a golf club having a golf club head comprising:

a practice mat for use by a user practicing a golf swing;

a golf club head sensor being operable to generate golf club head impact position-related data, said golf club head impact position-related data being generated during a practice swing of said golf club in response to impact of said golf club head being detected by said golf club head sensor and being generated independent of whether the golf club head is striking a golf ball;

a memory for storing said golf club head impact position-related data;

a processor operatively coupled to said golf club head sensor and said memory and configured to execute instructions for accessing said golf club head impact position-related data, and for determining the impact position of the golf club head, said processor being configured to determine a characteristic of the user's practice golf swing related to the impact position of the club head; and an output mechanism operatively coupled to said processor for identifying to said user said characteristic of the user's practice golf swing related to the impact position of said golf club head during said practice swing.

2. A golf swing feedback generating system according to claim 1, further including a target on said practice mat disposed in an area of desired contact of the club head with the practice mat; wherein said practice mat includes a golf ball indicator, disposed adjacent to said target, identifying the position at which the user should assume the presence of a golf ball during said practice swing.

3. A golf swing feedback generating system according to claim 2, wherein the area of desired contact corresponds to an area where a divot would have been made on a golf course fairway after ball contact if an actual golf ball had been placed at the indicated position of a golf ball.

4. A golf swing feedback generating system according to claim 1, wherein said golf club head impact position-related data includes data defining a line formed by the bottom sole of the golf club head making initial contact with the mat during said practice swing.

5. A golf swing feedback generating system according to claim 1, wherein said characteristic of the user's practice golf swing is selected from the group consisting of the club face was open at impact, the club face was square at impact, and the club face was closed at impact.

6. A golf swing feedback generating system according to claim 1, wherein said characteristic of the user's practice golf swing is that the swing would have resulted in a fat shot.

7. A golf swing feedback generating system according to claim 1, wherein the golf club head sensor is an impact sensor disposed in said practice mat and said impact sensor comprises an array of pressure sensors.

8. A golf swing feedback generating system according to claim 1, wherein said processor is operable to process said golf club head impact position-related data to determine if the golf club head was open at impact during said practice swing.

9. A golf swing feedback generating system according to claim 1, wherein said processor is operable to process said golf club head impact position-related data from a plurality of practice swings, and determine if there is a recurring swing characteristic related to a user's golf swing, and wherein said output mechanism is operable to communicate to said user the determined recurring swing characteristic.

10. A golf swing feedback generating system according to claim 1, wherein said processor is configured to generate a simulation of golf ball motion on a simulated golf hole using said golf club head impact position-related data, wherein said output mechanism is a display that displays said simulation of said golf ball motion that is a function of said golf club head impact position-related data.

11. A golf swing feedback generating system according to claim 1, further including an input device for a user to input data relating to the extent of the backswing of a practice swing.

12. A golf swing feedback generating system according to claim 1, wherein said processor is configured to generate a three-dimensional display simulating a golf shot based upon said golf club head impact position-related data.

13. A golf swing feedback generating system according to claim 1, wherein said output mechanism includes a speaker operatively coupled to said processor for providing golf stroke-related audio to a user relating to said characteristic of the user's practice golf swing.

14. A method of operating a golf swing feedback generating system including a golf practice mat having an impact area for a user practicing a golf swing with a golf club having a golf club head and providing golf swing-related feedback to a user, said method comprising:

generating golf club head impact position-related data during a practice swing of said golf club by the user of said practice mat independent of whether the user is striking a golf ball;

storing said golf club head impact position-related data;

accessing said golf club head impact position-related data by a processor;

determining by said processor the disposition of the golf club head upon impact during said practice swing;

determining a characteristic of the user's practice golf swing by said processor using said golf club head impact position-related data; and communicating to said user said characteristic of the user's practice golf swing related to said golf club head impact position-related data.

15. A method according to claim 14, wherein said step of determining a characteristic of the user's golf swing includes generating golf club head angular disposition-related data during a practice swing by detecting golf club head contact pattern data generated upon contact between said golf club head, and an impact area of the practice mat.

16. A method according to claim 14, wherein said practice mat includes a target indicator and wherein the step of determining a characteristic of the user's practice golf swing by said processor includes analyzing golf club head impact position-related data with respect to the location of said target indicator.

17. A method according to claim 14, further including the step of generating by said processor a golf club stroke yardage indicating signal.

18. A method according to claim 14, wherein the communicating step includes generating a three-dimensional golf swing-related display depicting ball flight on a simulated golf course hole indicative of the projected result of the practice golf swing by the user.

19. A method according to claim 14, further including the step of displaying an indication of the points of initial contact between the golf club head and the impact area of the practice mat.

20. A method of operating a golf simulating display generating system including a golf practice mat for a user practicing a golf swing with a golf club having a golf club head and providing ball flight-related feedback to a user using said practice mat, said method comprising the steps of:

generating golf club head impact position-related data during a practice swing of said golf club by a user standing on said practice mat independent of whether the user is striking a golf ball;

analyzing, by a processing device, the golf club-head impact position-related data during said practice swing;

determining, by said processing device, the golf club head position at impact and the projected direction a golf ball would be directed if struck by said golf club head at the detected impact position based upon an analysis of the golf club impact position-related data; and displaying under the control of said processing device, a simulation of the flight of a golf ball using said golf club head impact position-related data.

21. A method according to claim 20, wherein said determining step includes projecting that the ball flight will be to the right of a target direction, left of a target direction, or straight at the target direction depending upon the generated golf club head impact position-related data.

* * * * *